United States Patent [19]

Minamitaka et al.

[11] Patent Number: 4,958,552

[45] Date of Patent: Sep. 25, 1990

[54] APPARATUS FOR EXTRACTING ENVELOPE DATA FROM AN INPUT WAVEFORM SIGNAL AND FOR APPROXIMATING THE EXTRACTED ENVELOPE DATA

[75] Inventors: Junichi Minamitaka, Fussa; Kunio Sato, Sagamihara; Mayumi Ino, Akishima, all of Japan

[73] Assignee: Casio Computer Co., Ltd., Tokyo, Japan

[21] Appl. No.: 408,412

[22] Filed: Sep. 14, 1989

Related U.S. Application Data

[63] Continuation of Ser. No. 117,082, Nov. 3, 1987, abandoned.

[30] Foreign Application Priority Data

| | | | |
|---|---|---|---|
| Nov. 6, 1986 | [JP] | Japan | 61-264205 |
| Nov. 6, 1986 | [JP] | Japan | 61-264206 |
| Nov. 6, 1986 | [JP] | Japan | 61-264207 |
| Nov. 6, 1986 | [JP] | Japan | 61-170531[U] |
| Nov. 6, 1986 | [JP] | Japan | 61-170532[U] |
| Nov. 6, 1986 | [JP] | Japan | 61-170533[U] |
| Nov. 6, 1986 | [JP] | Japan | 61-170534[U] |
| Nov. 6, 1986 | [JP] | Japan | 61-170535[U] |
| Nov. 6, 1986 | [JP] | Japan | 61-170536[U] |
| Nov. 6, 1986 | [JP] | Japan | 61-170537[U] |
| Nov. 6, 1986 | [JP] | Japan | 61-170538[U] |
| Nov. 6, 1986 | [JP] | Japan | 61-170539[U] |

[51] Int. Cl.[5] ..... G10H 1/057; G10H 7/08

[52] U.S. Cl. ..... 84/603; 84/607; 84/616; 84/627; 84/477 R

[58] Field of Search ..... 84/603, 607, 616, 627, 84/477 R, 478

[56] References Cited

U.S. PATENT DOCUMENTS

| | | | |
|---|---|---|---|
| 4,342,245 | 8/1982 | Gross | 84/1.19 X |
| 4,357,852 | 11/1982 | Svenaga | 84/1.03 X |
| 4,360,708 | 11/1982 | Taguchi et al. | 381/36 |
| 4,483,229 | 11/1984 | Tsukamoto et al. | 84/1.26 X |
| 4,584,541 | 4/1986 | Nossen | 375/41 X |
| 4,606,255 | 8/1986 | Hayashi et al. | 84/267 X |
| 4,608,703 | 8/1986 | Kaga et al. | 375/13 X |
| 4,628,787 | 12/1986 | Nozawa | 84/1.26 X |
| 4,691,608 | 9/1987 | Sasaki et al. | 84/1.13 X |
| 4,696,216 | 9/1987 | Asahi et al. | 84/1.26 X |
| 4,754,679 | 7/1988 | Suzuki | 84/1.26 X |

*Primary Examiner*—Stanley J. Witkowski

*Attorney, Agent, or Firm*—Frishauf, Holtz, Goodman & Woodward

[57] ABSTRACT

An envelope extracting circuit extracts an envelope from the waveform sampled by a musical tone sampling circuit, and stores the envelope data into a memory. An envelope approximating circuit approximates the envelope data as stored in the memory by the function data such as linear or exponential function data. The original envelope is approximated by a limited number of function waveforms whose characteristics change at switching points.

24 Claims, 40 Drawing Sheets

APPARATUS FOR EXTRACTING ENVELOPE DATA FROM AN INPUT WAVEFORM SIGNAL AND FOR APPROXIMATING THE EXTRACTED ENVELOPE DATA

This application is a continuation of application Ser. No. 117,082, filed Nov. 3, 1987, and now abandoned.

BACKGROUND OF THE INVENTION

The present invention relates to an envelope generating apparatus for generating an envelope from an input waveform signal, and to an apparatus for approximating an extracted envelope by a line diagram function or an exponential function.

In electronic musical instruments, a natural musical tone generated by playing the instrument is simulated. The simulation is progressively performed by varying various types of factors or parameters defining the natural musical tone in a try and error manner. In the simulation, an operator once sets, and hears the musical tone formed using the set parameters to check if the sounded musical tone is good. If it is no good, he sets again another modified parameters seeming to be correct. At the present stage of technology in this field, there has not been developed any effective measure to approximating the artificial musical tone generated by the musical instrument to the natural musical tone. This complies with the operator to use the try-and-error process for the musical tone simulation. The restricted parameters used make it difficult to obtain a satisfactory approximation of the artificial musical tone to the natural one.

The same thing is true for generating an envelope as one of factors of the waveform.

In the apparatus to compose a musical tone by multiplying the one wave data at the fundamental frequency of a musical tone by the envelope data, it is impossible to form an envelope whose variation is complicated. Only one freedom allowed in this case is to generate a monotone waveform, e.g., an exponential curve, in a confined period of time or interval, and to change the ends of the interval.

Thus, the present artificial sound composing measure is under limited conditions of hardware and software, and is only the perceptional and try-and-error process under limited conditions and with also limited freedom of design.

Sampling musical instruments have been known. In the instrument, the waveform of a natural musical tone is sampled using the PCM technique. The sampled and stored waveform data are read out in real time for sounding. This instrument can reproduce the sampled sound at high fidelity. The musical tone data of the instrument takes the form of a complete waveform, and is inappropriate for the machine computing processing. For this reason, when using the sampling instrument, it is impossible to reproduce the features of the complicatedly varying musical tone by the natural musical instrument by using the sampled data of one waveform. Thus, it is enough to say that the conventional sound composing system as mentioned above abandons the technical efforts to electronically synthesize sounds from the outset.

For the above background reasons, the present invention has been made on the hypothesis that the following approach would be effective to approximate the articifial musical tone to the natural musical tone: the waveform of a musical tone by the natural musical instrument is analyzed, the features of the waveform are extracted on the basis of the analyzed data, and the extracted feature parameters of the waveform are used for synthesizing or composing an aritificial musical tone well approximating the natural musical tone.

SUMMARY OF THE INVENTION

Accordingly, an object of the present invention is to provide an envelope extracting apparatus for extracting the envelope data well containing the features of an original sound from the extracted waveform data.

Another object of the present invention is to provide an envelope approximating apparatus which compresses the large amount of original envelope data extracted by the envelope extracting apparatus, and can well reproduce the features of the original waveform with small amount of data.

An additional object of this invention is to provide an envelope generator which generates the envelope data by operating both the envelope extracting apparatus and the envelope approximating apparatus.

It is evident that the envelope extracting apparatus and the envelope approximating apparatus may be used not only individually, but also in combination.

According to one aspect of the present invention, there is provided an envelope generating apparatus for an electronic musical instrument comprising:

envelope extracting means by extracting an envelope waveform in a manner that a waveform described by sampled waveform data is segmented into a plurality of intervals for each predetermined time period, and envelope data is extracted item by item according to the features of a segmental waveform described by the waveform data within each interval; and envelope approximating means for approximating the envelope waveform extracted by the envelope extracting means by a limited number of function waveforms whose characteristic changes at switching points.

According to another aspect of this invention, there is provided an envelope extracting apparatus in which the entire range of sampled waveform data is segmented into a plurality of intervals for each predetermined time period, and an envelope value is extracted one by one according to the features of a segmental waveform described by the waveform data within each interval, the apparatus comprising:

envelope extracting means in which the interval is equal to the period of the fundamental wave of the waveform expressed by the waveform data.

According to a further aspect of the present invention, there is provided an envelope approximating apparatus which approximates an envelope waveform described by the envelope data of a musical tone in the form of a limited number of function waveforms whose characteristic changes at switching points, the apparatus comprising:

function data generating means for generating function data;

computing means for computing an evaluation value of an error between the function data and envelope data; and switching point deciding means for deciding a switching point to optimize the evaluation point.

BRIEF DESCRIPTION OF THE DRAWINGS

Other objects and features of the present invention will be described in connection with the accompanying drawings, in which.

DETAILED DESCRIPTION OF THE PREFERRED EMBODIMENT

1st Embodiment

1. General

A first embodiment of an envelope generating apparatus according to the present invention will be described referring to FIGS. 1 to 11.

In the envelope generating apparatus according to the first embodiment, an envelope waveform is extracted in a manner that a waveform described by sampled waveform data is segmented into a plurality of intervals for each predetermined time period, and the value inherent to the waveform within the interval is computed item by item, as the envelope data, to extract the waveform of the envelope, and the extracted envelope waveform is approximated by a limited number of function waveforms whose characteristic changes at switching points.

According to the first embodiment, an envelope is automatically formed on the basis of the sampled waveform. The time axis of the musical tone waveform data is segmented into a plurality of time intervals for each predetermined period, e.g., the period of the fundamental wave of the musical tone. Distinctive envelope values are computed one by one from the musical tone data contained in each time interval. In this way, the envelope data equal in number to the intervals are obtained. The envelope data obtained are approximated by a limited number of function waveforms (line graphs) whose characteristics (direction) are changed at the switching points. Therefore, an envelope can be expressed by the obtained coordinates at the switching points, so that effective data compression is realized. An error or difference between the approximated curve and the original envelope data is small. This indicates the essential features of the original sound are left without little modification of them.

2. Description of Arrangement and Operation (1) Overall arrangement

Figure 1:
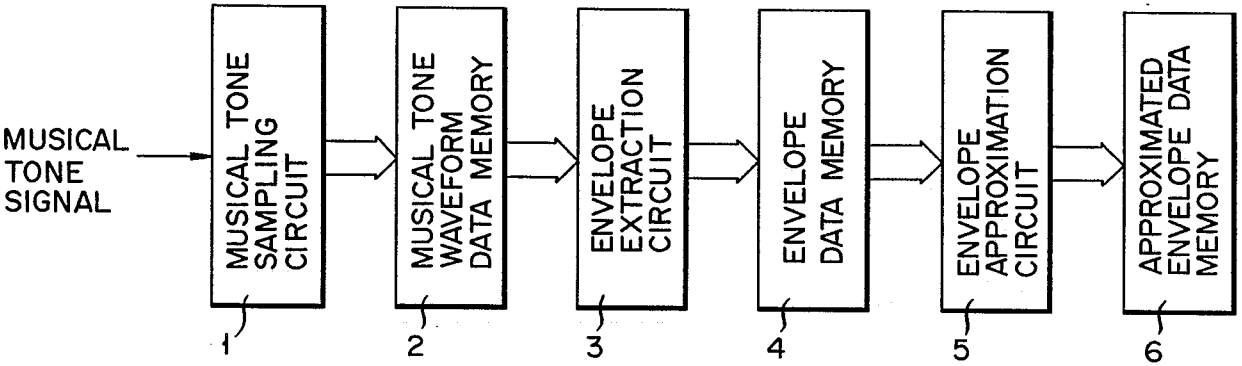
FIG. 1 shows a block diagram of an overall arrangement of an envelope generating apparatus according to a first embodiment of the present invention.

An overall arrangement of the envelope generating apparatus according to the first embodiment is shown in FIG. 1. Musical tone sampling circuit 1, which may be a well known circuit, samples a musical tone waveform signal as an analog signal (whose amplitude is continuous with respect to time) at a sampling frequency. The sampled waveform data as a digital signal (whose amplitude is discrete with respect to time) is stored into musical tone data memory 2. Envelope extraction circuit 3 extracts envelope data from the musical tone waveform data, and supplies it into envelope data memory 4. The extracted envelope data is subjected to approximation by a limited number of function waveforms. This is made in envelope approximating circuit. The result of approximation is stored into approximated envelope memory 6.

The system of FIG. 1 can be realized by using a single- or multi-processor system.

The system shown in FIG. 1 is for a tool for generating an envelope, and a musical tone synthesizing system is not illustrated. A musical tone can be synthesized or composed by multiplying the fundamental waveform data of the fundamental wave of one period by the approximated envelope.

(2) Envelope extraction circuit

Figure 2:
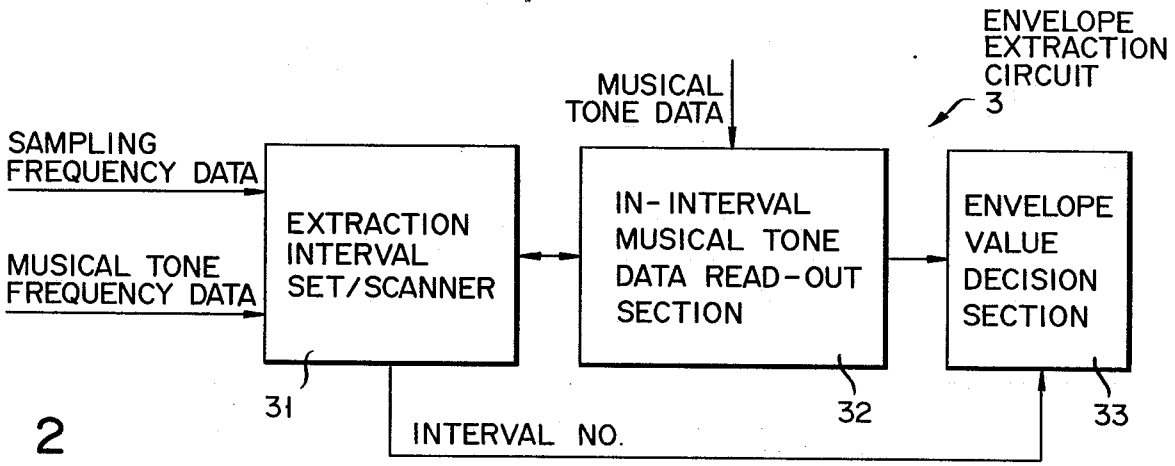
FIG. 2 shows a block diagram of a key portion of an envelope extracting circuit used in the FIG. 1 envelope generating apparatus.

A key portion of the envelope extraction circuit 3 of FIG. 1, is shown in FIG. 2. Sampling interval set/scanner 31 receives the data from the input device and determines the interval for extracting the envelope values one by one. When the envelope data is extracted, every time the envelope value is determined, the interval is successively shifted to the succeeding intervals. Finally, the entire intervals of the sampled musical tone are scanned. This instance uses for the input data, the sampling frequency data of the musical tone data and the musical tone frequency data defining the pitch of the musical tone. For this reason, the interval equivalent to the period of the sampled musical tone is selected for the input data.

If required, another length of time may be used for the extracting interval. For example, envelope values may be extracted from the musical tone data contained in the period which is integer times, e.g., two times, the period of musical tone.

In-interval musical tone data read-out section 32 sequentially reads out the musical tone data contained in the present interval, which is transferred from extraction interval set/scanner 31, from musical tone waveform data memory 2 (FIG. 1).

Envelope value determining section 33 works out the value inherent to the in-interval musical tone data from read-out section 32, and outputs it as an envelope value.

To compute (determine) the envelope values, any suitable algorithm may be used if the computed value is the parameter of the "magnitude" contained in the in-interval musical tone data. Some of typical examples of the algorithm will be described.

(A) To extract the maximum value of the in-interval musical tone data.

(B) To extract the maximum and minimum values of the in-interval musical tone data, and to compute the difference (peak to peak) between them.

(C) To compute $$\sum_{l=1}^{k} (|Di|)\alpha$$

($\alpha$: Index of power)

for the absolute value $|Di|$ of each of in-interval musical tone data D1 to Dk

When $\alpha=1$, an area (averaged amplitude) of the waveform of the musical tone data within the interval is obtained. When $\alpha=2$, the so-called power of waveform is obtained. When sampling interval set/scanner 31 designates the termination of the present scanning interval, envelope value determining section 33 stores the computed value as the envelope value within the intended interval into a memory location of envelope data memory 4 (FIG. 1). The memory location is assigned to the present interval number as designated by sampling interval set/scanner 31.

Figure 3:
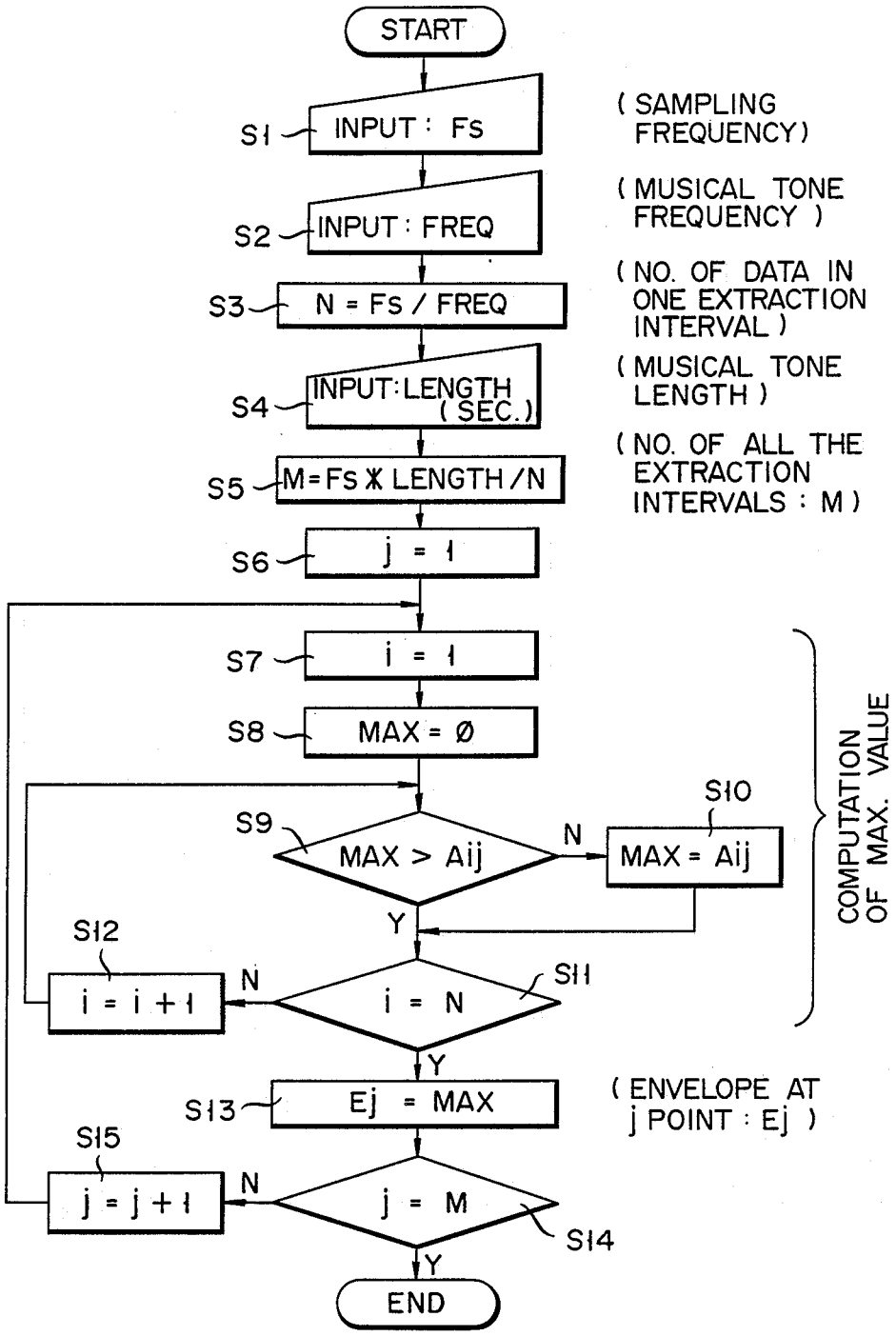
FIG. 3 shows a flow chart illustrating an operation of the FIG. 2 envelope extracting circuit.

FIG. 3 shows a flow chart illustrating the operation of envelope extraction circuit 3 when the maximum value of the in-interval musical tone data is extracted as the envelope value.

After start, a sampling frequency Fs and the frequency Freq of a musical tone are input to the circuit 3. CPU computes the number N of the musical tone data within the sampling interval (steps S1, S2 and S3). By this processing, the data of the fundamental period of the musical tone is just fit in one sampling interval.

Further, the length (sec.) of the musical tone is input and the total number M of sampling intervals is obtained using the length data, the sampling frequency and the number of data within one sampling period (steps S4, S5).

Variable number "j" of the sampling interval number and a variable number "i" of the data position within one sampling interval are initialized to "1" (steps S6, S7).

A variable number MAX of the maximum value of the musical tone data within one sampling interval is initialized to "0" (S8). With i=N, the variable number MAX is compared with the present musical tone data Aij (the i-th musical tone data in the j-th sampling interval) until the completion of the scanning within the present sampling period (S11). If the present data Aij is larger than the variable number MAX, the MAX is updated by that value (S9, S10). To advance the musical tone data to be compared, the variable number "i" is incremented (S12). The above processing is repeated. Accordingly, when the variable "i" reaches N, the maximum value of the musical tone data within the sampling period scanned this time has been stored.

When the variable "i" reaches N, the stored variable MAX is entered into the variable number Ej of the j-th envelope value. To advance the sampling interval to the next sampling interval, the variable "j" is incremented (S13, S15). The above processing is repeated until the variable "j" reaches M of sampling intervals (S14), i.e., the sampling of the envelope values during all of the intervals is completed.

An arrangement of variable numbers from E1 to EM, which is obtained after the processing shown in FIG. 3 is completed, represents the envelope data of M as extracted from the musical tone data.

FIGS. 4 to 7 show examples of waveforms of the musical tones, and waveforms of envelope data as obtained through the flow chart processing of FIG. 3.

Figure 4:
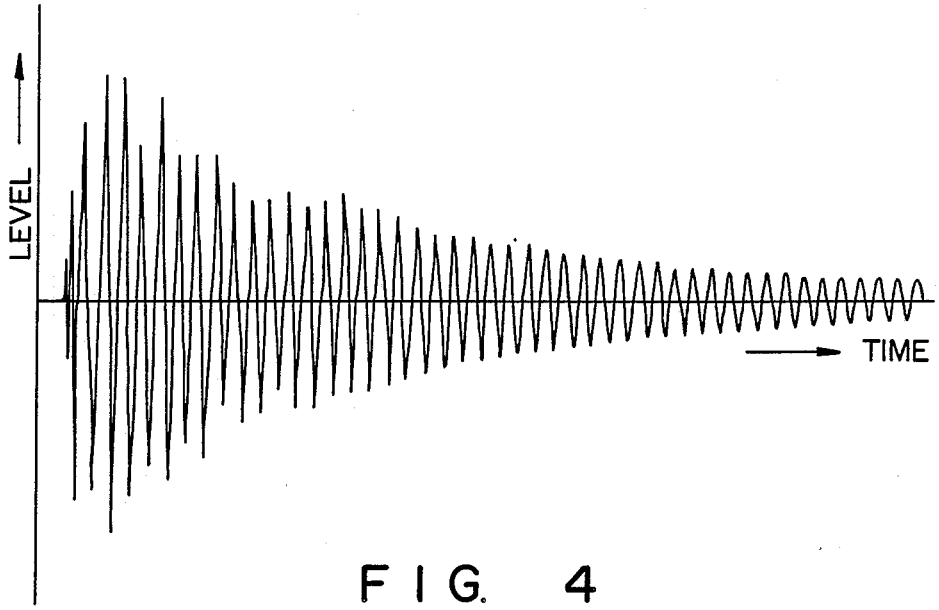
FIG. 4 shows a waveform obtained by sampling a musical tone waveform.
Figure 5:
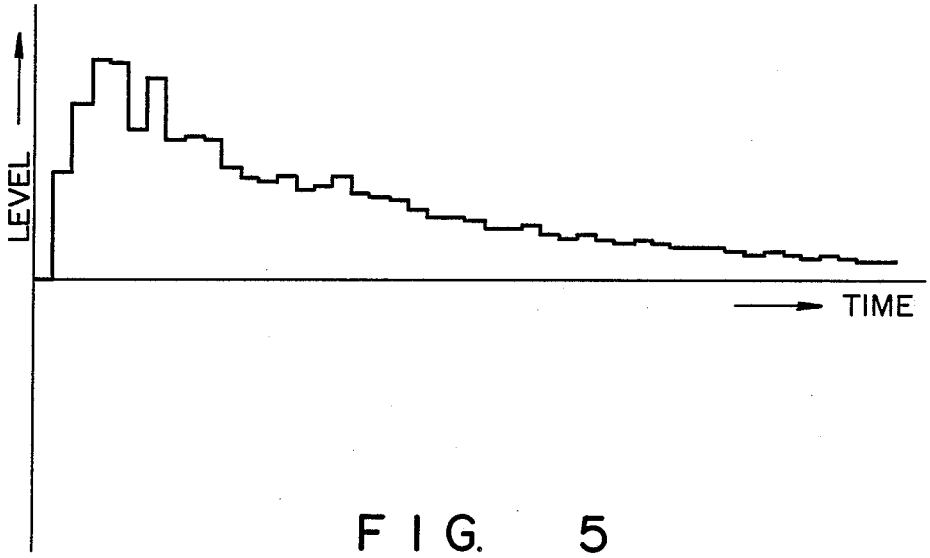
FIG. 5 shows an envelope waveform obtained from the FIG. 4 waveform.
Figure 6:
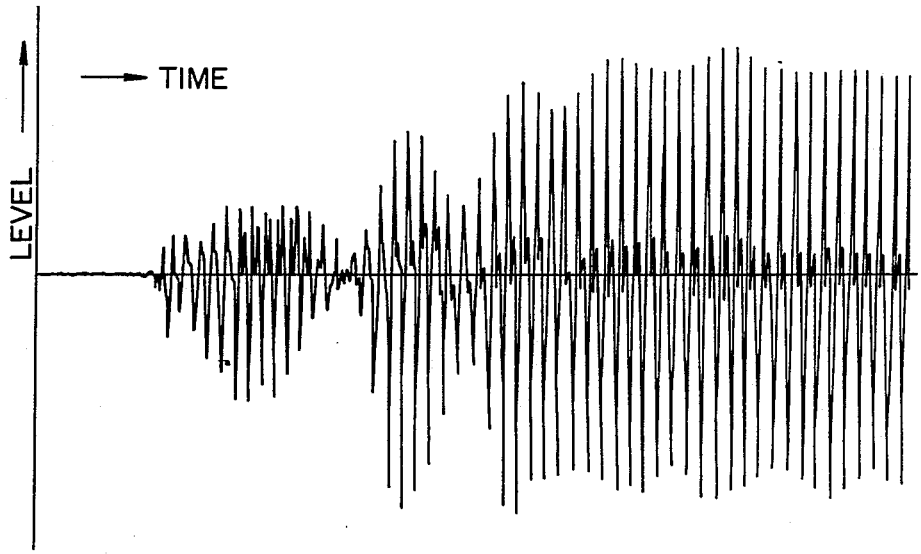
FIG. 6 shows a waveform of another sampled musical tone waveform.
Figure 7:
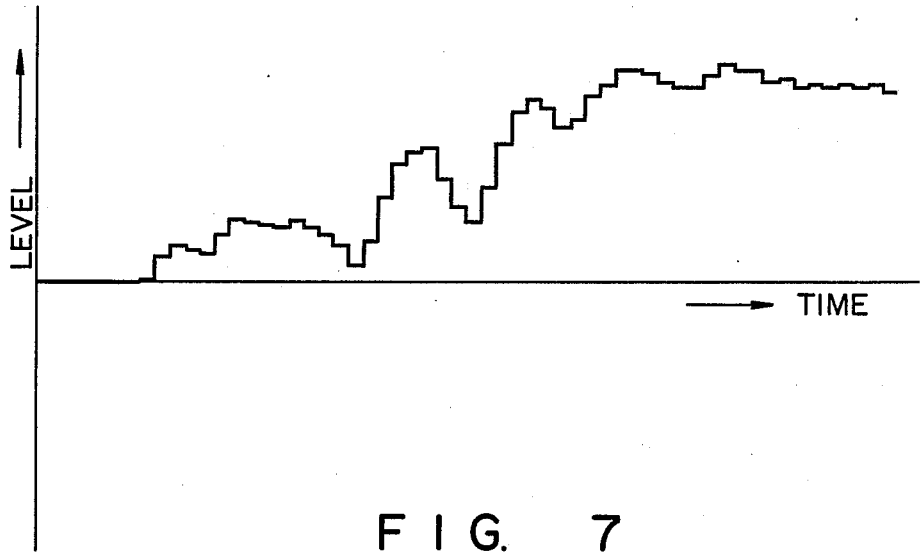
FIG. 7 shows an envelope waveform obtained from the FIG. 6 waveform.

A waveform shown in FIG. 4 illustrates a damping waveform of the sound of a trumpet. An envelope waveform shown in FIG. 5 is obtained when the FIG. 4 waveform is processed by the FIG. 3 flow chart. A waveform shown in FIG. 6 is obtained when the trumpet is continuously played. An envelope shown in FIG. 7 is obtained when the FIG. 6 waveform is processed by the algorithm of FIG. 3.

To extract the envelope by using the (B) algorithm, a variable number MIN is used. The variable number MIN is initialized to "0" before a new interval is scanned. During the scanning, it is compared with present data Aij. If it is larger than the present data Aij, variable number MIN is updated by its value. After the scanning, (MAX−MIN) is computed. The result of computation is used as the variable number Ej for the envelope value. In actual use, this algorithm is appropriately incorporated into the FIG. 3 flow chart.

The extraction of the envelope of the trumpet waveform by using the (C) algorithm, will be described. When the area of the $\alpha=1$ waveform is used as the envelope value, a variable number SUM is used in place of variable number MAX. Variable number SUM is initialized to "0" in step S8. The SUM is updated by (SUM+|Aij|) in steps S9 and S10. In step S13, Ej=SUM (or Ej=SUM/N) is executed.

These algorithms as mentioned above in brief will be described in other embodiments of the present invention.

(3) Envelope approximating circuit

Figure 8:
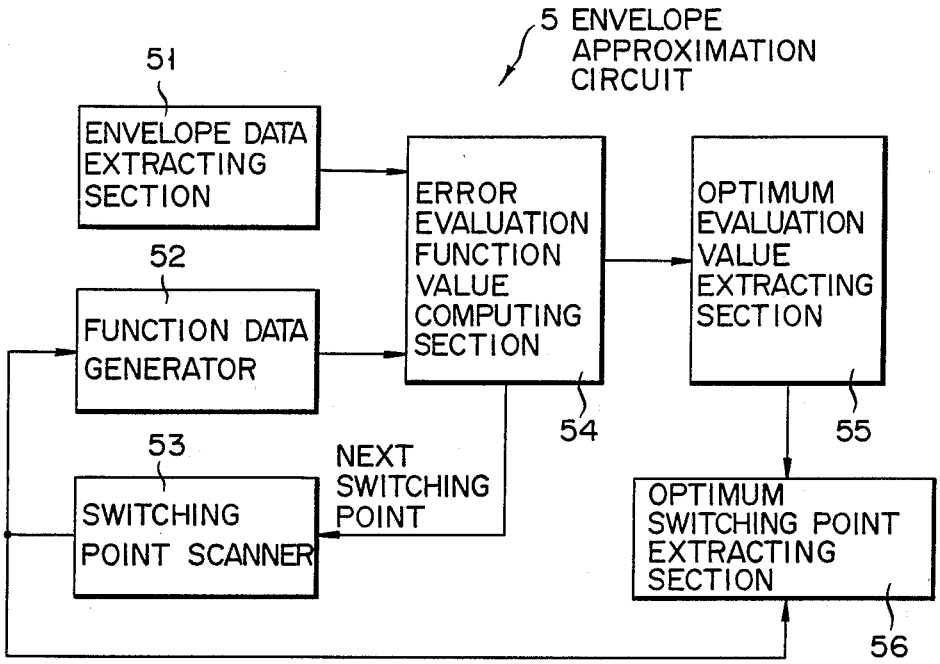
FIG. 8 shows a key portion of an envelope approximating circuit used in the FIG. 1 circuit.

A circuit arrangement of a key portion of the envelope approximating circuit 5 of FIG. 1 is shown in FIG. 8.

In envelope data extracting section 51, the original envelope data is extracted. Function data generator 52 specifies the characteristics (waveform deciding parameters of the function) according to the switching point data as supplied from switching point scanner 53, to generate predetermined function data.

The original envelope data from envelope data extracting section 51 and the function data from function data generator 52 are transferred to error evaluation function value computing section 54, in order to compute the error between both the waveforms. The computed value from the computing section 54 changes depending on the position of the switching point, viz., it is a function of the switching point. The error function computed by error evaluation function value computing section 54 is given by E(P) on the assumption that the number of the scanning switching point is E, which is applied from switching point scanner 53 every scanning, and the coordinates of the switching point is P.

When switching point scanner 53 scans a series of switching points, and the scanning switching points have coordinates values, the evaluation function E reaches the peak, i.e., the maximum or minimum point.

Optimum evaluation extracting section 55 monitors the values computed by the computing section 54, and extracts an optimum evaluation value defined by peak values, for example.

Optimum switching point extracting section 56 fetches and holds the data of the present scanned switching point as indicated by switching point scanner 53, to obtain the position data of the switching point to generate the optimum evaluation value. This operation by the extracting section 56 is performed when the optimum evaluation value is detected by optimum evaluation value extracting section 55.

Accordingly, when switching point scanner 53 completes the scanning of the switching points within the set scanning range, optimum switching point extracting section 56 has stored the position data of the switching point to let the error function between the original envelope waveform and the function waveform have the optimum value such as minimum or maximum value within the scanning range. In other words, the optimum switching point has been searched.

Any search range in searching the switching points (scanning range) and the order of scannings, which are handled by switching point scanner 53, so long as the original envelope waveform may be approximated by the function waveform whose characteristic is switched at the obtained optimum switching point, may be used.

The interval between two adjacent points in the original envelope waveform, for example, may be used as the search range of the switching point. Additionally, a range including that interval and its vicinity may be used as the search range. Further, a predetermined point distanced from the original envelope waveform may be used for the same purposes.

When error evaluation function computing section 54 computes an error evaluation value between the original envelope waveform and the function waveform whose characteristic is switched at a predetermined number "r" of switching points, switching point scanner 53 provides switching points P1, P2, . . . Pr (P1<P2 . . . <Pr). Also in this case, function data generator 52 generates the function data connecting a pair of points Pi and Pi-1. In this arrangement, the error evaluation function is the function of switching the predetermined number "r" of points, and is represented as $$E=(P1, P2, \ldots, Pr).$$

When switching point scanner 53 outputs all of the combinations of different positions of "r" of those positions in the scanning range, optimum switching point extracting section 56 has stored the optimum switching points data of "r", which is equal to the number as set.

In the above-mentioned embodiment, however, the total number of the combinations of the switching points to be output by switching point scanner 53 is the number of combinations to select "r" from N (the total number of the positions belonging to the scanning range), i.e., C (N, r). This may be tremendously large.

To avoid this, it is suggestible that the optimum switching points are searched one by one. Alternatively, a processing may be employed, in which the search range is limited to the points or the intervals seeming to contain the optimum switching points, allowing for the features of the original envelope waveform. For example, if a certain interval contains only one optimum switching point, the number of computed values is satisfactorily small. In such a processing, points and intervals may be selected through the interaction between the man and machine.

A typical arrangement of the type, in which the optimum switching points are searched one by one, is as follows. In the arrangement, the function data (old function waveform) is generated by using the data of the optimum switching points already obtained. Switching points are scanned within the scanning range, in order to search a new optimum switching point. When the scanning is completed, optimum switching point extracting section 56 has stored a switching point to optimize the evaluation function, or a new optimum switching point, when a new switching point is added.

(4) Function generator

The function f(x) generated by function data generator 52 may be any function if it is unconditionally defined when two points are given. Such functions are, for example, functions describing lines, exponential curves, triangle functions, logarithmic curves, and etc.

(5) Optimum switching point selection

Many types of functions may be used for the error evaluation function, which is used by error evaluation function value computing section 54. The meaning of the optimizing changes with the type of error evaluation function used. So typical evaluation functions are described below.

(A) The error evaluation function expressed by $\Sigma|D(x)-f(x)|$ (where D(x) represents the original envelope waveform) is used. In this case, the minimum value is the optimum evaluation value. The above expression indicates the difference area between the original envelope and the function f(x). A switching point to minimize this difference area is used as an optimum switching point.

(B) An error evaluation function expressed by $\Sigma(D(x)-f(x))^2$ is used. An optimum point is a point to minimize this function. With extension of the function of (A) and (B), $\Sigma D(x)-f(x)|\alpha(1\leqq\alpha)$ may be used as the error evaluation function.

(C) $|D(x)-f(x)|$ is used for the evaluation function. In the case, the optimum switching point is a point to maximize this function value within the scanning range. The evaluation function is a difference function subtracting the approximating function waveform from the envelope waveform. The peak of this waveform of the function is the optimum switching function.

Figure 9:
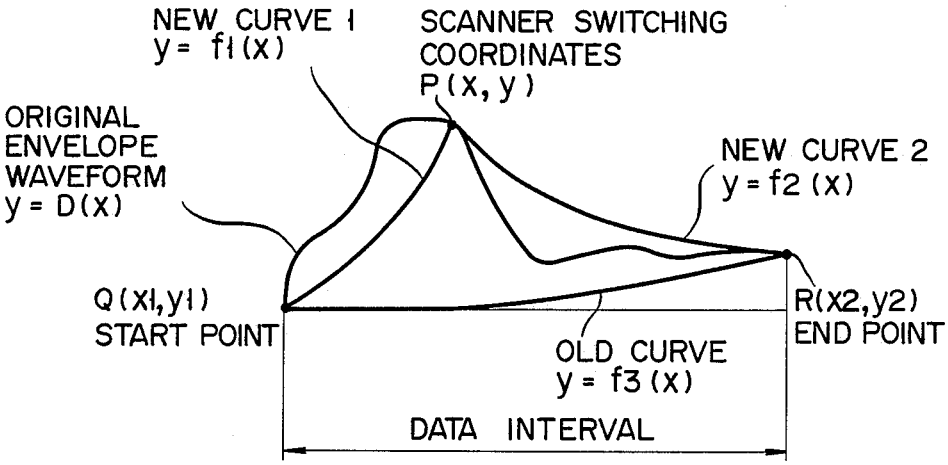
FIG. 9 shows waveforms useful in explaining the operation of the envelope approximating circuit.

How to sequentially obtain the optimum switching points on the basis of the difference area minimizing method of (A), will be described referring to FIG. 9. As described above, the curve of y=D(x) is an original envelope waveform. The start point Q and the end point R of the data interval are the optimum switching points already obtained. The scanning switching point coordinates P is scanned to find a new optimum switching point. In this instance, the scanning range resides in each point of the original envelope waveform.

Curve y=f3(x) connecting start point Q and end point R is called an old curve. The reason for this is that these points Q and R are optimum switching points as already obtained. Area ERC enclosed by the old curve and the original envelope waveform is a difference area $\Sigma|D(x)-f3(x)|$ as evaluated as an error existing between both the wavforms. In other words, the difference value is an evaluation value of the old error when the curve approximation is made using the already known optimum switching points.

A curve y=f1(x) including the present scanning switching coordinates P and start point Q (old optimum switching point) is called a new curve 1. Another curve y=f2 (x) including the present scanning switching coordinates P and end point R is called a new curve 2. The sum of a difference area ERA enclosed by new curve 1 and the original envelope waveform and a difference area ERB enclosed by new curve 2 and the original envelope waveform is an evaluation value of the error (new error) between the original envelope waveform and the curve, which is approximated with selection of the present scanning switching coordinates as a new switching point.

$$\begin{aligned} E &= ERC - (ERA + ERB) \\ &= \text{old error} - \text{new error.} \end{aligned}$$

The difference E indicates a descreasing rate of error when the switching point is additionally used.

When the scanning switching coordinates are scanned over all of the points in the original envelope waveform, the difference E is maximized at a point. The scanning switching coordinates to maximize the difference area is a point within the scanning range, the point minimizing the error between the curve and the original envelope waveform, which is evaluated on the difference area basis. Therefore, this point is used as a new optimum switching point.

The search of the optimum switching point is continued until the set number of curves, to finally obtain the position data of a necessary number of optimum switching points to minimize the difference area.

FIG. 10 shows a flow chart for explaining the operation of envelope approximating circuit 5. This instance is designed by the above method for sequentially searching optimum switching points. The function for approximation is a linear function.

Parameters used in this flow chart will be given below.

L: What type of line graph is used?

P: Number of points (number of data)

D(p): Original envelope data

IPi: x-coordinates at the i-th point as counted from the top i: Parameter when repetitions of the number of lines of a graph is required j: Parameter between 2 and P−1

MAX: Parameter storing the maximum value of ERj c: Parameter between 1 and i+1

(x, y): Coordinates (scanning coordinates P) when "j" varies)

(x1, y1): Coordinates of IPc (start coordinates Q in the data interval)

(x2, y2): Coordinates of IPc+1 (end coordinates R in the data interval)

a1, b1: Coefficient of line y=a1x+b1 including P and Q a2, b2: Coefficient of line y=a2x+b2 including R and P a3, b3: Coefficient of line y=a3x+b3 including R and Q ERA: Sum of absolute values of differences between line QP including Q and P and y=D(x)

EBA: Sum of absolute values of differences between line PR including P and R and y=D(x)

EBC: Sum of absolute values of differences between line QR including Q and R and y=D(x)

ERj: Decreasing rate of error when point P is selected m, n: Parameter for reordering (sorting) IP It is believed that from the description thus far made and the above parameter description, those skilled persons in the art will almost understand the operation of the flow chart. To supplement, the description to follow is given.

Steps T1 to T5 are for initializing processing, and sets the number of lines, inputs the number of data of the original envelope to be used, reads on the original envelope data, and the like. In step T4, IP1=1 and IP2=P. The setting in this step is used for the reason that in this instance, the start and end points of the original envelope waveform are those of the line graph. Broadly, this is involved in the initializing setting. i=1 in step T5 is used for the reason that a single line connecting the start and end of the original envelope waveform, is used.

Step T6 is used for starting the cycle to obtain a new optimum switching point, and sets the scanning x-coordinates to the second envelope data (j=2), and sets MAX to "0", and sets "c" to "1" for initializing the data interval.

Step T7 is used for checking the updating of the data interval, and when the present scanning x-coordinates reaches the end point of the data interval, shifts the data interval to the next data interval through step T8.

In steps T9 to T11, old line y=a3x+b3, and two new lines y=a1x+b1 and y=a2x and b2 is determined by using start point coordinates (x1, y1), end point coordinates (x2, y2), and present scanning coordinates (x, y) of the data interval.

In steps T12 to T17, control computes the total sum of the absolute values of the differences between new line y=a1x+b1 and envelope waveform y=D(x) in the range between start point Q and scanning coordinates P in the present data interval. The computed total sum is stored into ERA.

In steps T18 to T23, control computes the total sum of the absolute values of the differences between new line y=a2x+b2 and envelope waveform y 32 D(x) in the range between start point Q and scanning coordinates P in the present data interval. The computed total sum is stored in ERB.

In steps T24 to T29, control computes the total sum of the absolute values of the differences between new line y=a3x+b3 and envelope waveform y=D(x) in the range between start point Q and scanning coordinates P in the present data interval. The computed total sum is stead in ERC.

In step T30, when scanning coordinates P is selected as the switching point, control computes a decreasing rate of the total sum (difference area) of the absolute values of errors existing between the line and the original envelope waveform, and loads it into ERj.

This REj is compared with the maximum value MAX thus far obtained (step T31). If the ERj is larger than the latter, its value is loaded into MAX. The scanning x coordinates "j" at that time is loaded into IPi+2 (T32).

The internal point is advanced by one with j=J+1. This processing is repeated until the scanning coordinates reaches the end point of the original envelope waveform (T33, T34).

Steps T35 to T42 are used for the sorting of sets of the x coordinates of the optimum switching point. In this instance, a new optimum switching point is once set in IPi+2 as shown in step T32. As seen from step T4, as control enters step T35, the x coordinates of the end point of the envelope waveform has been set in IPi+1. At this time IPi+1>IPi+2 has held. In this sorting processing, the sets of the x coordinates are arranged into IP1<IP2<. . . <IPi+2.

To start the next cycle, "i" is incremented and this is repeated until lines curves of L (T43, T44).

Through the above processing, the set IP 32 (IP1, IP2, points is obtained by using original envelope data D(1) to D(P), and the number L of the set lines.

To actually generate the line approximated envelope data, it is only needed to use sets IP and D(IP) of the optimum setting points. Specifically, the line connecting sets (IP1, D(IP1)) and (IP2, D(IP2)) is first computed. When set IP2 is reached, the line connecting sets (IP2, D(IP2)) and (IP3, D(IP3)) is then computed. Subsequently, the lines are switched at the switching points.

Figure 10A:
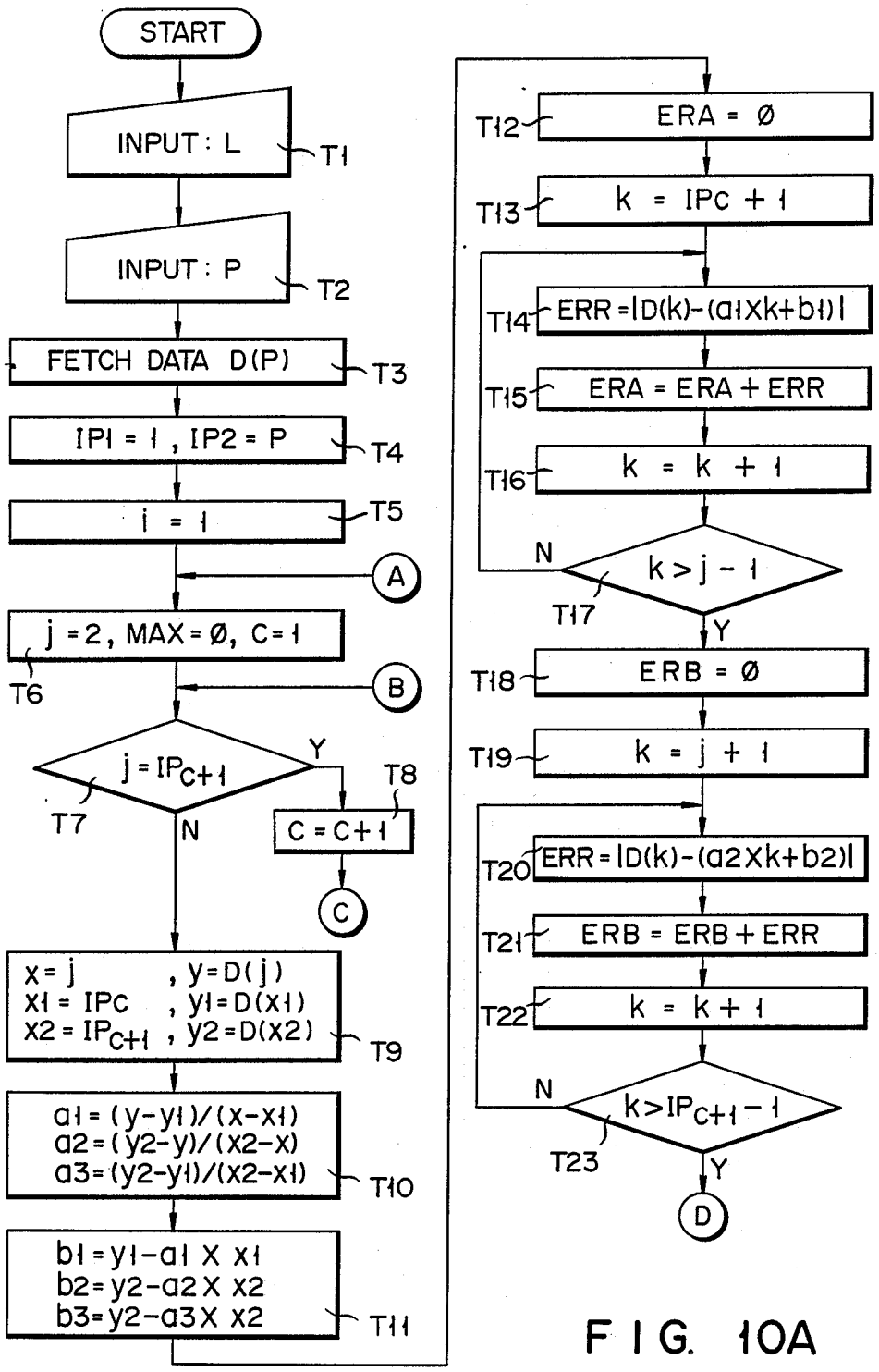
FIGS. 10A and 10B show a flow chart illustrating the operation of the FIG. 8 envelope approximating circuit.
Figure 10B:
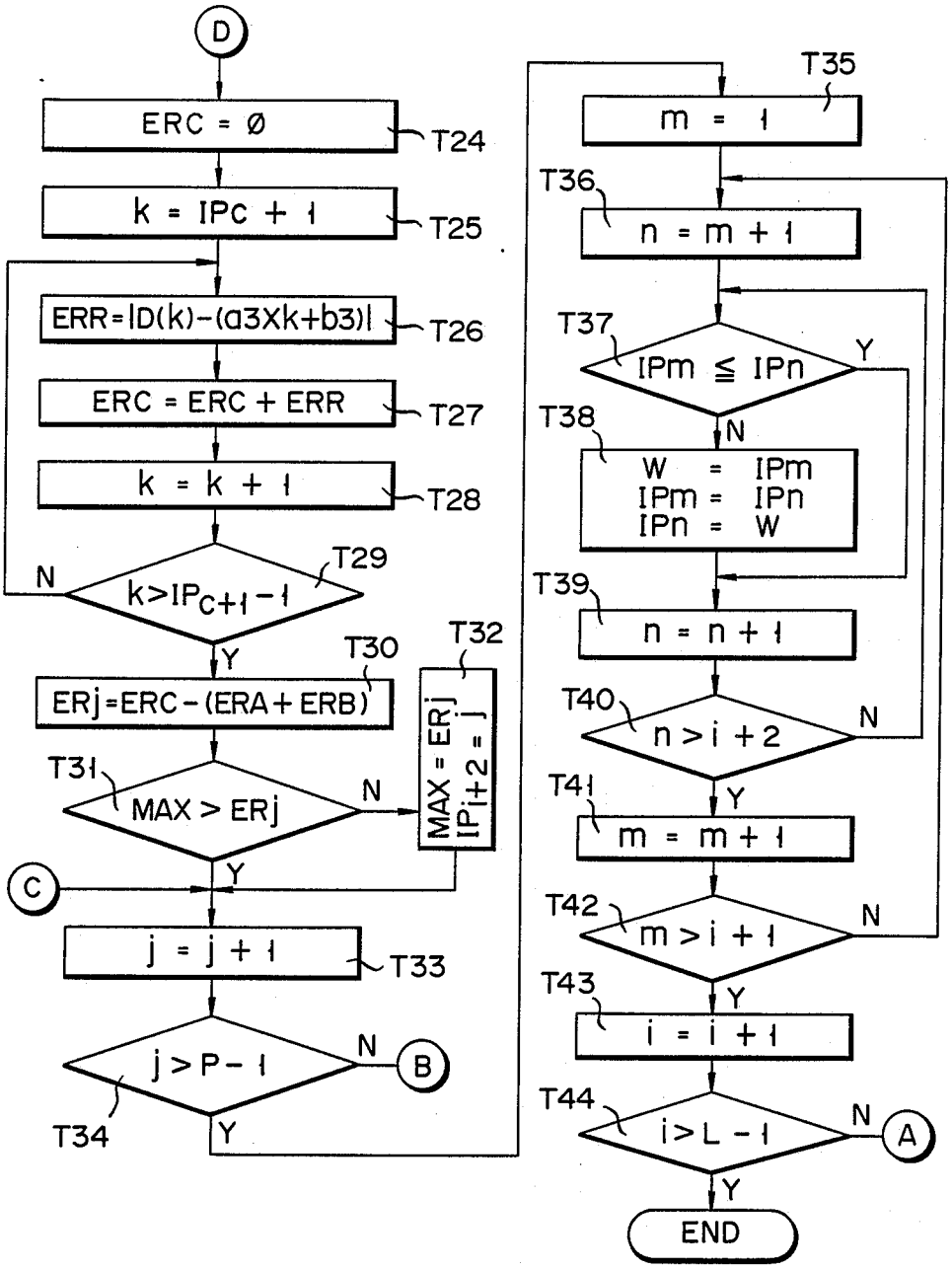

Use of the method (B) to minimize the total sum of the square errors for the approximating method is allowed if $ERR=(D(k)-f1(k))^2$, $ERR=(D(k)-f2(k))^2$, and $ERR=(D(k)-f3(k))^2$. applied for the processings of steps T14, T20 and T26 in FIGS. 10A and 10B.

When the line or rectilinear curve is replaced by another curve, e.g., an exponential curve ($y=e^{aix+bi}$, where i=1 gives a new curve 1 and i=2 gives a new curve 2, and i=3 gives an old curve), the following processings may be used for the processings in steps T10 and T11:

$$a1=(eny-lny1)/(x-x1)$$

$$a2=(lny2-lny)/(x2-x)$$

$$a3=(lny2-lnyl(/(x2-x1)$$

$$b1=lnyl-a1\cdot x1$$

$$b2=lny2-a2\cdot x2$$

$$b3=lny3-a3\cdot x3$$

Figure 11:
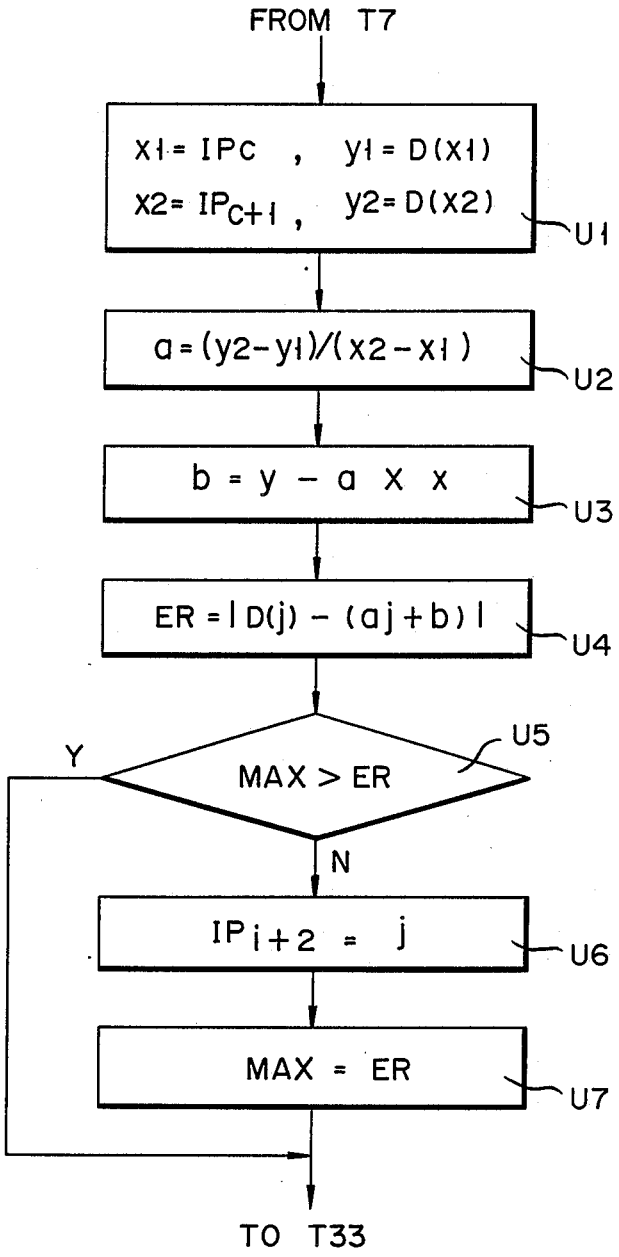
FIG. 11 shows a flowchart showing a modification of the operation of the envelope approximating circuit of FIG. 8.

To use the difference function peak system (C), the processings in steps T9 to t32 in FIGS. 10A and 10B are replaced by the processing shown in FIG. 11. In this case, there is no need for computing the total sum of FIGS. 10A and 10B, and the operation required is only to compute error ER (U4) and to extract the maximum value (U5 to U7). Therefore, the time for the operations is considerably saved. This will be described in detail in connection with other embodiments to be given later.

As seen from the foregoing, the envelope data is automatically extracted from a natural musical tone, and the function approximation is also automatically applied for the extracted envelope data. Therefore, the envelope approximation according to this embodiment is remarkably improved over the conventional try-and-error method.

In the above-mentioned embodiment, the switching point selection is perfectly automated. If necessary, part of the selecting operation may manually be executed while referring to the original envelope waveform.

In the above-mentioned embodiment, the single principle is used for selecting optimum points. If necessary, it may be used in combination with other suitable principles.

3. Effects

As seen from the foregoing description, in the first embodiment, the time axis of the waveform represented by the waveform data as obtained by sampling the original sound waveform is segmented into a number of predetermined time intervals. The value essential to the waveform data within each interval is evaluated as the envelope value, to extract the waveform data of the envelope. Further, the envelope value is optimally approximated by such a limited number of function waveforms as to optimize the evaluation value of the error existing between it and the envelope waveform data. Therefore, the envelope of the original waveform can be reproduced with relatively small amount of data, while retaining the essential features of the original sound containing a tremendous amount of data. Therefore, the first embodiment enables simple electronic musical instruments with limited circuitry to easily use the envelope approximation. In this case, the sound composed by the instrument provides more natural feelings.

Thus, when considering specifically the envelope extracting circuit, the present embodiment successfully provides an envelope extracting apparatus which can optimally approximate the original envelope waveform.

A feature of this embodiment to extract one envelope from the one-period data of sampled acoustic sound provides exact original sound elements, retaining the essential features of the original sound.

This fact indicates that excessive amount of original waveform data to be used for one envelope value extraction causes the loss of data representing the amplitude variation featuring the original sound. On the other hand, if the number of sound data for each interval is too small, meaningless variation is evaluated as the envelope value. Let us consider a case that for example, a sine wave of the sound as generated by a tuning fork, for example, is sampled. In this case, if the maximum value for each halved period of the sine wave is used as the envelope value, the time sequential data of the envelope varies in the form of 1, 0, 1, 0, . . . , which is a train of meaningless bits.

It is noted that in this embodiment, the unit interval for envelope extraction is the fundamental period of the sampled original sound. Therefore, the above problem is solved.

When considering specifically the envelope approximating circuit, the first embodiment provides an envelope approximating apparatus.

In this apparatus, the original waveform is optimumly approximated by such a limited number of function waveforms as to optimize the evaluation value of the error existing between it and the envelope waveform data. Therefore, the approximation is made retaining the essential features of the original sound. The sound composing apparatus, when it coupled with the envelope approximating apparatus, can reproduce the sound as natural as possible.

The approximated envelope data thus obtained is applicable for currently used electronic musical instruments, enabling them to produce more natural artificial sounds.

2nd Embodiment

1. General

A second embodiment of an envelope extracting apparatus according to the present invention will be described with reference to FIGS. 12 to 15.

This embodiment is based on a technical idea that the entire range of the sampled waveform is segmented into a number of time intervals, the maximum and minimum peak values of the waveform data contained in each interval are extracted, and an envelope value inherent to the waveform within the interval is determined on the basis of the extracted values.

2. Description of Arrangement and Operation

Figure 12:
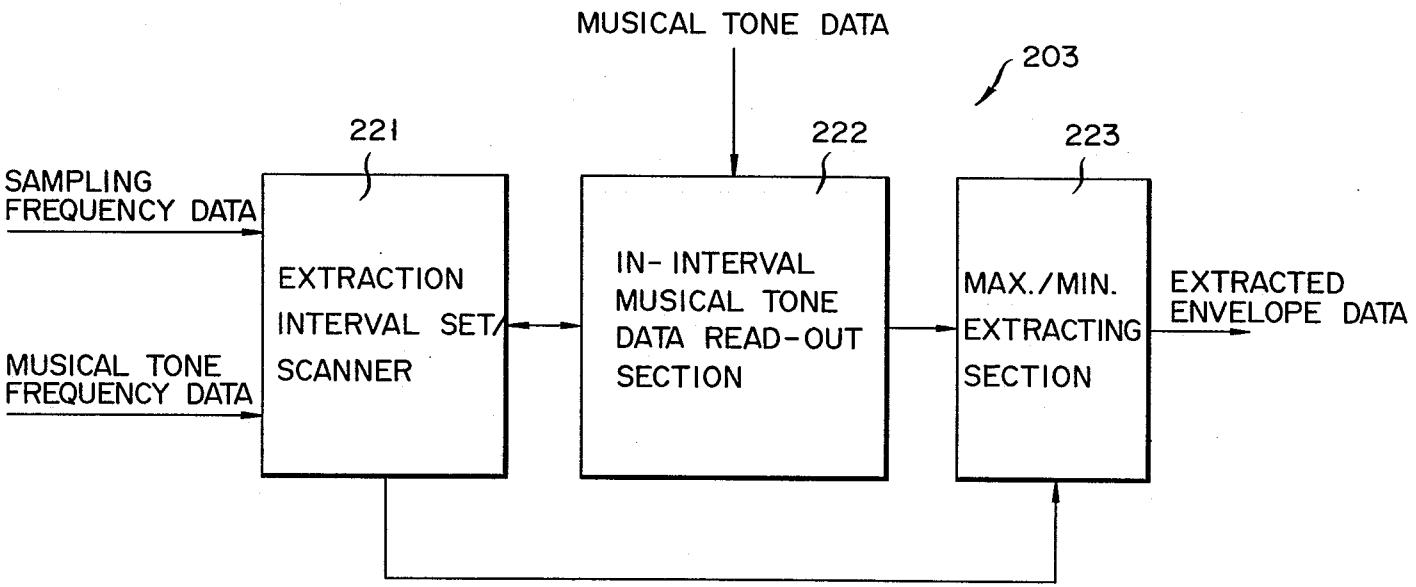
FIG. 12 shows a circuit arrangement of an envelope extracting apparatus according to a second embodiment of the present invention.

An arrangement of envelope extraction circuit 203 is shown in FIG. 12.

Sampling interval set/scanner 221 receives the data from an input unit and determines the interval to extract the envelope values one by one. Every time the envelope value of one interval is determined, the interval is advanced to the next interval. In this way, the musical tone data sampled is scanned over its entire range. In this instance, the sampling frequency data and musical tone (fundamental) frequency data are used for the input data. Therefore, the interval (extraction interval) to extract one envelope value is the interval of time corresponding to the period of the sampled waveform of musical tone.

In-interval musical tone read-out section 222 sequentially reads out, from the musical tone data memory, the musical tone data, which is contained in the waveform of the present interval and derived from sampling interval set scanner 221.

Maximum/minimum extracting section 223 extracts the maximum and minimum peak values of the musical tone data within the interval from read-out section 222. Sampling interval set scanner 221 transfers a signal indicating completion of the present interval to maximum/minimum extraction section 223. Upon receipt of this signal, the section 223 computes the difference between the maximum and minimum peak values, and stores the computed difference into the memory location, which is assigned to the present scanning interval number designated by in-interval musical tone data read-out section 221.

Figure 13:
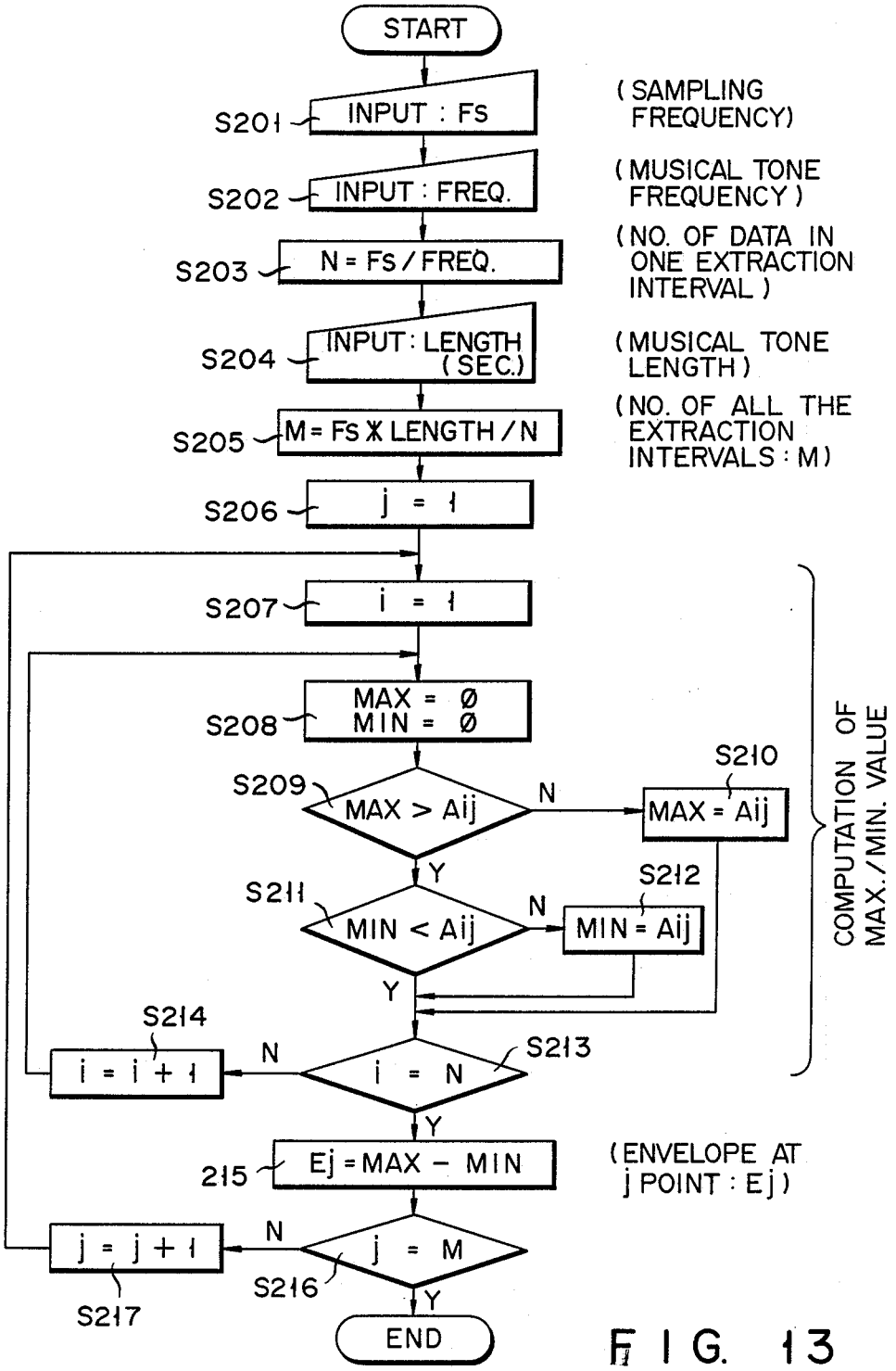
FIG. 13 shows a flow chart of the operation of the second embodiment.

A flowchart useful in explaining the operation of envelope extraction circuit 203 is shown in FIG. 13.

Further, the length (sec.) of the musical tone is input and the total number M of sampling intervals is obtained using the length data, the sampling frequency and the data within one sampling period (S204, F205).

Variable number "j" of the sampling interval number and a variable number "i" of the data position within one sampling interval are initialized to "1" (S206, S207).

A variable number MAX of the maximum value of the musical tone data within one sampling interval and a variable number MIN of the minimum value are initialized to "0" (S208). With i=N, the variable number MAX MIN are compared with the present musical tone data Aij (the i-th musical tone data in the j-th sampling interval) until the completion of the scanning within the present sampling period (S213). If the present data Aij is larger than the variable number MAX, the MAX is updated by that value (S209, S210). If it is smaller than variable number MIN, the MIN is updated by that value (211, S212). To advance the musical tone data to be compared, the variable number "i" is incremented (S214). The above processing is repeated. Accordingly, when the variable "i" reaches N, the maximum value of the musical tone data within the sampling period scanned this time has been stored in MAX and MIN.

When the variable "i" reaches N, the difference between the variable MAX and variable MIN is entered into the variable number Ej of the j-th envelope value. To advance the sampling interval to the next sampling interval, the variable "j" is incremented (S215, S217). The above processing is repeated until the variable "j" reaches the total sum M of sampling intervals (S14), i.e., the sampling of the envelope values during all of the intervals is completed.

An arrangement of variable numbers from El to EM, which is obtained after the processing shown in FIG. 13 is completed, represents the envelope data of M as extracted from the musical tone data.

Figure 14:
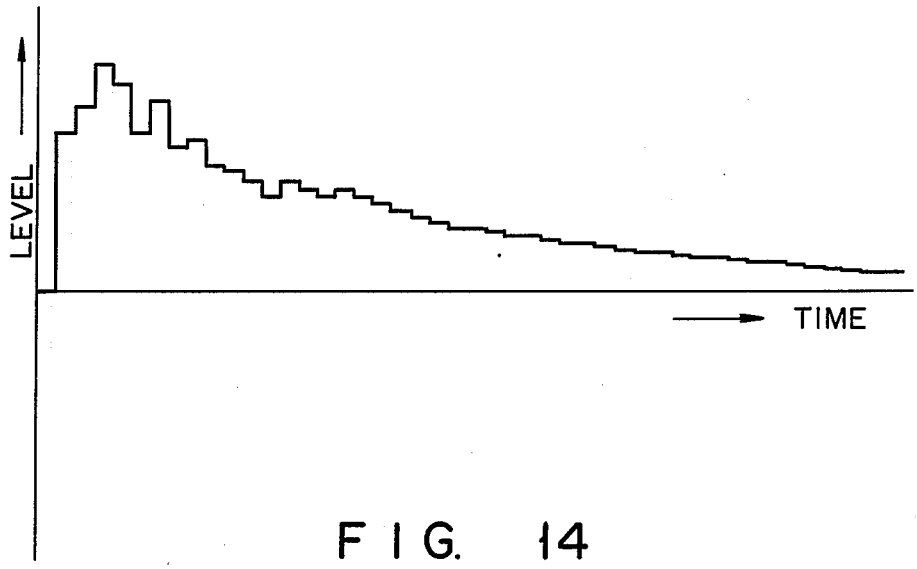
FIG. 14 shows the extracted envelope waveform for the input waveform of FIG. 4 according to the second embodiment.
Figure 15:
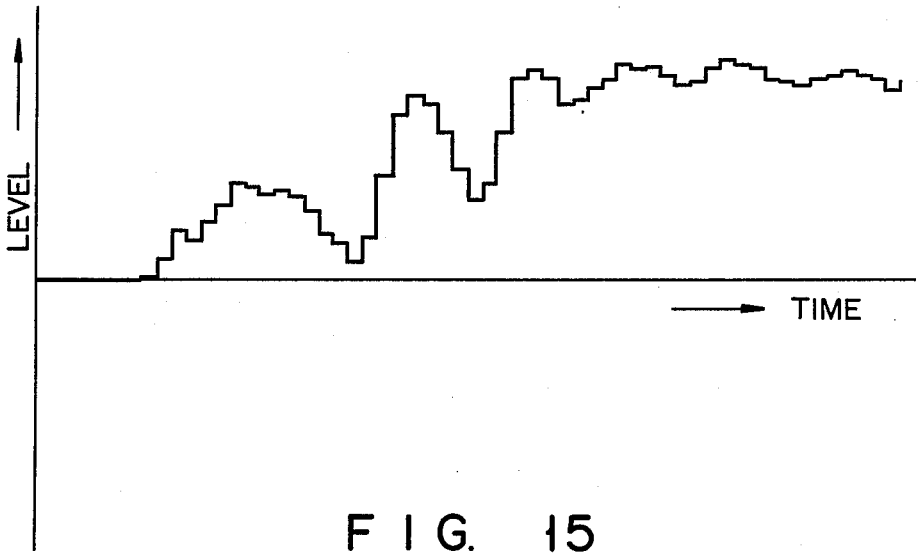
FIG. 15 shows the extracted envelope waveform for the input waveform of FIG. 6 according to the second embodiment.

FIGS. 14 to 15 show respectively the waveforms of the envelopes which are extracted from the waveforms of the input musical tones according to this embodiment. Specifically, FIG. 14 shows the envelope waveform of the damping waveform of the trumpet sound (FIG. 4). FIG. 15 shows the envelope waveform of the continuous waveform of the trumpet sound (FIG. 6).

In the above-mentioned embodiment, the extracting interval, viz., the interval of the waveform data from which one item of envelope data is extracted, corresponds to the period of that waveform. If necessary, any other suitable period such as the time interval two times the period of the musical tone waveform may be used.

3. Effects

As seen from the foregoing description, the envelope data is extracted in a manner that the entire range of the sampled waveform is segmented into a number of time intervals, the maximum and minimum peak values of the waveform data contained in each interval are extracted, and an envelope value inherent to the waveform within the interval is determined on the basis of the extracted values. Therefore the elements of the samples musical tone are very discrete and accurate, well keeping essential features of the natural musical tone.

3rd Embodiment

1. General

A third embodiment of an envelope extracting apparatus according to the present invention will be described with reference to FIGS. 16 to 19.

This embodiment is based on a technical idea that the entire range of the sampled waveform is segmented into a number of time intervals, the area (the total sum of data) of the waveform data contained in each interval are computed, and an envelope value inherent to the waveform within the interval is determined on the basis of the computed values.

2. Description of Arrangement and Operation

Figure 16:
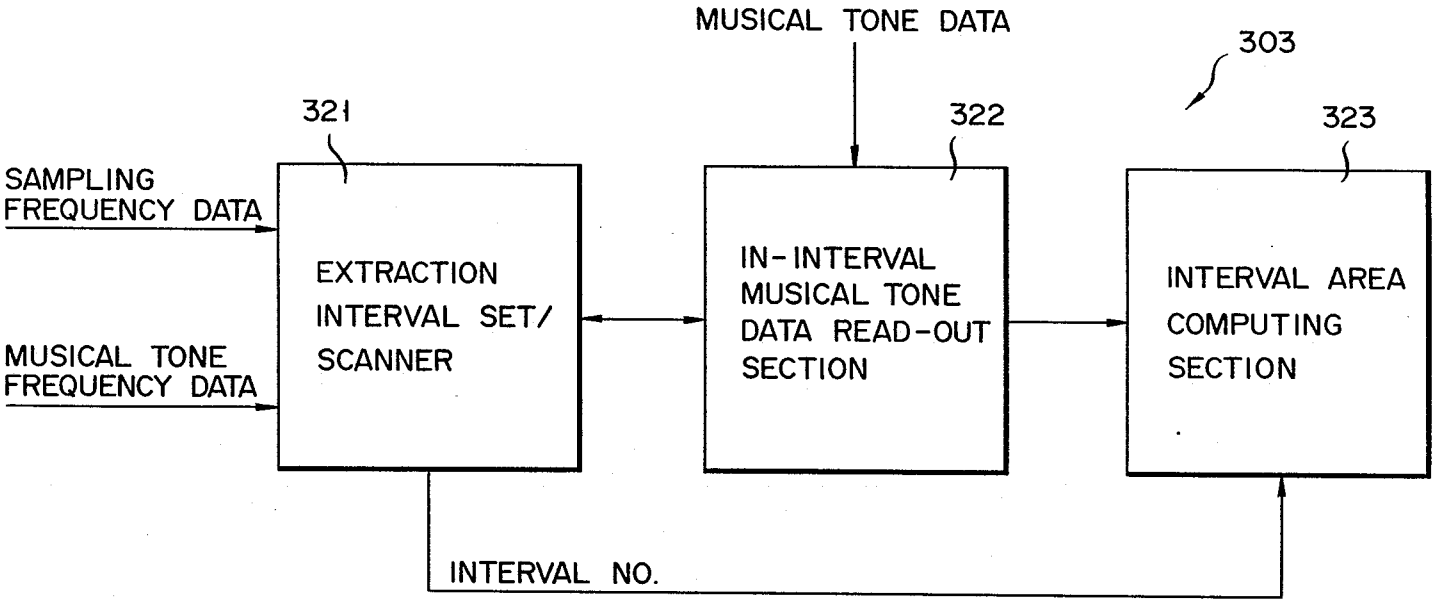
FIG. 16 shows a circuit arrangement of an envelope extracting a according to a third embodiment of the present invention.

An arrangement of the key portion of envelope extraction circuit 303 is shown in FIG. 16.

Sampling interval set scanner 321 receives the data from an input unit and determines the interval to extract the envelope values one by one. Every time the envelope value of one interval is determined, the interval is advanced to the next interval. In this way, the musical tone data sampled is scanned over its entire range. In this instance, the sampling frequency data and musical tone (fundamental) frequency data are used for the input data. Therefore, the interval (extraction interval) to extract one envelope value is the interval of time corresponding to the period of the sampled waveform of musical tone.

In-interval musical tone read-out section 322 sequentially reads out from the musical tone data memory, the musical tone data, which is contained in the waveform of the present interval, and derived from sampling interval set scanner 321.

Interval area computing section 323 extracts the waveform area (total sum of the absolute value) of the musical tone data within the interval from read-out section 322. Sampling interval set scanner 321 transfers a signal indicating completion of the present interval to interval area computing section 323. Upon receipt of this signal, the section 323 computes the total sum (average amplitude of in-interval waveform and its equivalent value), and stores it into the memory location, which is assigned to the present scanning interval number designated by in-interval musical tone data read-out section 321.

Figure 17:
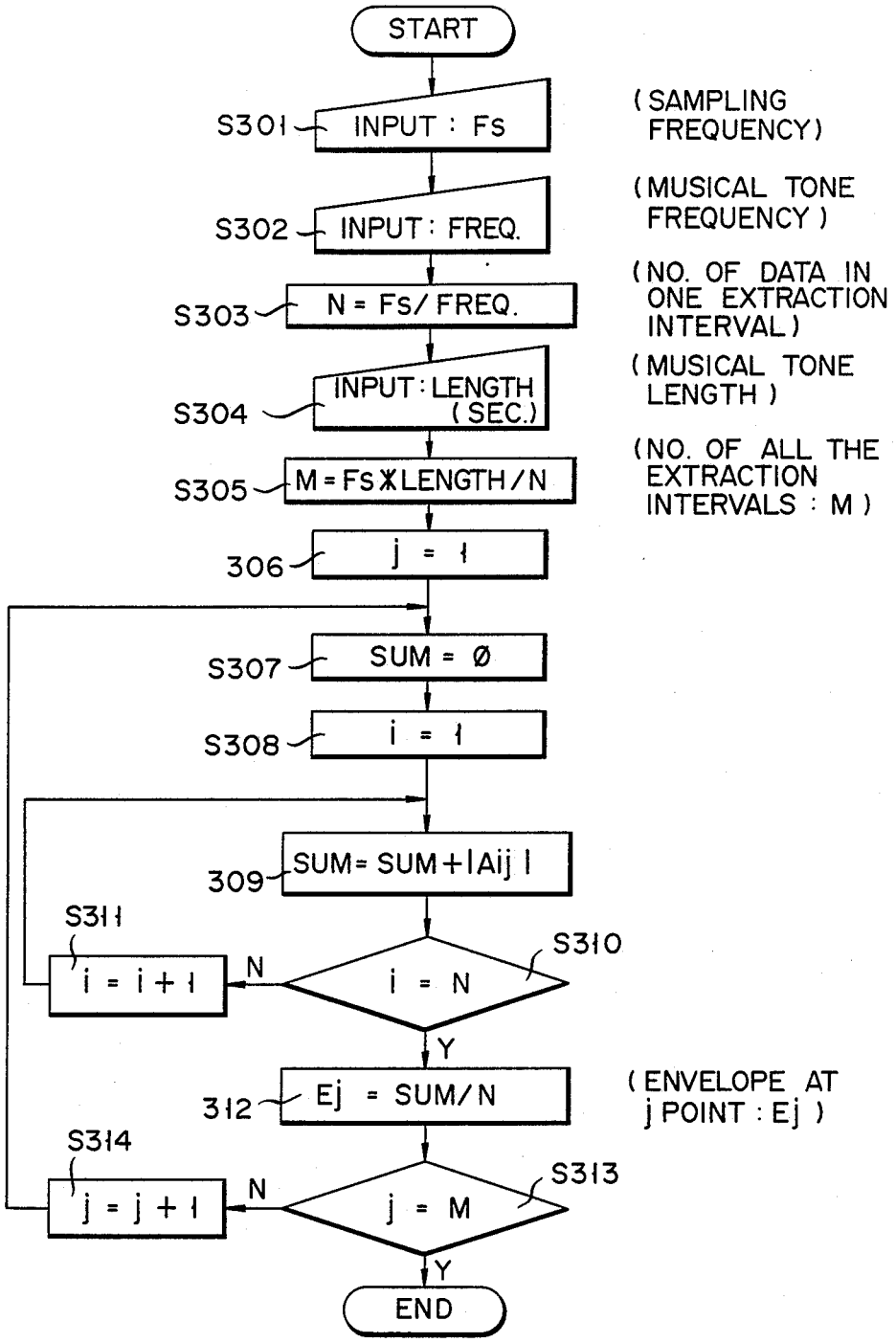
FIG. 17 a flow chart illustrating the operation of the third embodiment.

A flowchart useful in explaining the operation of envelope extraction circuit 303 is shown in FIG. 17.

Further, the length (sec.) of the musical tone is input and the total number M of sampling intervals is obtained using the length data, the sampling frequency and the data within one sampling period (S304, F305).

Parameter "j" of the sampling interval number is initialized to "1" (S306). Parameter "i" in the intended in-interval data location is initialized to "1", and parameter SUM of the total number of data from the 1st data to the i-th data is initialized to "0" (S307, S308).

A parameter MAX of the maximum value of the musical tone data within one sampling interval and a parameter MIN of the minimum value are initialized to "0". With i=N, the absolute value Aij of the present musical tone data location "i" is added to the parameter SUM (309), and the in-interval musical tone data numb 2i" is advanced by one for the next addition (311). The above processing is repeated. Accordingly, when the parameter "i" reaches N, the total sum of the absolute values of the musical tone data within the sampling period scanned this time has been stored in SUM.

When the parameter "i" reaches N, SUM is divided by the number of data within the sampling interval, the result of division is is entered into the parameter Ej of the j-th envelope value. To advance the sampling interval to the next sampling interval, the parameter "j" is incremented (S314). The above processing is repeated until the parameter "j" reaches the total sum M of sampling intervals (S13), i.e., the sampling of the envelope values during all of the intervals is completed.

The processing of step S312 is for normalizing only S312 and there is not any special meaning in the provision of it. The envelope value is equivalent to the area of the waveform within each sampling interval or the average amplitude of the waveform.

Figure 18:
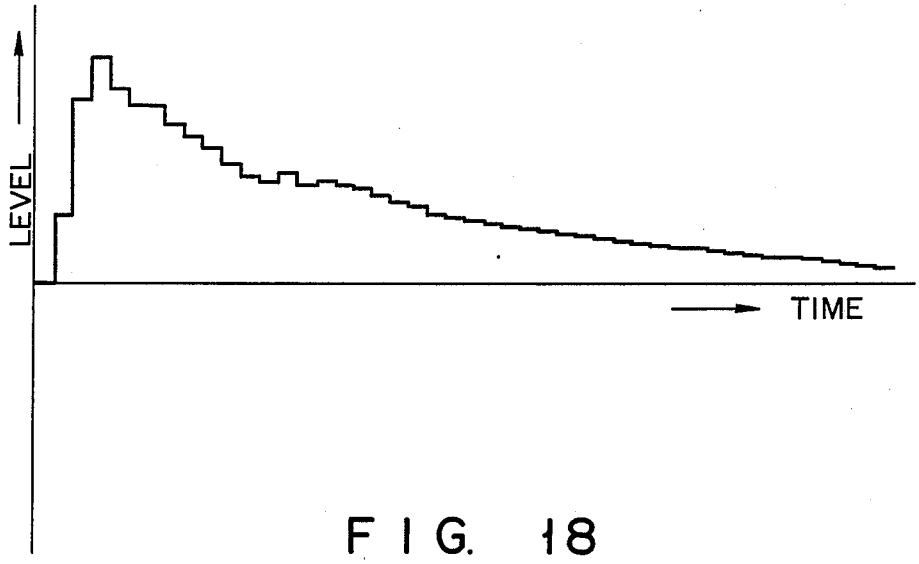
FIG. 18 an extracted envelope waveform for the input waveform of FIG. 4 according to the third embodiment.
Figure 19:
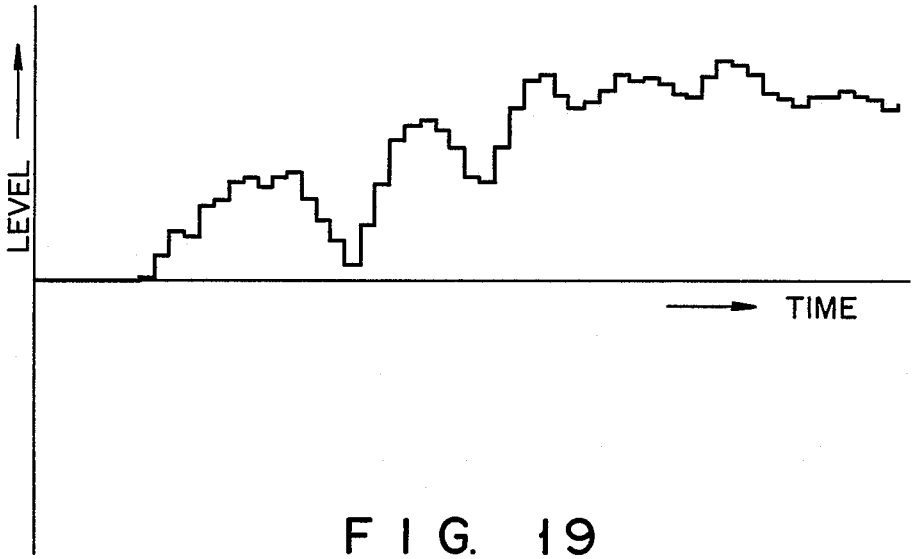
FIG. 19 shows an extracted envelope waveform for the input waveform of FIG. 6 according to the third embodiment.

FIGS. 18 to 19 show respectively the waveforms of the envelopes which are extracted from the waveforms of the input musical tones according to this embodiment. Specifically, FIG. 18 shows the envelope waveform of the damping waveform of the trumpet sound (FIG. 4). FIG. 19 shows the envelope waveform of the continuous waveform of the trumpet sound (FIG. 6).

In the above-mentioned embodiment, the sampling interval, viz., the interval of the waveform data from which one item of envelope data is extracted, corresponds to the period of that waveform. If necessary, any other suitable period such as the time interval two times the period of the musical tone waveform may be used.

3. Effects

As seen from the foregoing description, the envelope data is extracted in a manner that the entire range of the sampled waveform is segmented into a number of time intervals, the area occupied by the musical tone within the interval is computed. Therefore, the elements of the sampled musical tone are very discrete and accurate, well retaining essential features of the natural musical tone.

4th Embodiment

1. General

A fourth embodiment of an envelope extracting apparatus according to the present invention will be described with reference to FIGS. 20 to 23.

This embodiment is based on a technical idea that the entire range of the sampled waveform is segmented into a number of time intervals, the total sum of the squares of the waveform data values in the intervals (the power of waveform) are computed, and envelope values inherent to the waveform within the intervals are determined on the basis of the computed values.

2. Description of Arrangement and Operation

Figure 20:
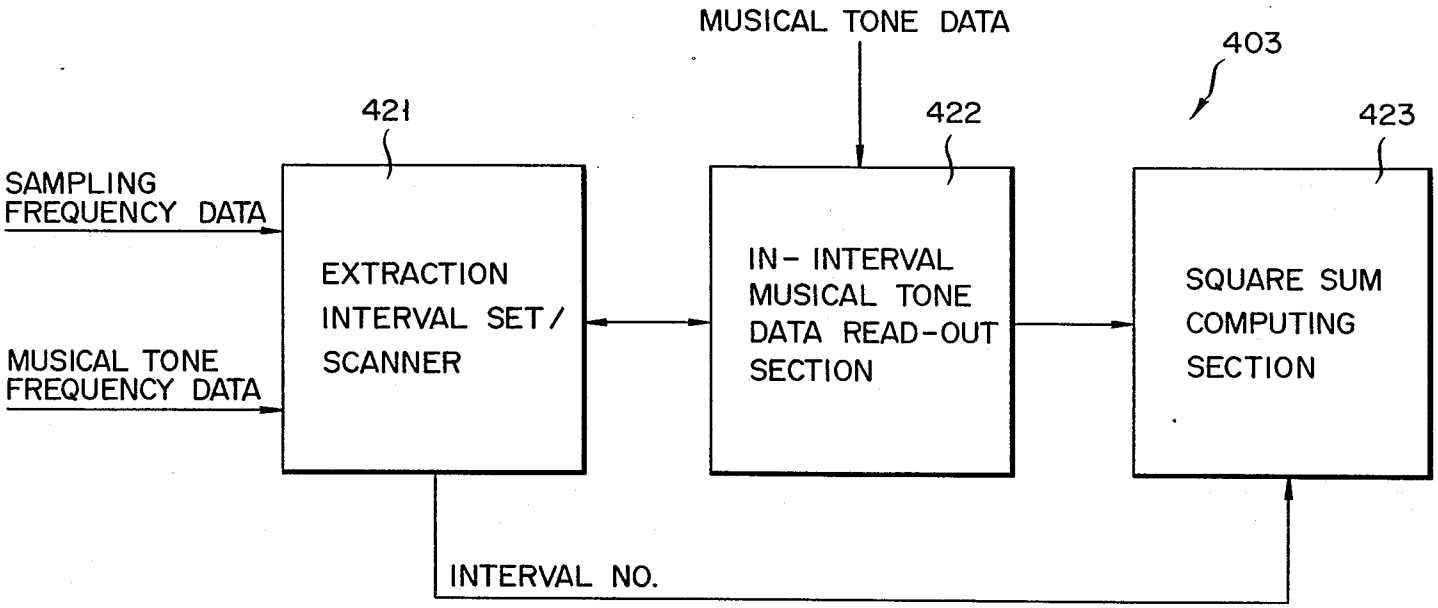
FIG. 20 a block diagram of an envelope extracting circuit according to a fourth embodiment of the present invention.

An arrangement of envelope extraction circuit 403 is shown in FIG. 20.

Sampling interval set scanner 421 receives the data from an input unit and determines the interval to extract the envelope values one by one. Every time the envelope value of one interval is determined, the interval is advanced to the next interval. In this way, the musical tone data sampled is scanned over its entire range. In this instance, the sampling frequency data and musical tone (fundamental) frequency data are used for the input data. Therefore, the interval (extraction interval) to extract one envelope value is the interval of time corresponding to the period of the sampled waveform of musical tone.

In-interval musical tone read-out section 422 sequentially reads out, from the musical tone data memory, the musical tone data, which is contained in the waveform of the present interval and derived from sampling interval set scanner 421.

Maximum/minimum extracting section 423 extracts the maximum and minimum peak values of the musical tone data within the interval from read-out section 422. Sampling interval set scanner 421 transfers a signal indicating completion of the present interval to maximum/minimum extraction section 423. Upon receipt of this signal, the section 423 computes the difference between the maximum and minimum peak values, and stores the computed difference into the memory location, which is assigned to the present scanning interval number designated by in-interval musical tone data read-out section 421.

Figure 21:
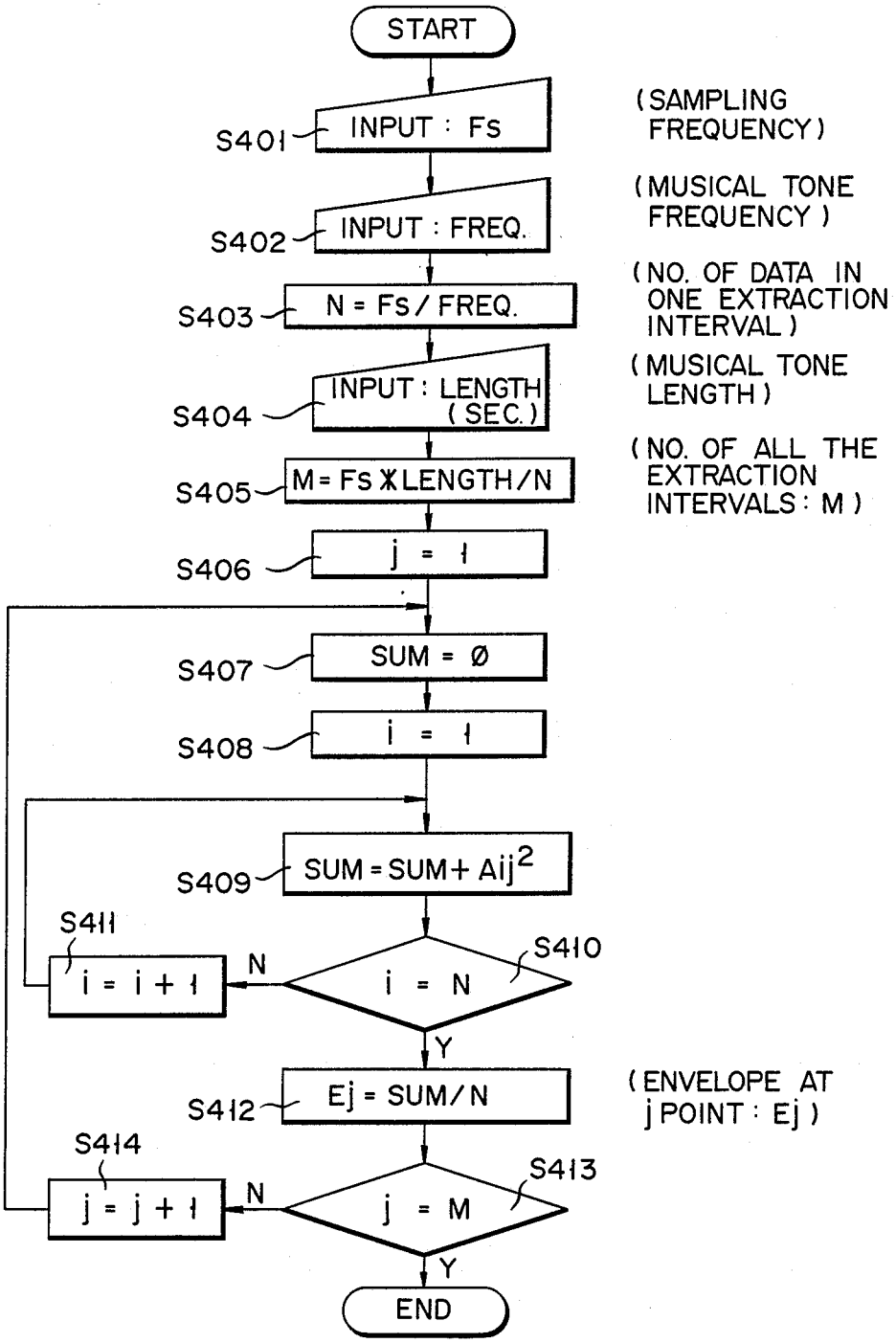
FIG. 21 shows a flow chart illustrating the operation of the fourth embodiment.

A flowchart useful in explaining the operation of envelope extraction circuit 403 is shown in FIG. 21.

Sampling frequency Fs and the frequency Freq of the musical tone are input to the envelope approximating apparatus, the number N of musical tone data within the sampled interval is computed (steps 401 to S403). Then, the data of the fundamental frequency is entered into the one sampling interval or period.

Further, the length (sec.) of the musical tone is input and the total number M of sampling intervals is obtained using the length data, the sampling frequency and the data within one sampling period (S404, F405).

Parameter "j" of the sampling interval number is initialized to "1" (S406). Parameter "i" in the intended in-interval data location is initialized to "1", and parameter SUM of the total sum of the square of the data data from the 1st data to the i-th data within the intended interval is initialized to "0" (S407, S408). until the scanning for the currently intended interval is completed, the square of the musical tone data value $Aij^2$ is added to SUM (S409), and the in-interval musical tone data numb "i" is advanced by one for the next addition (411). The above processing is repeated. Accordingly, when the parameter "i" reaches N, the total sum of the squares of the musical tone data, i.e., the waveform power, within the sampling period scanned this time has been stored in SUM.

When the parameter "i" reaches N, SUM is divided by the number N of data within the sampling interval, the result of division is is entered into the parameter Ej of the j-th envelope value (S412). To advance the sampling interval to the next sampling interval, the parameter "j" is incremented (S414). The above processing is repeated until the parameter "j" reaches the total sum M of sampling intervals (S13), i.e., the sampling of the envelope values during all of the intervals is completed.

After completion of the FIG. 21 processing, the arrangement of El to EM represents is for normalization only, and there is not any special meaning. The envelope value is equivalent to the waveform power within each sampling interval.

Figure 22:
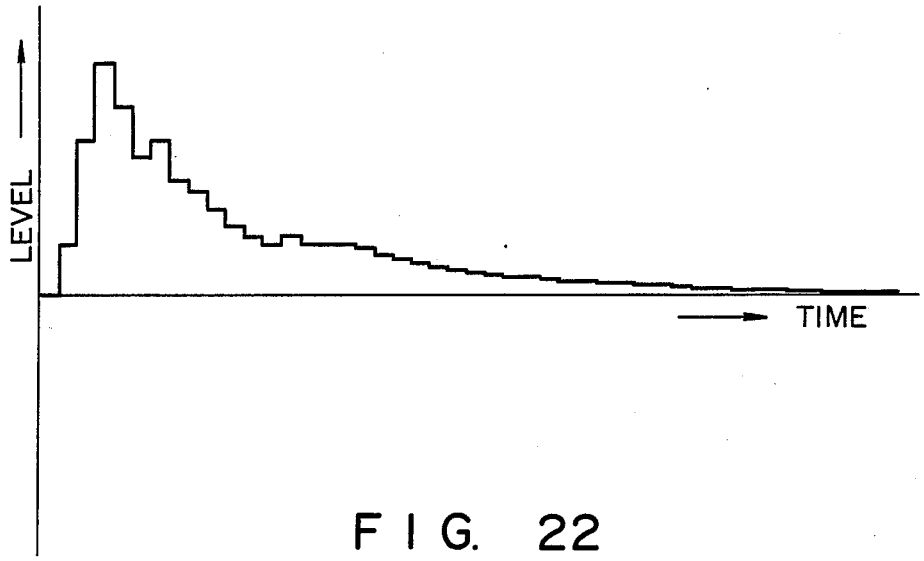
FIG. 22 shows an extracted envelope waveform for the input waveform of FIG. 4 according to the fourth embodiment.
Figure 23:
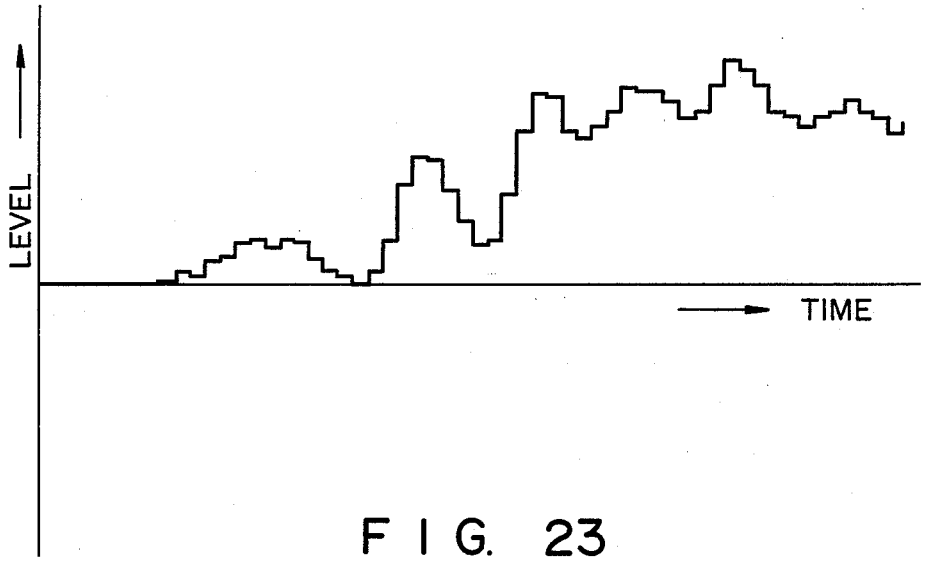
FIG. 23 shows an extracted envelope waveform for the input waveform of FIG. 6 according to the fourth embodiment.

FIGS. 22 to 23 show respectively the waveforms of the envelopes which are extracted from the waveforms of the input musical tones according to this embodiment. Specifically, FIG. 22 shows the envelope waveform of the damping waveform of the trumpet sound (FIG. 4). FIG. 23 shows the envelope waveform of the continuous waveform of the trumpet sound (FIG. 6).

In the above-mentioned embodiment, the sampling interval, viz., the interval of the waveform data from which one item of envelope data is extracted, corresponds to the period of that waveform. If necessary, any other suitable period such as the time interval two times the period of the musical tone waveform may be used.

3. Effects

As seen from the foregoing description, the envelope data is extracted in a manner that the entire range of the sampled waveform is segmented into a number of time intervals, the waveform power (square sum of data values) within the intervals are computed. Therefore the elements of the sampled musical tone are very discrete and accurate, well retaining essential features of the natural musical tone.

5th Embodiment

1. General

A fifth embodiment of an envelope approximating apparatus according to a fifth embodiment will be described referring to FIG. 24.

A technical idea of the fifth embodiment is similar to that of FIGS. 10A and 10B. In this embodiment, an envelope waveform expressed by given envelope data is approximated by a limited number of lines whose direction changes at a switching point.

The data of a line connecting switching points is generated. The total number of errors between the line data and the envelope, i.e., the difference area between those waveforms, is computed. A switching point to substantially minimize the difference area is used as an optimum switching point.

2. Description of Arrangement and Operation

A hardware of the envelope approximating apparatus will be expressed in a functional block diagram. An overall operation of the envelope approximating apparatus is substantially the same as that of FIGS. 10A and 10B. FIG. 24 shows an arrangement of line switching point analyzer 522.

In this embodiment, the entire range of the original envelope data is used for the first data interval. The first optimum switching point is obtained by scanning the points within the original envelope from the start point to the end point. Subsequently, the optimum switching point as obtained is used as the end point of the data interval. ER is obtained by using a line y=a3+b3 (old line) connecting the optimum switching points already obtained, and two new lines y 32 a1x+b1, Y=a2x+b2, and the envelope waveform data within the data interval. An internal point to maximize the ER during the entire range of the original envelope waveform, is extracted. This extracted point is used as a new optimum switching point.

Figure 24:
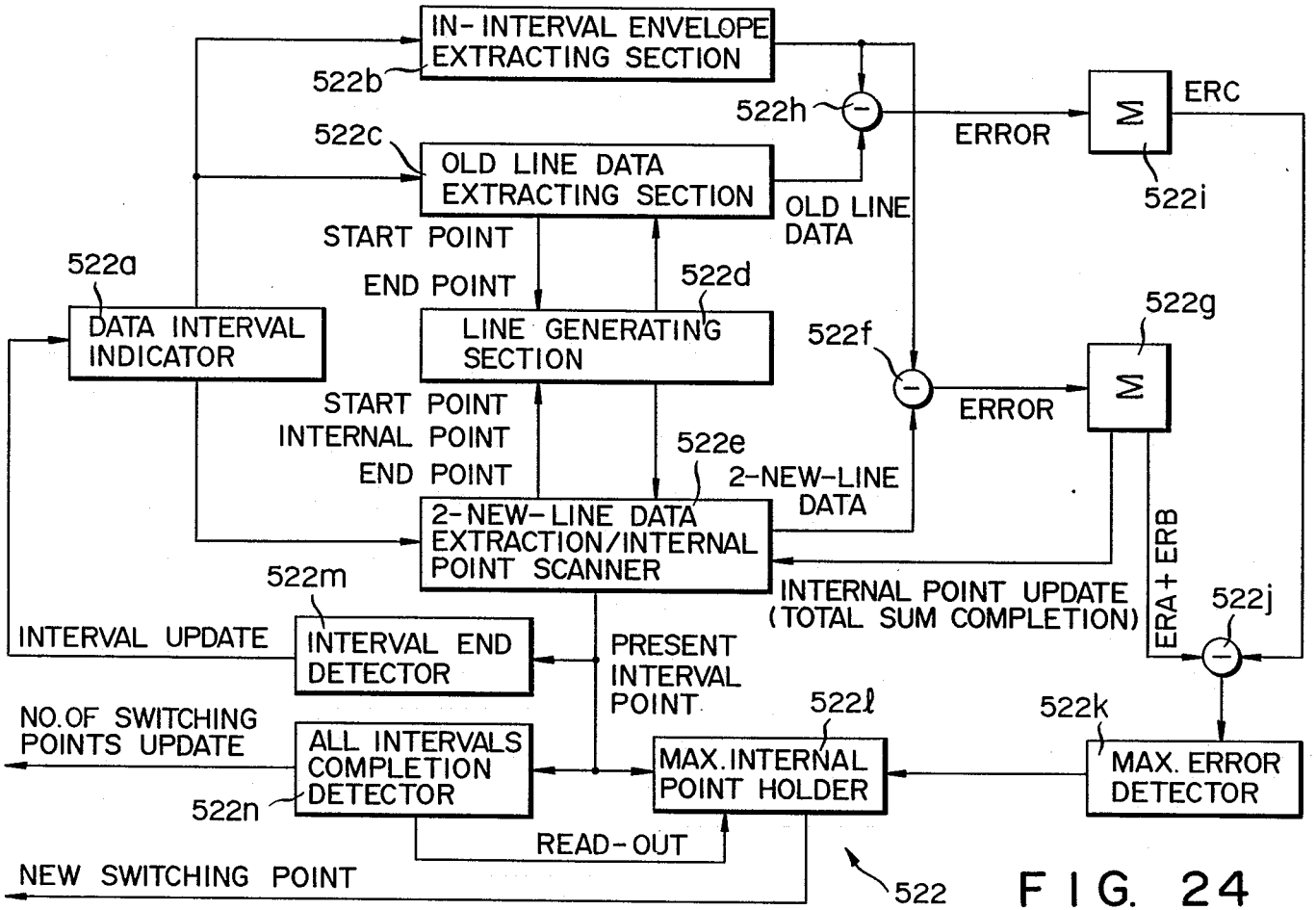
FIG. 24 shows a circuit arrangement of a line switching point analyzing section as a key portion of the envelope approximating apparatus according to a fifth embodiment of the present invention.

In FIG. 24, the cycle controller sets the data of the data intervals in accordance with cycles, in data interval indicator 522*a*. In-interval envelope extraction section 522*b* extracts the original envelope data in the present data interval indicated by data interval indicator 522*a*. Old line data extracting section 522*c* transfers the start and end points of the present data interval to line generating section 522*d*. Upon receipt of this, the generating section 522*d* computes a coefficient to determine the line, and computes the old line data using a predetermined line. 2 new line data extraction/internal point scanner 522*e* scans the internal points from the start point to the end point within the present data interval, and transfers the start point, end point, and the present interval point to line generating section 522*d*. Line generating section 522*d* forms new line 1 by using the start point and the internal point, and further forms new line 2 using the internal point and the end point. Upon receipt of this, 2 lines extraction/internal point scanner 522*e* generates 2 types of new line data. Difference element 522*f* computes absolute values of the error existing between the envelope data at the respective points in the data interval and two new lines data. Summing section 522*g* computes the total sum of these absolute values, or the difference area (ERA+ERB) between the two new lines at the present internal points and the original envelope waveforms. After the summing by summing section 522*g*, the scanner 522*e* shifts the internal point by 1, and extracts two new lines data again.

Difference element 522*h* works out an absolute value of the difference between each data of the in-interval envelope waveform and each data of the old line. Summing section 522*i* works out the total sum of these absolute values, or the difference area ERC between the old tine and the original envelope waveform.

Difference element 522*j* computes the difference between those difference areas ERC and (ERA+ERB) which are respectively derived from those sections 522*i* and 522*g*.

The output signal from difference element 522*j* indicates a decreasing rate of the difference area. Maximum error detector 522*k* extracts its maximum value. When the detector 522*k* detects a new maximum value, it transfers a signal to maximum internal point holder 522*l*. Upon receipt of this, the holder 522*l* reads in and holds the present internal points derived from internal point scanner 522*e*.

When the present internal point reaches the end point of the present data interval, this is detected by interval end detector 522*m*. Then, data interval indicator 522*a* shifts the indicated data interval to the next interval.

When all of the data intervals have been scanned, the present internal point reaches the end point of the entire interval of the original envelope. This is detected by all intervals completion detector 522*n*.

At this time, maximum internal point holder 522*l* holds a switching point. This switching point is the internal point to minimize the error between the original envelope waveform and the curve within the entire interval of the original envelope, viz., a switching point which, when one switching point is added, minimizes the difference area to make the polygonal line closest in shape to the waveform of the original envelope.

Accordingly, the detector 522*n* informs the cycle controller of the scanning completion in this cycle, and reads out a new optimum switching point from MAX internal point holder 522*l*, and transfers it to the cycle controller.

At this point line switching point analyzer 522 completes the operation of one cycle, and waits for the instruction to start the next cycle from the cycle controller.

While in the above-mentioned embodiment, switching points selection is automatically made, some part of it may be manually made, if necessary, on the basis of the original envelope waveform.

For the selection of switching point, the above-mentioned embodiment uses the point to minimize the difference area between the exponential curve and the original envelope waveform, as the optimum switching point. If necessary, it may be used in combination with another switching point. For example, the peak value of the attack in the original envelope waveform may be used as one of the optimum switching points. The peak value of the attack can be obtained by searching the maximum value in the original envelope data.

3. Effects

As seen from the foregoing description, the approximation of the envelope waveform described by the given original envelope data is made by using the limited number of lines to minimize the difference area between the line and the original waveform. With this the original waveform can be well approximated while keeping the essential features of the original sound. When the approximated envelope signal is applied to the musical tone composer, it produces a musical tone near to the natural musical tone.

6th Embodiment

1. General

A sixth embodiment of an envelope approximating apparatus according to a sixth embodiment will be described referring to FIGS. 25 to 30.

A technical idea of the sixth embodiment is similar to that of the fifth embodiment. In this embodiment, an envelope waveform expressed by given envelope data is approximated by a limited number of lines whose direction changes at a switching point. The data of a line connecting switching points is generated. The total number of the square of errors between the line data and the envelope, is computed. A switching point to substantially minimize the difference area is used as an optimum switching point.

To be more specific, the waveform of the original envelope data is approximated by a limited number of lines (polygonal line) which minimizes the total sum of the square of errors. The data compression is realized while keeping the features of the musical tone of a natural musical instrument, which are contained in the original envelope data. The optimizing principle to minimize the total sum of the error square enables the original envelope waveform to be expressed intensifying the attach portion of the original envelope data. The linear envelope with the intervals each between the optimum switching points is formed by using the compressed data. The technical idea of the sixth embodiment is directly or readily applicable for the conventional musical instruments of the type in which a line is formed within the interval.

Generally, the total sum of the square error changes when the switching point coordinates is changed. In other words, it is a function of the position of the switching point. Of those switching points, the switching point to minimize the total sum of the error square is the optimum switching point. A range for searching switching points (scanning range) and the order of scannings may be appropriately changed if the line whose direction changes at the searched optimum switching point, well approximates the original envelope waveform, as described in the first embodiment.

2. Description of Arrangement and Operation

Figure 25:
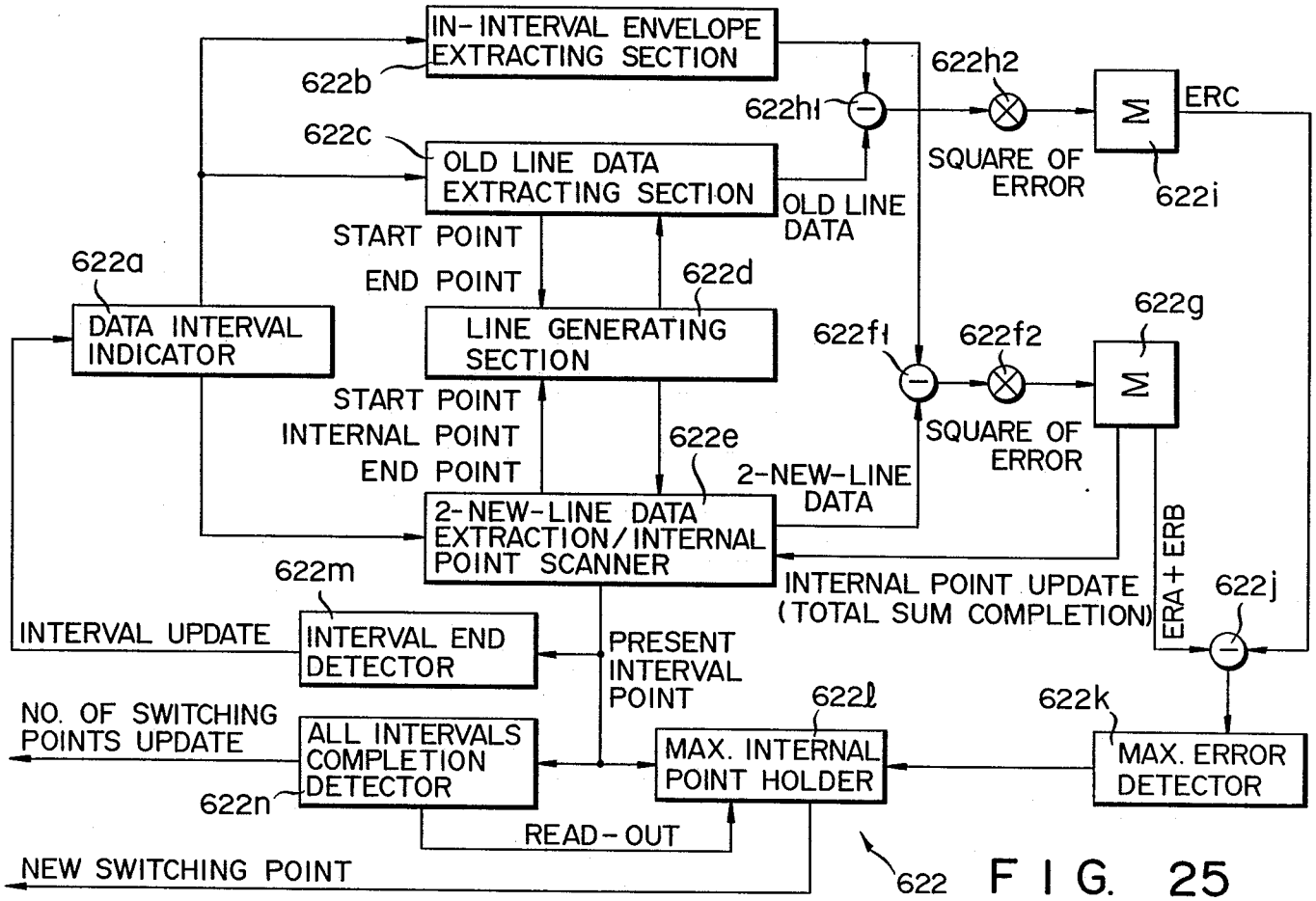
FIG. 25 shows a circuit arrangement of a line switching point analyzing section as a key portion of the envelope approximating apparatus according to a sixth embodiment of the present invention.

FIG. 25 shows an arrangement of line switching point analyzer 622 designed on the basis of the technical idea of this embodiment.

In this embodiment, the entire range of the original envelope data is used for the first data interval. The first optimum switching point is obtained by scanning the points within the original envelope from the start point to the end point. Subsequently, the optimum switching point as obtained is used as the end point of the data interval. ER is obtained by using a line $Y=a3x+b3$ (old line) connecting the optimum switching points already obtained, and two new lines $y=a1x+b1$, $y=a2x+b2$, and the envelope waveform data within the data interval. An internal point to maximize the ER during the entire range of the original envelope waveform, is extracted. This extracted point is used as a new optimum switching point.

The circuit arrangement of the sixth embodiment of FIG. 25 is substantially the same as that of FIG. 24. Like portions are designated by reference numerals which are those numerals of FIG. 24 plus 100. For example, **522*x* in FIG. 24 is 722*x* in FIG. 27. 2 new lines extraction/internal point scanner 622*a* generates 2 types of new line data. Difference element 622*f1* computes the error existing between the envelope data at the respective points in the data interval and two new lines data. Square element 622*f2* squares these errors. Summing section 622*g* computes the total sum of these errors, or the total sum of square errors (ERA +ERB) between the two new lines at the present internal points and the original envelope data. After the summing by summing section 622*g*, the scanner 622*e* shifts the internal point by 1**, and extracts two new lines data again.

Difference element **622*h1* works out an error existing between each data of the in-interval envelope waveform and each data of the old line, and square element 622*h2* computes square values of these errors. Summing section 622*i*** works out the total sum of these square errors ERC.

Difference element **622*j* computes the difference between the total sum of these square errors ERC and (ERA+ERB) which are respectively derived from those sections 622*i* and 622*g***.

The output signal from difference element **622*j* indicates a decreasing rate of the total sum of square errors. Maximum error detector 622*k* extracts its maximum value. When the detector 622*k* detects a new maximum value, it transfers a signal to maximum internal point holder 622*l*. Upon receipt of this, the holder 622*l* reads in and holds the present internal points derived from internal point scanner 622*e***.

When the present internal point reaches the end point of the present data interval, this is detected by interval end detector **622*m*. Then, data interval indicator 622*a*** shifts the indicated data interval to the next interval.

When all of the data intervals have been scanned, the present internal point reaches the end point of the entire interval of the original envelope. This is detected by all intervals completion detector **622*n***.

At this time, maximum internal point holder **622*l*** holds a switching point. This switching point is the internal point to minimize the error between the original envelope waveform and the line within the entire interval of the original envelope, viz., a switching point which, when one switching point is added, minimizes the total sum of square errors to make the polygonal line closest in shape to the waveform of the original envelope.

Accordingly, the detector **622*n* informs the cycle controller of the scanning completion in this cycle, and reads out a new optimum switching point from MAX internal point holder 622*l***, and transfers it to the cycle controller.

At this point line switching point analyzer 622 completes the operation of one cycle, and waits for the instruction to start the next cycle from the cycle controller.

Figure 26A:
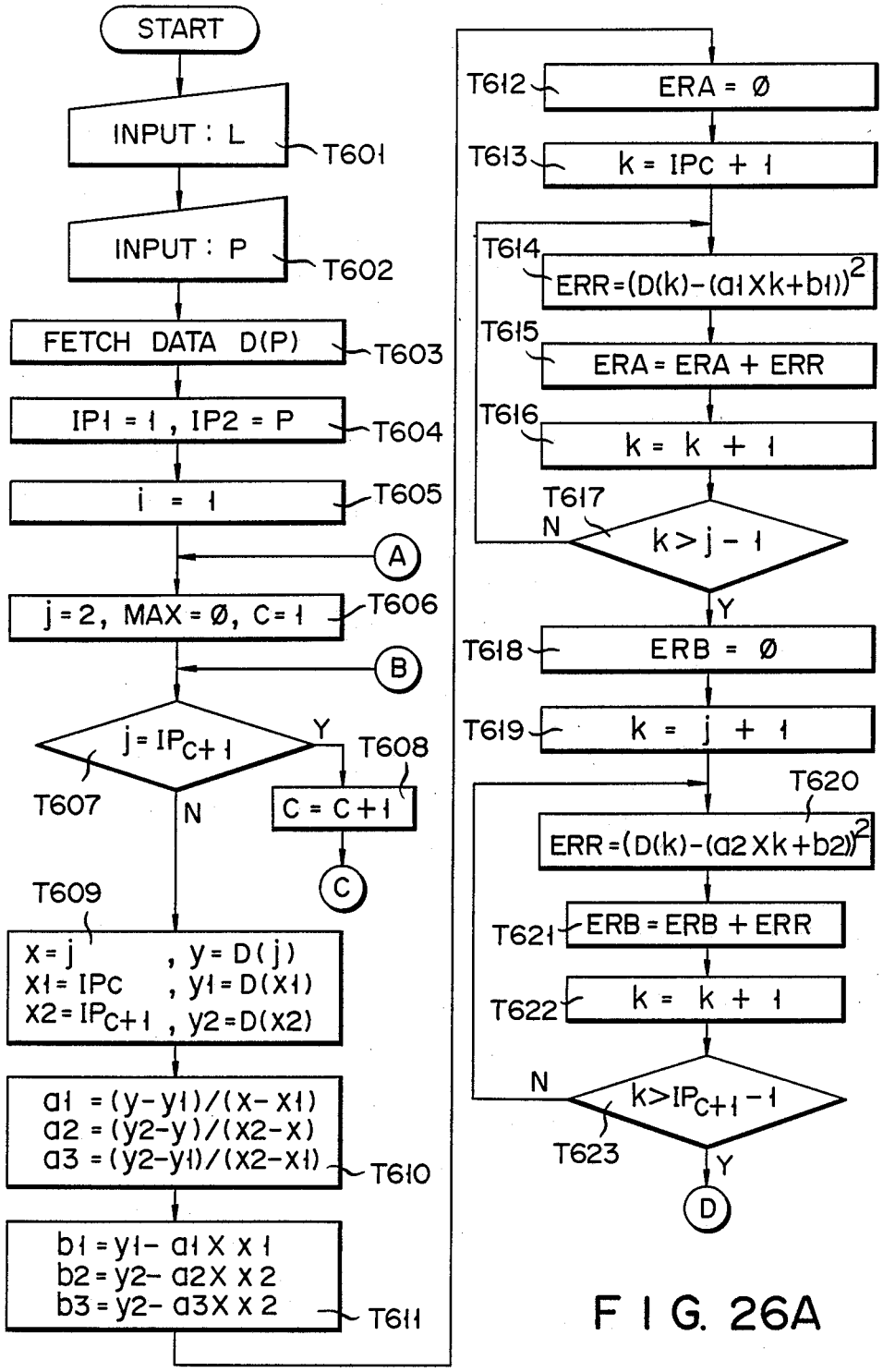
FIGS. 26A and 26B show a flow chart illustrating the operation of an envelope approximating apparatus according to the sixth embodiment.
Figure 26B:
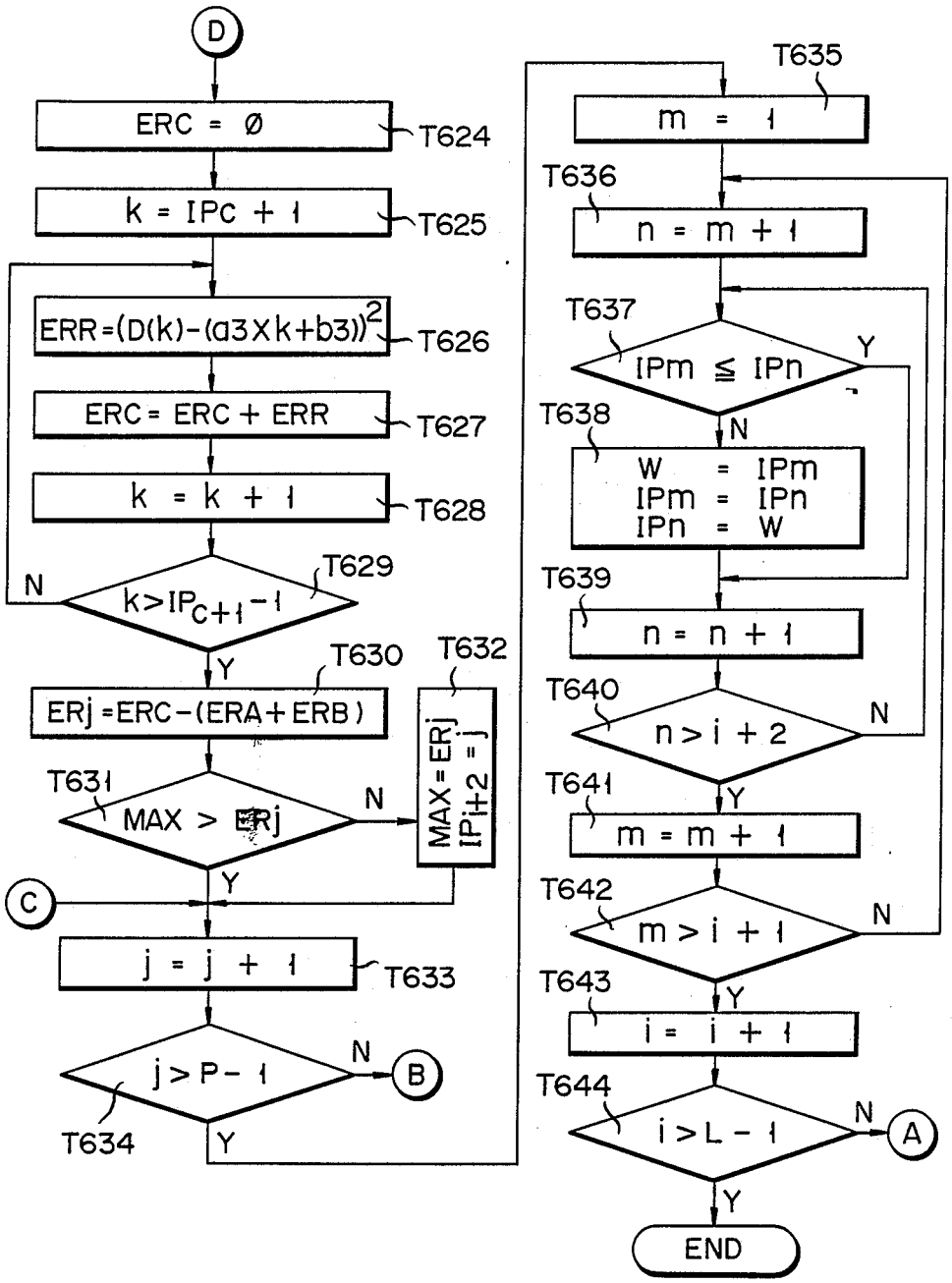

FIG. 26 shows a flowchart for explaining in detail the operation of the envelope approximating apparatus. This flowchart is substantially the same as that of the 1st embodiment, FIG. 10, with some exception. The description of the operation will be given, laying an emphasis on the different portions.

ERA ; Total sum of square of differences between the line QP between Q and P, and y=D(x)

ERB ; Total sum of square of differences between the line PR between P and R, and y=D(x)

ERC; Total sum of square of differences between the line QR between Q and R, and y=D(x)

ERj; Decreasing rate in selecting P points m, n; Parameter for reordering IPs (sorting)

The processing by the flowchart will be apparent when reading the description so far made and the definition of the parameters. Hence, the flowchart will be described. The step numbers in this flow are designated by reference numerals which are those numerals of FIGS. 10A and 10B plus 600.

Steps T601 to T605 are for initializing processing, and sets the number of lines, inputs the number of data of the original envelope used, and fetches the original envelope data.

Step T606 is provided for starting the cycle to seek a new optimum switching point, and in this step, the x-coordinates of the internal point is laid at the second envelope data (j=2), the maximum value is set at "0", and "c" is set at "1" for initializing the data interval.

Step T607 for checking the updating of the data interval, checks if the present internal point reaches the end point of the data interval. If it is reached, step shifts the data interval from the present data interval to the next one.

Steps T609 to T611 determine the old line y=a3+b3, and two new lines y=a1x+b1, y=a2+b2, by using the start point coordinates (Xl, yl) and the end point coordinates (x2, y2) of the data interval, and the coordinates (x, y) of the internal point.

In steps T612 to T617, CPU computes the total sum of square of differences between the new line y=a1x+b1 and the envelope waveform y=D(x) in the range from the start point Q and the internal point P in the present data interval, and stores it as ERA.

In steps T618 to T623, CPU computes the total sum of square of differences between the new line y=a2x+b2 and the envelope waveform y=D(x), in the range from the start point P and the internal point R in the present data interval, and stores it as ERB.

In steps T624 to T629, CPU computes the total sum of square of differences between the old line y=a3x+b3 and the envelope waveform y=D(x) in the present data interval, and stores it as ERC.

In step T630, CPU computes a decreasing rate of the total sum of square of errors existing between the original envelope and the line, when the internal point P is selected as a switching point, and stores it as ERj.

This ERj is compared with the maximum value MAX of those values obtained so far (step T631). If the ERj is larger than the latter, its value is loaded as MAX. The x coordinates "j" of the internal point at that time is loaded into IPi+2 (T632).

The internal point is advanced by one with j=J+1. This processing is repeated until the internal point reaches the end point of the original envelope waveform (T633, T634).

Steps T635 to T642 are used for the sorting of setting of the x coordinates of the optimum switching point. In this instance, a new optimum switching point is once set in IPi+2 as shown in step T632. As seen from step T604, as control enters step T635, the x coordinates of the end point of the envelope waveform has been set in IPi+1. At this time IPi+1>IPi+2 has held. In this sorting processing, the sets of the x coordinates are arranged IP1<IP2<. . . IPi+2.

To start the next cycle, "i" is incremented and this is repeated until lines of L (T643, T644).

Through the above processing, the set IP=(IP1, IP2, . . . IPL+1 points is obtained by using original envelope data D(1) to D(P), and the number L of the set lines.

To actually generate the line approximated envelope data, it is only needed to use sets IP and D(IP) of the optimum setting points. Specifically, a line connecting sets (IP1, D(IP1)) and (IP2, D(IP2)) is first computed. When set IP2 is reached, an line connecting sets (IP2, D(IP2)) and (IP3, D(IP3)) is then computed. Subsequently, the lines are switched at the switching points.

According to the sixth embodiment, when the envelope data extracted from the natural musical tone is applied, the line approximation can be automatically made merely by designating the number of lines by an operator. In this respect, this method can obtain the envelope more effectively and quickly than the conventional try-and-error method.

While in the above-mentioned embodiment, switching points selection is automatically made, some part of it may be manually made, if necessary, on the basis of the original envelope waveform.

For the selection of switching point, the abovementioned embodiment uses the point to minimize the total sum of square errors of the difference between the line and the original envelope waveform, as the optimum switching point. If necessary, it may be used in combination with another switching point. For example, the peak value of the attack in the original envelope waveform may be used as one of the optimum switching points. The peak value of the attack can be obtained by searching the maximum value in the original envelope data.

3. Effects

As seen from the foregoing description, the approximation of the envelope waveform described by the given original envelope data is made by using the limited number of lines to minimize the total sum of square errors existing between the line and the original waveform. With this the original waveform can be well approximated while keeping the essential features of the original sound. When the approximated envelope signal is applied to the musical tone composer, it produces a musical tone near to the natural musical tone.

7th Embodiment

1. General

A seventh embodiment of an envelope approximating apparatus according to the present invention will be described referring to FIGS. 27 to 28.

This embodiment applies the approximation function to curves resembling exponential curves, while the function has been applied to rectilinear curves in the embodiments thus far mentioned.

In this embodiment, the sum of differences between the exponential curve data connecting switching points and the envelope data, viz., the difference area between both the waveforms, is computed, and a switching point to substantially minimize the difference area is used as the optimum switching point.

The optimizing method to minimize the difference area enables the whole waveform of the original envelope to be reproduced in an exact manner.

The technical idea in this embodiment is almost applied to the electronic conventional musical instruments of type in which the exponential curve is generated within the interval in order to form an envelope curve.

The search range in searching the switching points (scanning range) and the order of scannings are widely variable, as discussed in the first embodiment. For example, the rise portion of the envelope contains the most distinctive features of the musical tone. Higher density scanning, if necessary, may be applied for this portion. If so done, a good approximation of the waveform is obtained.

2. Description of Arrangement and Operation

Figure 27:
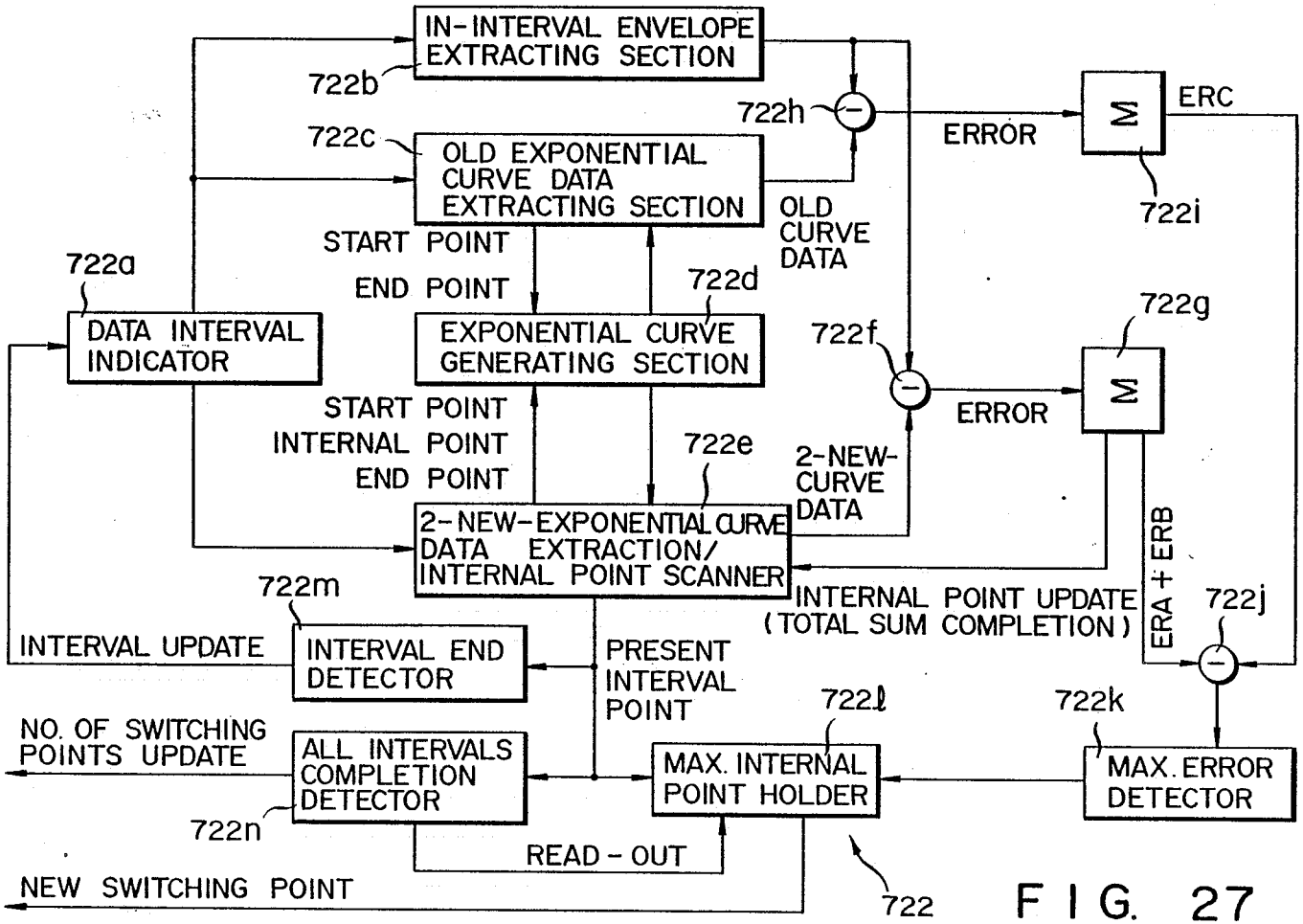
FIG. 27 a circuit arrangement of an exponential curve switching point analyzing section as a key portion of the envelope, approximating apparatus according to a sixth embodiment of the present invention.

FIG. 27 shows an arrangement of exponential curve switching point analyzer 722, which is contained in the envelope approximating apparatus designed on the basis of the technical idea of this embodiment.

In this embodiment, the entire range of the original envelope data is used for the first data interval. The first optimum switching point is obtained by scanning the points within the original envelope from the start point to the end point. Subsequently, the optimum switching point as obtained is used as the end point of the data interval. ER is obtained by using an exponential curve $y=e^{a3x+b3}$ (old exponential curve) connecting the optimum switching points already obtained, and two new exponential curves $y=e^{a1x+b1}$ and $y=e^{a2x+b2}$, and the envelope waveform data within the data interval. An internal point to maximize the ER during the entire range of the original envelope waveform, is extracted. This extracted point is used as a new optimum switching point.

The circuit arrangement of the seventh embodiment of FIG. 27 is substantially the same as that of FIG. 24. Like portions are designated by reference numerals which are those numerals of FIG. 24 plus 200. For example, 522*x* in FIG. 24 is 722*x* in FIG. 27.

Old exponential curve data extracting section 722*c* transfers the start and end points of the present data interval to exponential curve generating section 722*d*. Upon receipt of this, the generating section 722*d* computes a coefficient to determine the exponential curve, and computes the old exponential curve data using a predetermined exponential curve. 2 new exponential curve data extraction/internal point scanner 722*e* scans the internal points from the start point to the end point within the present data interval, and transfers the start point, end point, and the present interval point to exponential curve generating section 722*d*. Exponential curve generating section 722*d* forms new exponential curve 1 by using the start point and the internal point, and further forms new exponential curve 2 using the internal point and the end point. Upon receipt of this, 2 new exponential curves extraction/internal point scanner 722*e* generates 2 types of new exponential curve data. Difference element 722*f* computes absolute values of the error existing between the envelope data at the respective points in the data interval and two new curves data. Summing section 722*g* computes the total sum of these absolute values, or the difference area (ERA+ERB) between the two new curves at the present internal points and the original envelope waveforms. After the summing by summing section 722*g*, the scanner 722*e* shifts the internal point by 1, and extracts two new curves data again.

Difference element 722*h* works out an absolute value of the difference between each data of the in-interval envelope waveform and each data of the old exponential curve. Summing section 722*i* works out the total sum of these absolute values, or the difference area ERC between the old curve and the original envelope waveform.

Difference element 722*j* computes the difference between those difference areas ERC and (ERA+ERB) from those sections 722*i* and 722*g*.

The output signal from difference element 722*j* indicates a decreasing rate of the difference area. Maximum error detector 722*k* extracts its maximum value. When the detector 722*k* detects a new maximum value, it transfers a signal to maximum internal point holder 722*l*. Upon receipt of this, the holder 722*l* reads in and holds the present internal points derived from internal point scanner 722*e*.

When the present internal point reaches the end point of the present data interval, this is detected by interval end detector 722*m*. Then, data interval indicator 722*a* shifts the indicated data interval to the next interval.

When all of the data intervals have been scanned, the present internal point reaches the end point of the entire interval of the original envelope. This is detected by all intervals completion detector 722*n*.

At this time, maximum internal point holder 722*l* holds a switching point. This switching point is the internal point to minimize the error between the original envelope waveform and the curve within the entire interval of the original envelope, viz., a switching point which, when one switching point is added, minimizes the difference area to make the polygonal line closest in shape to the waveform of the original envelope.

Accordingly, the detector 722*n* informs the cycle controller of the scanning completion in this cycle, and reads out a new optimum switching point from MAX internal point holder 722*l*, and transfers it to the cycle controller.

At this point exponential curve switching point analyzer 722 completes the operation of one cycle, and waits for the instruction to start the next cycle from the cycle controller.

Figure 28A:
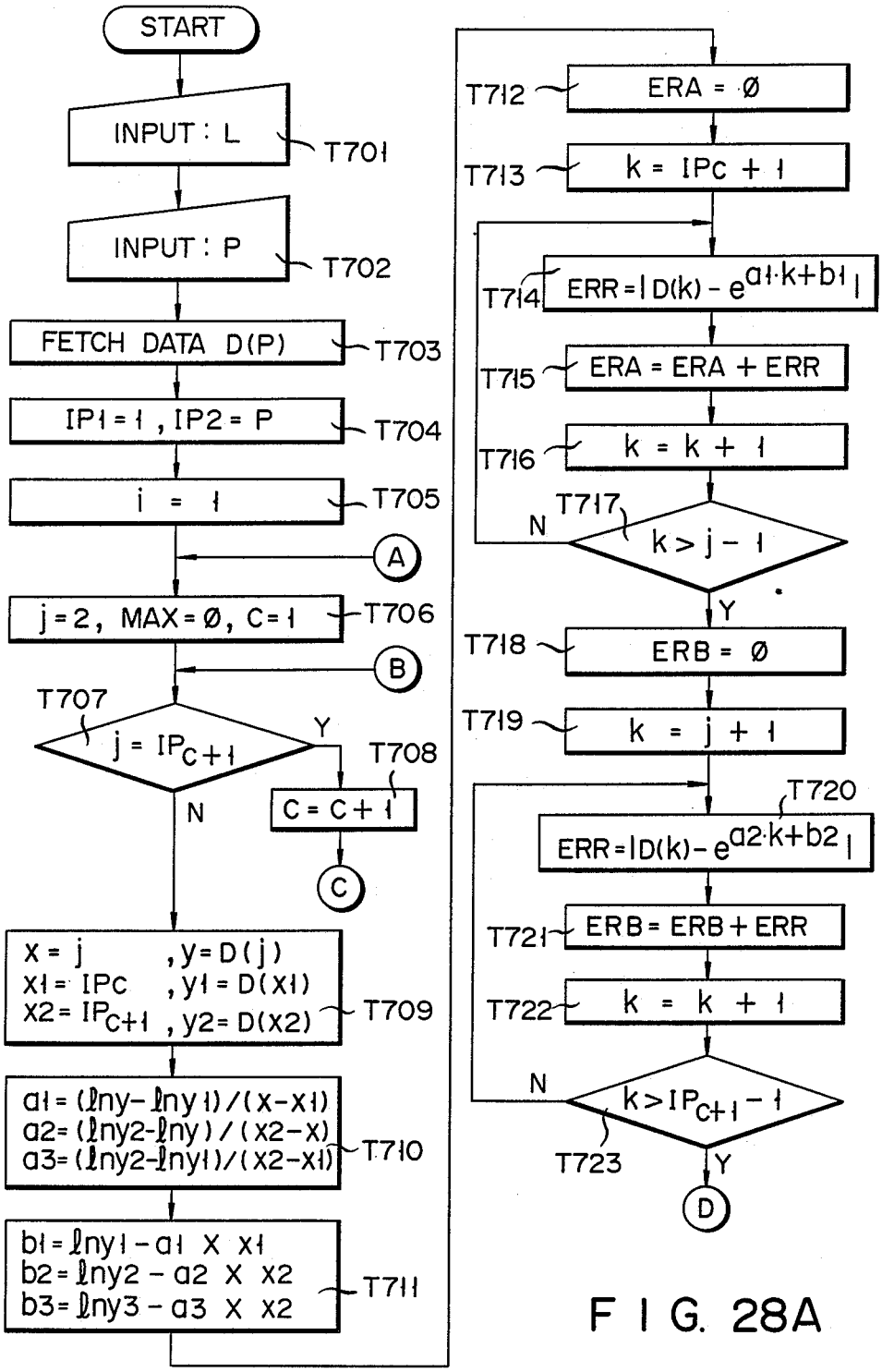
FIGS. 28A and 28B show a flowchart illustrating the operation of the envelope approximating apparatus according to the seventh embodiment.
Figure 28B:
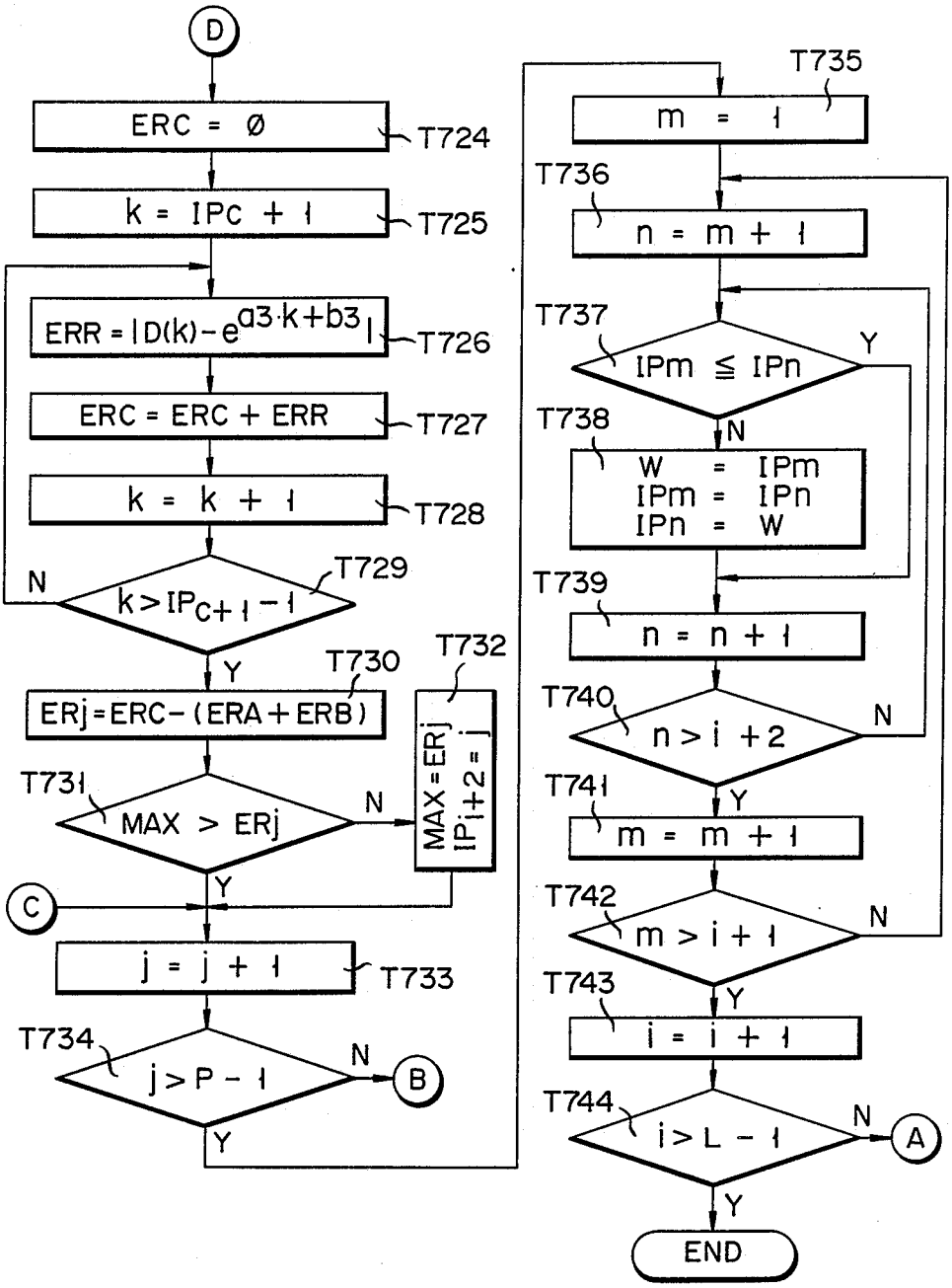

FIGS. 28A and 28B show a flowchart for explaining in detail the operation of the envelope approximating apparatus. This flowchart is substantially the same as that of each embodiment thus far mentioned, with some exception. The description of the operation will be given, laying an emphasis on the different portions. The difference between various types of parameters used in this flowchart, and those in the FIG. 10 flowchart will be described.

a1, b1; Coefficient of the curve $y=e^{a1x+b1}$ connecting points P and Q a2, b2; Coefficient of the curve $y=e^{a2x+b2}$ connecting points R and P a3, b3; Coefficient of the curve $y=e^{a3x+b3}$ connecting points R and Q ERA; Total sum of absolute values of differences between the curve QP between Q and P, and $y=D(x)$ ERB; Total sum of absolute values of differences between the curve PR between P and R, and $y=D(x)$ ERC; Total sum of absolute values of differences between the curve QR between Q and R, and $y=D(x)$ In FIG. 28, steps T701 to T705 are for initializing processing, and sets the number of curves, inputs the number of data of the original envelope used, and fetches the original envelope data.

The reason why $i=1$ in step T705 is that in this instance, one exponential curve connecting the start point and the end point of the waveform of the original envelope data, is used for the initial old exponential curve.

Step T706 is provided for starting the cycle to seek a new optimum switching point, and in this step, the x-coordinates of the internal point is laid at the second envelope data (j=2), the maximum value is set at "0", and "c" is set at "1" for initializing the data interval.

Step T707 for checking the updating of the data interval, checks if the present internal point reaches the end point of the data interval. If it is reached, step shifts the data interval from the present data interval to the next one.

Steps T709 to T711 determine the old exponential curve $y=e^{a3x+b3}$, and two new exponential curves $y=e^{a1x+b1}$ and $y=e^{a2x+b2}$, by using the start point coordinates (Xl, yl) and the end point coordinates (x2, y2) of the data interval, and the coordinates (x, y) of the internal point.

In steps T712 to T717, CPU computes the total sum of absolute values of differences between the new curve $y=e^{a1x+b1}$ and the envelope waveform y=D(x) in the range from the start point Q and the internal point P in the present data interval, and stores it as ERA.

In steps T718 to T723, CPU computes the total sum of absolute values of differences between the new curve $y=e^{a2x+b2}$ and the envelope waveform y=D(x), in the range from the start point P and the internal point R in the present data interval, and stores it as ERB.

In steps T724 to T729, CPU computes the total sum of absolute values of differences between the new curve $y=e^{a3x+b3}$ and the envelope waveform y=D(x) in the present data interval, and stores it as ERC.

In step T730, CPU computes a decreasing rate of the total sum of absolute values of errors (difference area) existing between the original envelope and the exponential curve, when the internal point P is selected as a switching point, and stores it as ERj.

This ERj is compared with the maximum value MAX of those values obtained so far (step T731). If the ERj is larger than the latter, its value is loaded as MAX. The x coordinates "j" of the internal point at that time is loaded into IPi+2 (T732).

The internal point is advanced by one with j=J+1. This processing is repeated until the internal point reaches the end point of the original envelope waveform (T733, T734).

Steps T735 to T742 are used for the sorting of setting of the x coordinates of the optimum switching point. In this instance, a new optimum switching point is once set in IPi+2 as shown in step T732. As seen from step T704, as control enters step T735, the x coordinates of the end point of the envelope waveform has been set in IPi+1. At this time IPi+1>IPi+2 has held. In this sorting processing, the sets of the x coordinates are arranged IPl<IP2<. . . IPi+2.

To start the next cycle, "i" is incremented and this is repeated until a polygonal line connecting exponential curves of L (T743, T744).

Through the above processing, the set IP=(IPl, IP2, points is obtained by using original envelope data D(1) to D(P), and the number L of the set exponential curves.

To actually generate the exponential curve approximated envelope data, it is only needed to use sets IP and D(IP) of the optimum setting points. Specifically, an exponential curve connecting sets (IP1, D(IP1)) and (IP2, D(IP2)) is first computed. When set IP2 is reached, an exponential curve connecting sets (IP2, D(IP2)) and (IP3, D(IP3)) is then computed. Subsequently, the exponential curves are switched at the switching points.

According to the seventh embodiment, when the envelope data extracted from the natural musical tone is applied, the exponential curve approximation can be automatically made merely by designating the number of exponential curves by an operator. In this respect, this method can obtain the envelope more effectively and quickly than the conventional try-and-error method.

While in the above-mentioned embodiment, switching points selection is automatically made, some part of it may be manually made, if necessary, on the basis of the original envelope waveform.

For the selection of switching point, the above-mentioned embodiment uses the point to minimize the difference area between the exponential curve and the original envelope waveform, as the optimum switching point. If necessary, it may be used in combination with another switching point. For example, the peak value of the attack in the original envelope waveform may be used as one of the optimum switching points. The peak value of the attack can be obtained by searching the maximum value in the original envelope data.

3. Effects

As seen from the foregoing description, the approximation of the envelope waveform described by the given original envelope data is made by using the limited number of exponential curves to minimize the difference area between the exponential curve and the original waveform. With this the original waveform can be well approximated while keeping the essential features of the original sound. When the approximated envelope signal is applied to the musical tone composer, it produces a musical tone near to the natural musical tone.

8th Embodiment

1. General

An eighth embodiment of an envelope approximating apparatus according to a sixth embodiment will be described referring to FIGS. 29 to 30.

In this embodiment, the original envelope is approximated by using the exponential function as in the seventh embodiment. A major difference of the eighth embodiment from the seventh embodiment resides in that the exponential curve data connecting switching points is generated. A switching point to substantially minimize the total number of the squares of errors between the exponential curve data and the envelope data, is used as an optimum switching point.

The optimizing principle to minimize the total sum of the error square enables the original envelope waveform to be expressed intensifying the attack portion of the original envelope data.

2. Description of Arrangement and Operation

Figure 29:
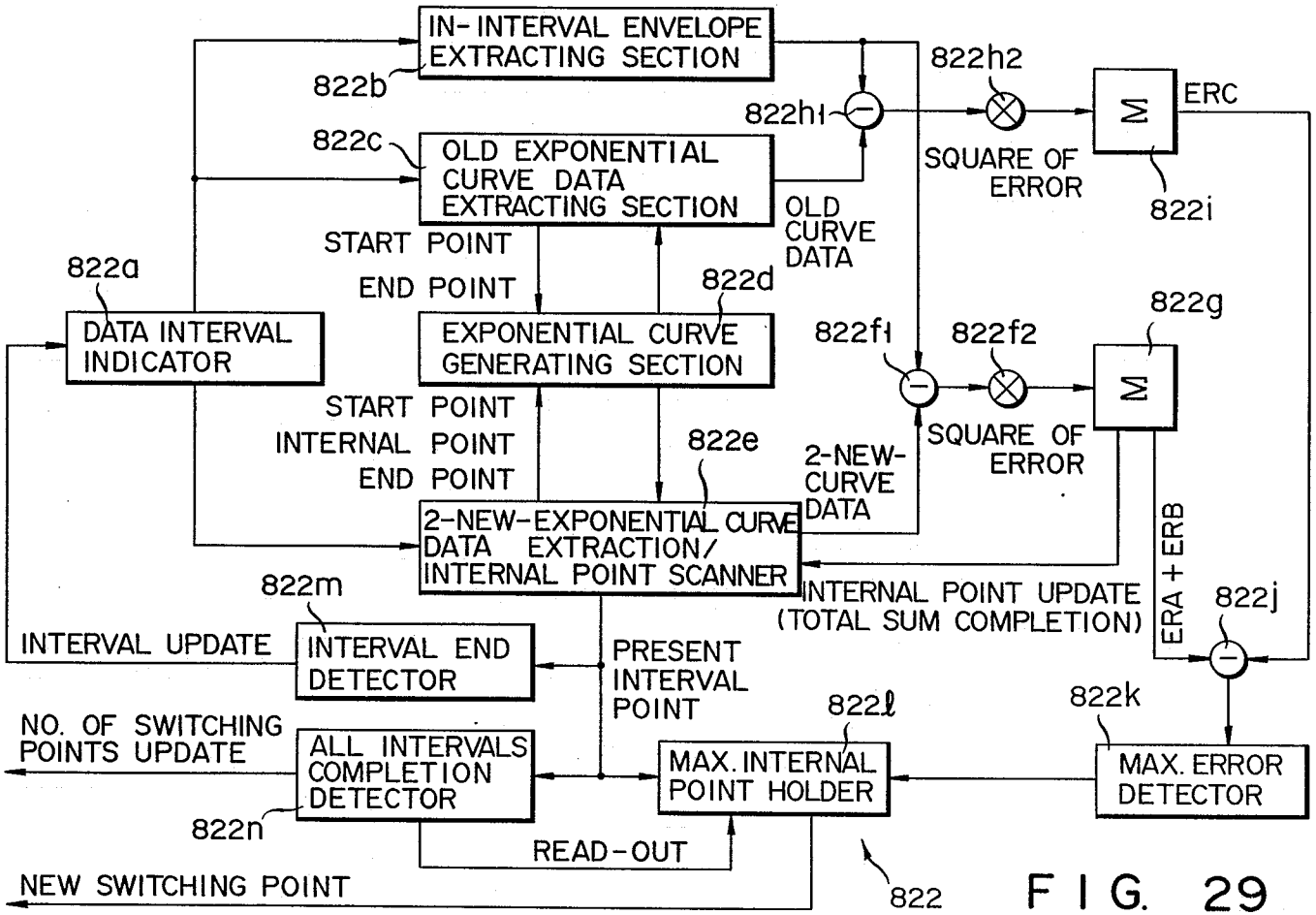
FIG. 29 shows a circuit arrangement of an exponential curve switching point analyzing section as a key portion of the envelope approximating apparatus according to an eighth embodiment of the present invention.

FIG. 29 shows an arrangement of exponential curve switching point analyzer 822, which is contained in the envelope approximating apparatus designed on the basis of the technical idea of this embodiment. The circuit arrangement of this embodiment of FIG. 29 is substantially the same as those of embodiments so far mentioned.

In this embodiment, the entire range of the original envelope data is used for the first data interval. The first optimum switching point is obtained by scanning the points within the original envelope from the start point to the end point. Subsequently, the optimum switching point as obtained is used as the end point of the data interval. ER is obtained by using an exponential curve $y=e^{a3x+b3}$ (old exponential curve) connecting the optimum switching points already obtained, and two new exponential curves $y=e^{a1x+b1}$ and $y=e^{a2x+b2}$, and the envelope waveform data within the data interval. An internal point to maximize the ER during the entire range of the original envelope waveform, is extracted. This extracted point is used as a new optimum switching point.

In FIG. 29, the cycle controller sets the information of the data intervals in accordance with cycles, in data interval indicator 822*a*. In-interval envelope extraction section 822*b* extracts the original envelope data in the present data interval indicated by data interval indicator 822*a*. Old exponential curve data extracting section 822*c* transfers the start and end points of the present data interval to exponential curve generating section 822*d*. Upon receipt of this, the generating section 822*d* computes a coefficient to determine the exponential curve, and computes the old exponential curve data using a predetermined exponential curve. 2 new exponential curve data extraction/internal point scanner 822*e* scans the internal points from the start point to the end point within the present data interval, and transfers the start point, end point, and the present interval point to exponential curve generating section 822*d*. Exponential curve generating section 822*d* forms new exponential curve 1 by using the start point and the internal point, and further forms new exponential curve 2 using the internal point and the end point. Upon receipt of this, 2 new exponential curves extraction/internal point scanner 822*e* generates 2 types of new exponential curve data. Difference element 822*f*1 computes absolute values of the error existing between the envelope data at the respective points in the data interval and two new curves data. Then, square element 822*f*2 squares these absolute values of errors, and summing section 822*g* computes the total sum of these absolute values of square errors (ERA+ERB). After the summing by summing section 822*g*, the scanner 822*e* shifts the internal point by 1, and extracts two new curves data again.

Difference element 822*hl* works out an absolute value of the difference between each data of the ininterval envelope waveform and each data of the old exponential curve. Then, square element 822*f*2 computes square values of these absolute values of the difference. Summing section 822*i* works out the total sum of these absolute values of square errors ERC.

Difference element 822*j* computes the difference between those old values ERC and new values (ERA+ERB) which are respectively derived from those sections 822*i* and 822*g*.

The output signal from difference element 822*j* indicates a decreasing rate of the total sum of square errors. Maximum error detector 822*k* extracts its maximum value. When the detector 822*k* detects a new maximum value, it transfers a signal to maximum internal point holder 822*l*. Upon receipt of this, the holder 822*l* reads in and holds the present internal points derived from internal point scanner 822*e*.

When the present internal point reaches the end point of the present data interval, this is detected by interval end detector 822*m*. Then, data interval indicator 822*a* shifts the indicated data interval to the next interval.

When all of the data intervals have been scanned, the present internal point reaches the end point of the entire interval of the original envelope. This is detected by all intervals completion detector 822*n*.

At this time, maximum internal point holder 822*l* holds a switching point. This switching point is the internal point to minimize the error between the original envelope waveform and the curve within the entire interval of the original envelope, viz., a switching point which, when one switching point is added, minimizes the total sum of square errors to make the polygonal line closest in shape to the waveform of the original envelope.

Accordingly, the detector 822*n* informs the cycle controller of the scanning completion in this cycle, and reads out a new optimum switching point from MAX internal point holder 822*l*, and transfers it to the cycle controller.

At this point exponential curve switching point analyzer 822 completes the operation of one cycle, and waits for the instruction to start the next cycle from the cycle controller.

Figure 30A:
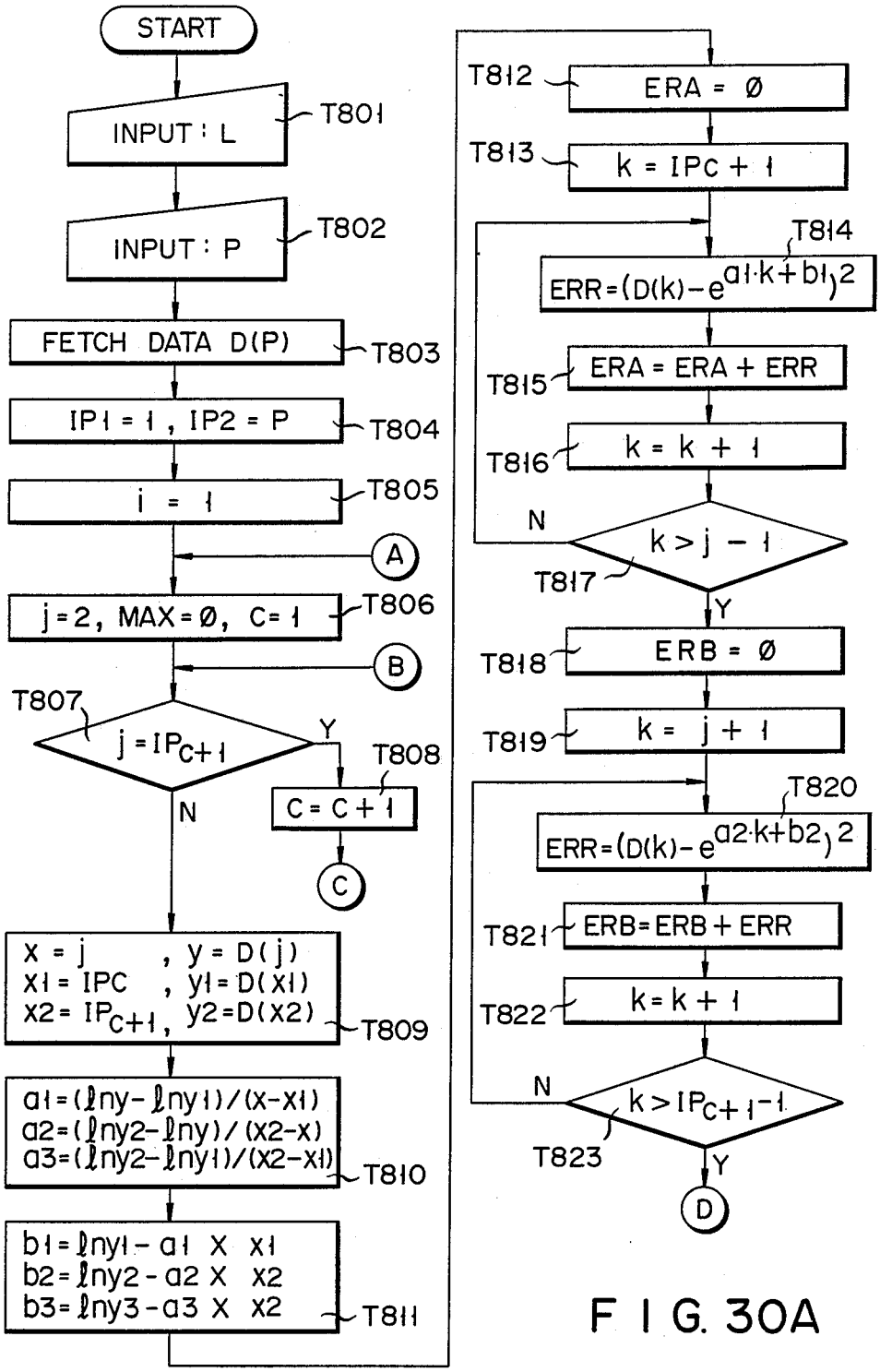
FIGS. 30A and 30B show a flow chart illustrating the operation of the envelope approximating apparatus according to the eighth embodiment.
Figure 30B:
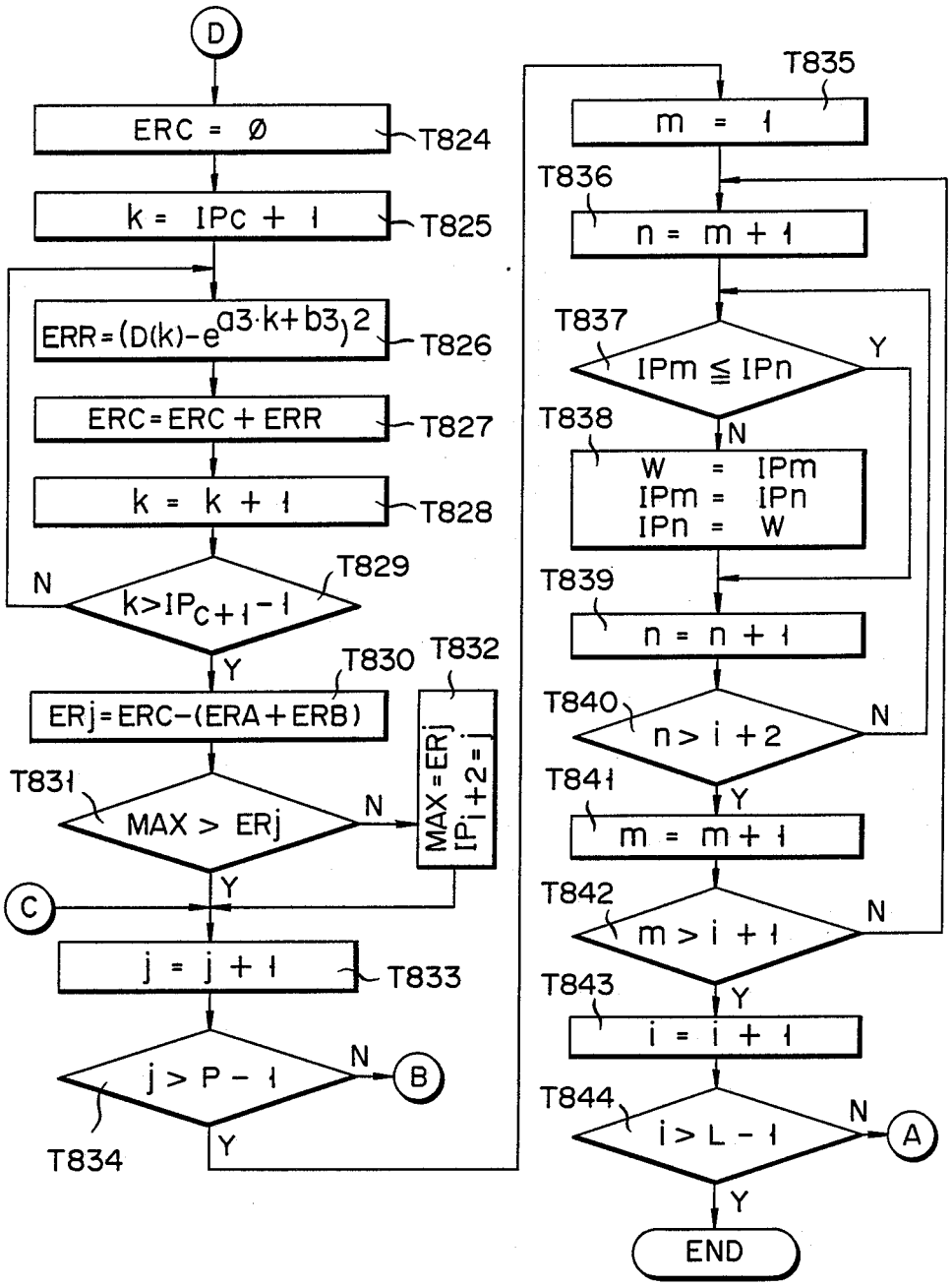

FIGS. 30A and 30B show a flow chart for explaining in detail the operation of the envelope approximating apparatus. The difference between various types of parameters used in this flowchart, and those in the FIG. 28 flowchart of the seventh embodiment will be described.

ERA; Total sum of square errors of between the curve QP between Q and P, and $y=D(x)$ ERB; Total sum of square errors of between the curve PR between P and R, and $y=D(x)$ ERC; Total sum of square errors of between the curve QR between Q and R, and $y=D(x)$ Since the step numbers in FIG. 30 are substantially the same as those of FIG. 28, they are designated by reference numerals which are those numerals of FIG. 10 plus 100.

Steps T801 to T805 are for initializing processing.

Step T806 is provided for starting the cycle to seek a new optimum switching point, and in this step, the x-coordinates of the internal point is laid at the second envelope data (j=2), the maximum value is set at "0", and "c" is set at "1" for initializing the data interval.

Step T807 for checking the updating of the data interval, checks if the present internal point reaches the end point of the data interval. If it is reached, step shifts the data interval from the present data interval to the next one.

Steps T809 to T811 determine the old exponential curve $y=e^{a3x+b3}$, and two new exponential curves $y=e^{a1x+b1}$ and $y=e^{a2x+b2}$, by using the start point coordinates (Xl, yl) and the end point coordinates (x2, y2) of the data interval, and the coordinates (x, y) of the internal point.

In steps T812 to T817, CPU computes the total sum of square of differences between the new curve $y=e^{a1x+b1}$ and the envelope waveform $y=D(x)$ in the range from the start point Q and the internal point P in the present data interval, and stores it as ERA.

In steps T818 to T823, CPU computes the total sum of square of differences between the new curve $y=e^{a2x+b2}$ and the envelope waveform $y=D(x)$, in the range from the start point P and the internal point R in the present data interval, and stores it as ERB.

In steps T824 to T829, CPU computes the total sum of square of differences between the new curve $y=e^{a3x+b3}$ and the envelope waveform $y=D(x)$ in the present data interval, and stores it as ERC.

In step T830, CPU computes a decreasing rate of the total sum of square errors existing between the original envelope and the exponential curve, when the internal point P is selected as a switching point, and stores it as ERj.

This ERj is compared with the maximum value MAX of those values obtained so far (step T831). If the ERj is larger than the latter, its value is loaded as MAX. The x coordinates "j" of the internal point at that time is loaded into IPi+2 (T832).

The internal point is advanced by one with j=J+1. This processing is repeated until the internal point reaches the end point of the original envelope waveform (T833, T834).

Steps T835 to T842 are used for the sorting of setting of the x coordinates of the optimum switching point. In this instance, a new optimum switching point is once set in IPi+2 as shown in step T832. As seen from step T804, as control enters step T835, the x coordinates of the end point of the envelope waveform has been set in IPi+1. At this time IPi+1>IPi+2 has held. In this sorting processing, the sets of the x coordinates are arranged IP1<IP2<. . . IPi+2.

To start the next cycle, "i" is incremented and this is repeated until a polygonal line connecting exponential curves of L (T843, T844).

Through the above processing, the set IP=(IP1, IP2, points is obtained by using original envelope data D(1) to D(P), and the number L of the set exponential curves.

To actually generate the exponential curve approximated envelope data, it is only needed to use sets IP and D(IP) of the optimum setting points. Specifically, an exponential curve connecting sets (IP1, D(IP1)) and (IP2, D(IP2)) is first computed. When set IP2 is reached, an exponential curve connecting sets (IP2, D(IP2)) and (IP3, D(IP3)) is then computed. Subsequently, the exponential curves are switched at the switching points.

According to the eighth embodiment, when the envelope data extracted from the natural musical tone is applied, the exponential curve approximation can be automatically made merely by designating the number of exponential curves by an operator. In this respect, this method can obtain the envelope more effectively and quickly than the conventional try-and-error method.

While in the above-mentioned embodiment, switching points selection is automatically made, some part of it may be manually made, if necessary, on the basis of the original envelope waveform.

For the selection of switching point, the above-mentioned embodiment uses the point to minimize the total sum of square errors existing between the exponential curve and the original envelope waveform, as the optimum switching point. If necessary, it may be used in combination with another switching point. For example, the peak value of the attack in the original envelope waveform may be used as one of the optimum switching points. The peak value of the attack can be obtained by searching the maximum value in the original envelope data.

3. Effects

As seen from the foregoing description, the approximation of the envelope waveform described by the given original envelope data is made by using the limited number of exponential curves to minimize the total sum of square errors existing between the exponential curve and the original waveform. With this the original waveform can be well approximated while keeping the essential features of the original sound. When the approximated envelope signal is applied to the musical tone composer, it produces a musical tone near to the natural musical tone.

9th Embodiment

1. General

A ninth embodiment of an envelope approximating apparatus according to the present invention will be described with reference to FIGS. 31 to 35.

This embodiment proposes another waveform approximating approach. The embodiment is based on a technical idea that a maximum error value (the longest distance) between linear data connecting two points and the original envelope data is computed, and an optimum switching point is obtained on the basis of the result of computation.

In the embodiment, an optimum switching point is the point at the coordinates at which the waveform of the difference between the original envelope waveform and a line connecting two points, exhibits. Therefore, the difference or error between the polygonal line connecting such optimum switching points and the original envelope waveform is very small.

The peak coordinates of this type contains essential musical features of the original envelope waveform. A set of data compressed optimum switching points contains the features of original sounds.

A linear envelope data with the interval of the optimum switching points can be generated by using the set of data compressed optimum switching points. The envelope approximating apparatus of this embodiment is easily applicable for the conventional electronic musical instruments of the type in which the linear data is generated for each interval to generate the envelope data.

2. Description of Arrangement and Operation

Figure 31:
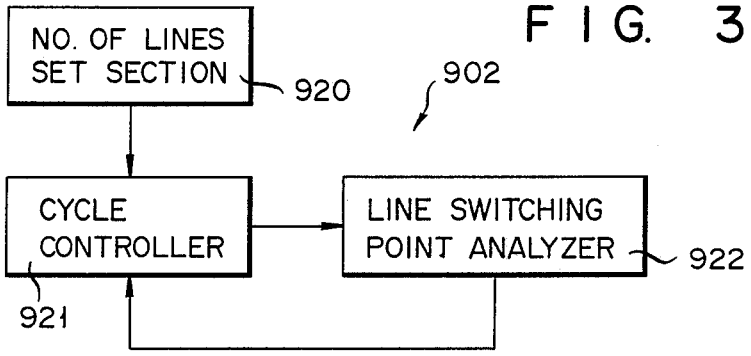
FIG. 31 shows a circuit arrangement of an envelope approximating apparatus according to a ninth embodiment of the present invention.

An envelope approximating apparatus 902 according to this embodiment is configured as shown in FIG. 31. The hardware configuration of this apparatus contains CPU, envelope approximating memory, working memory, and input/output device.

Number-of-line set section 920 sets the number of the apparatus. Line switching point analyzer 922 sequentially analyzes new optimum switching point under control of the cycle controller 921, to obtain the optimum switching point that corresponds to the set number of lines. At this point, the operation is completed.

Figure 32:
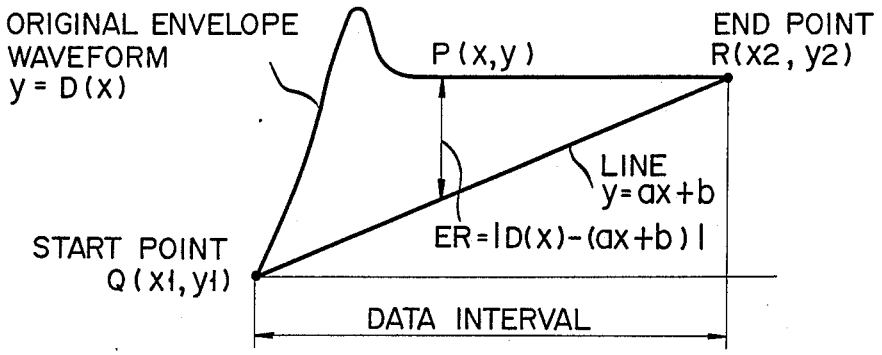
FIG. 32 shows a graph useful in explaining the principle to select the optimum switching point according to the ninth embodiment.

FIG. 32 shows the principle of analyzing the optimum switching point, which is employed in this embodiment. In the graph, $y=D(x)$ represents the waveform of the original envelope data. Q(x1, y1) and R(x2, y2) indicate respectively the start point and the end point of the original envelope waveform within the data interval.

To find the optimum switching points within the data interval, each point in the original envelope waveform are checked. P(x, y) indicates a specific coordinates point on the original envelope waveform. A line connecting the start point Q and the end point R is given by $y=ax+b$. A distance (absolute error) between the original envelope waveform and the line as viewed on the x-axis is given by $$ER = |D(x) - (ax+b)|.$$

When scanning is made from the start point xl to the end point x2, the distance ER changes with scanning positions, and reaches a peak. The coordinates point to maximize the ER is used as the optimum switching point.

Figure 33:
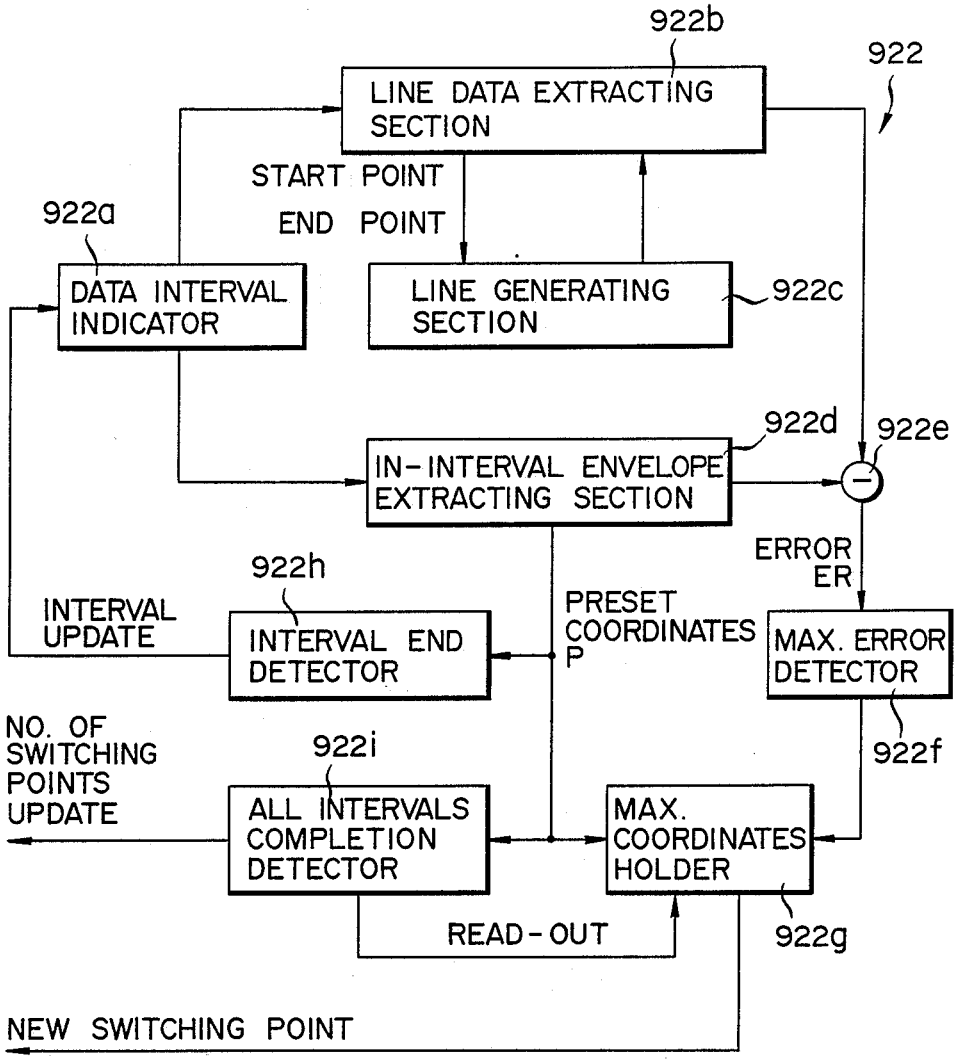
FIG. 33 shows a circuit arrangement of a line switching analyzing section in the envelope approximating apparatus of the ninth embodiment.

FIG. 33 shows an arrangement of line switching point analyzer 922 designed on the basis of the principle of FIG. 32. In this instance, the entire range of the original envelope data is used for the first data interval. Scanning is made from the top to end of the original envelope waveform in the direction of x-axis, to obtain the first switching point. Subsequently, the optimum switching point already obtained is used as the end point of the data interval. A point to maximize the distance between a line connecting the already obtained optimum switching points and the original envelope waveform is defined from those in the entire range of the original envelope waveform. This point is used as a new optimum switching point.

In FIG. 33, the data of the data interval is applied from cycle controller 921 and set in data interval indicator **922*a* according to optimum switching point search cycle. Line data extracting section 922*b* supplies the start point Q and the end point R of the present data interval as indicated by data interval indicator 922*a* to line generator 922*c*. Upon receipt of these points, line generator 922*c* computes coefficients "a" and "b" to define the line y=ax+b, and generates line data based on a predetermined line. In-interval envelope extracting section 922*d*** extracts the original envelope data within the present data interval.

Difference element **922*e*** computes the difference ER between the value D(x) of the original envelope data and the value (ax+b) of the line data in the x-distance.

Maximum error detector **922*f* monitors the error ER derived from difference element 922*e*, and extracts its maximum value. When the maximum error is detected, maximum error detector 922*f* applies an up-dating signal to MAX coordinates holder 922*g*. Then, coordinates holder 922*g* reads in the present scanning coordinates as indicated by in-interval envelope extracting section 922*d***, and holds it.

Interval end point detector **922*h* detects that the present scanning coordinates reaches the end point of the data interval, and causes data interval indicator 922*a*** to shift the data interval to the next interval.

All interval completion detector **922*i*** detects that the present scanning coordinates to reach the end of the original envelope waveform.

At this time, MAX coordinates holder **922*g*** holds the coordinates to maximize the distance between the line and the original envelope waveform in the entire range of the original envelope waveform, viz., a new optimum switching point as the coordinates of the peak of the function representing the original envelope waveform.

All intervals completion detector sends a signal representing the completion of analyzing the this-time optimum switching point to cycle controller 21. The same reads out a new optimum switching point from MAX coordinates holder **922*g*, and transfers it to cycle controller 921**.

Figure 34A:
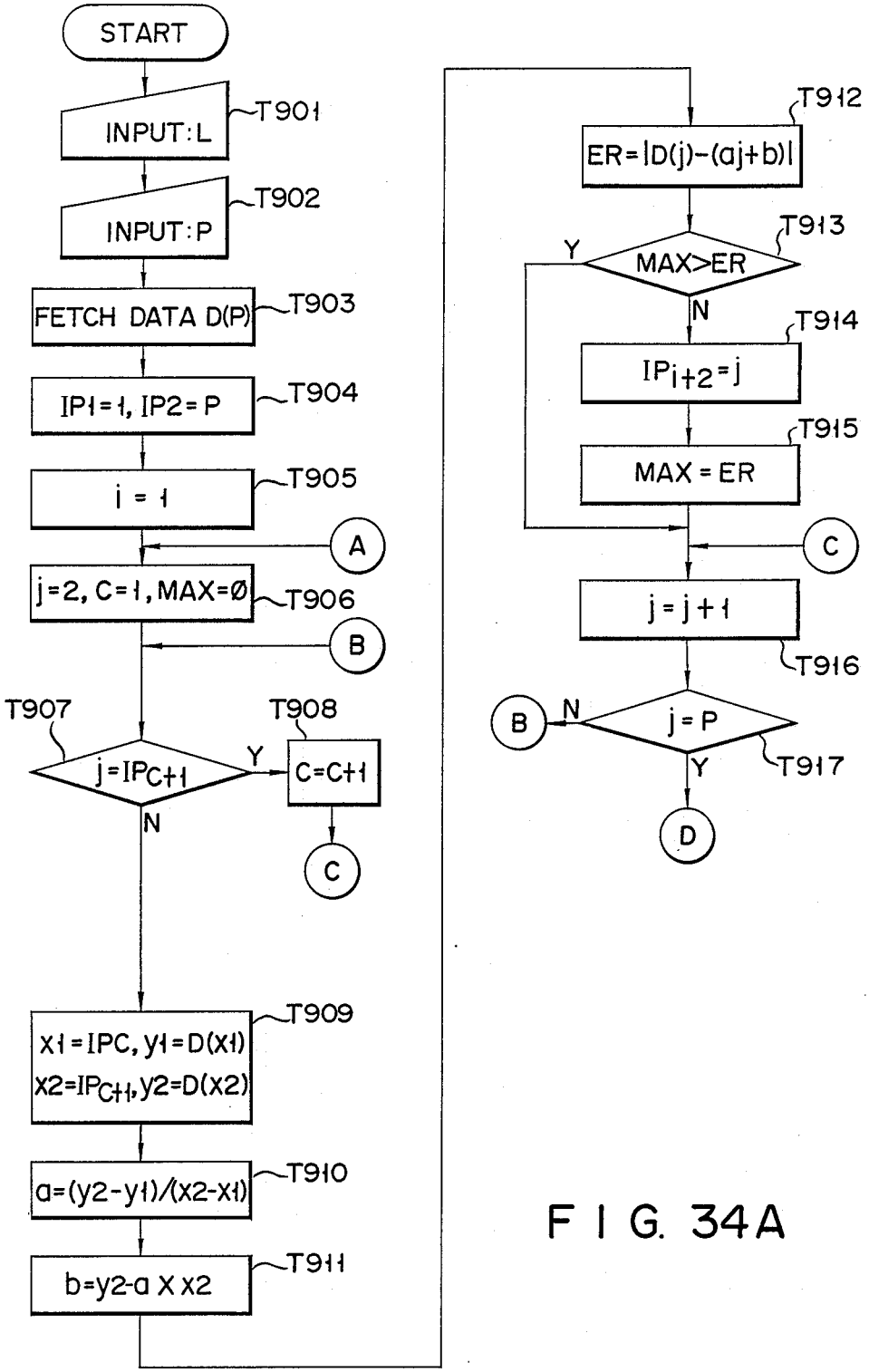
FIGS. 34A and 34B show a flow chart illustrating the operation of the envelope approximating apparatus according to the ninth embodiment.
Figure 34B:
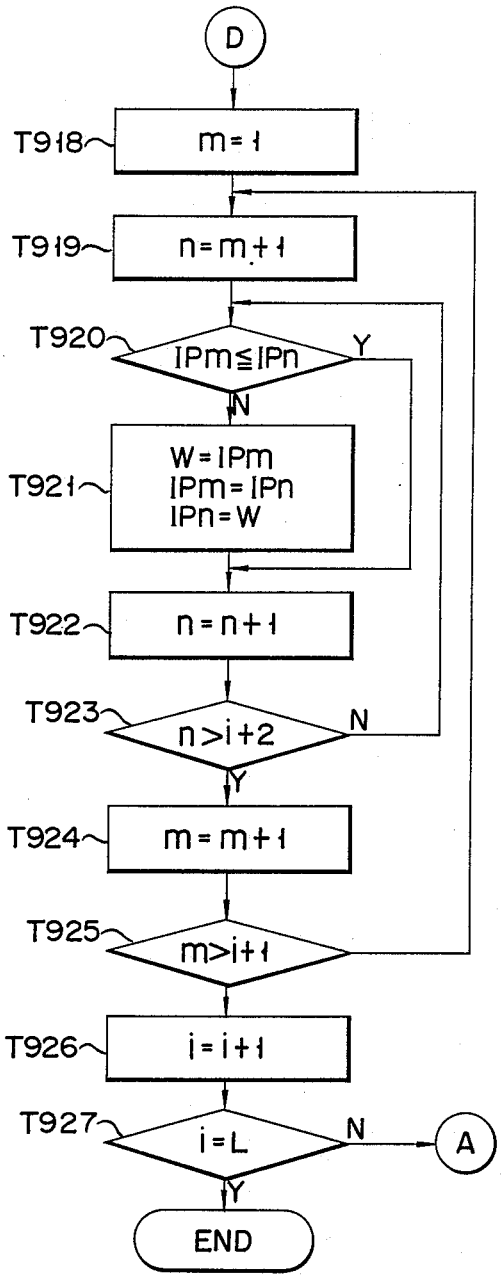

FIG. 34 shows a flowchart describing in detail the operation of envelope approximating circuit 902.

The meanings of various types of parameters used in this flowchart will be described below. The same parameters as those as already mentioned will not be referred to, for simplicity.

c: Parameter indicating that "j" is between IPc and IPc+1.

(x1, y1): Start point Qpf each data interval (IPc, D(IPc))

(x2, y2): Start point Rpf each data interval (IPc+1, D(IPc+1))

a, b: Coefficients of line y=ax+b

ER: Absolute value of the difference between y=ax+b and y=D(x) at the "j" point

Steps T901 to T905 are provided for initializing, and sets the number of lines, enters the number of data of e original envelope used, and reads in the original envelope data. In step T904, IP1=1 and IP2=P. The setting in this step is used for the reason that in this instance, the start and end points the original envelope waveform are the optimum switching points, and the distance between the start point and the end point is the first data interval. As indicated by i=1 in step T905, the first line is a single line. In this instance, the first line is the line connecting the start point of the original envelope to the end point.

Step T906 is used for starting the cycle to obtain a new optimum switching point, and initializes the parameters of the scanning x-coordinates, the data interval, and the maximum error.

Step T907 is used for checking the updating of the data interval, and when the present scanning x-coordinates reaches the end point of the data interval, shifts the data interval to the next data interval through step T908.

In steps T909 to T911, line y=ax+b is determined by using the start point Q, the end point R, and present scanning coordinates P of the data interval.

In step T912, control computes the original envelope data and the line data in the present scanning x-coordinates.

Steps T913 to T915 are processings for extracting the maximum error of the data. In these steps, when the error of the present scanning coordinates exceeds the maximum value MAX thus far existed, the value is set into the MAX.

In step T916, the present scanning x-coordinates "j" is incremented, and the processing succeeding to that of step T907 is repeated till the "j" reaches the final point of the original envelope waveform.

Steps T918 to T925 execute the sorting of a set of x-coordinates of optimum switching points. When control enters the sorting processing, the x-coordinates of the optimum switching point as found in the present cycle is placed in IPi+2. This value is naturally smaller than the x-coordinates value P at the end point of the original envelope waveform. It is for this reason that the optimum switching points are rearranged into IP-1<IP2<. . . <IPi+2 in the sorting processing.

In step T926, the number of processed lines "i" is incremented. In step T906, the search cycle of the next optimum switching point is started gain. This is repeated until the "i" reaches the set number of lines.

In this way, the set PT of x-coordinates of a necessary number of optimum switching points is obtained and given below $$IP = (IP1, IP2, \ldots, IPL+1).$$

Actually, to generate the line approximating envelope data, computation is made using optimum point switching points IP and D(IP). Specifically, the data of line connecting sets (IP1, D(IP1)) and (IP2, D(IP2)) is first computed. When set IP2 is reached, line connecting (IP2, DIP2)) and (IP3, D(IP3)) is then used. This sequence is subsequently repeated.

According to the processing of FIG. 34, to find one optimum switching point, necessary operations are only to scan the x-coordinates corresponding to the number of data of the original envelope and to extract the maximum error relating to it. Therefore, the number of required operations is small.

As seen from the foregoing, when the envelope data extracted from a natural musical tone is applied, the optimum approximation by lines may be automatically performed by designating only the number of lines by an operator. Therefore, the envelope approximation according to this embodiment is remarkably improved over the conventional try-and-error method.

In the above-mentioned embodiment, the single principle is used for selecting optimum points. If necessary, it may be used in combination with other suitable principles.

3. Effects

As seen from the foregoing description, an original envelope waveform is approximated by a limited number of lines, which are generated by using the maximum distance between the original waveform and the envelope waveform as represented by the applied original envelope data. The approximated waveform contains most of the essential features of the original sound. When the envelope approximating apparatus is coupled with musical tone composing apparatuses, the musical tone generated is almost the same as the original, or natural musical tone.

10th Embodiment

1. General

A tenth embodiment of an envelope approximating apparatus according to the present invention will be described referring to FIGS. 35 to 37B.

The tenth embodiment is different from the ninth embodiment in that the approximation function is an exponential function.

In this embodiment, the waveform of the envelope data of an applied musical tone is approximating by a limited number of exponential curves whose characteristics is switched at a switching point. The maximum error between the data of an exponential curve connecting two points and the original envelope data, i.e., the maximum distance between those waveforms, is computed. An optimum switching point is computed on the basis of the result of computation.

The coordinates at which the waveform between the original envelope waveform and the exponential curve exhibits the peak, is an optimum switching point. Therefore, the error between the polygonal line connecting such optimum switching points and the original envelope waveform is remarkably small.

The peak coordinates of this type contains the essential musical tone features of the original envelope waveform. A set of data compressed optimum switching points contains the features of original sounds.

An exponential curve envelope data with the intervals between the optimum switching points can be generated by using the set of data compressed optimum switching points. The envelope approximating apparatus of this embodiment is easily applicable to the conventional electronic musical instruments of the type in which the linear data is generated for each interval to generate the envelope data.

2. Description of Arrangement and Operation

Figure 35:
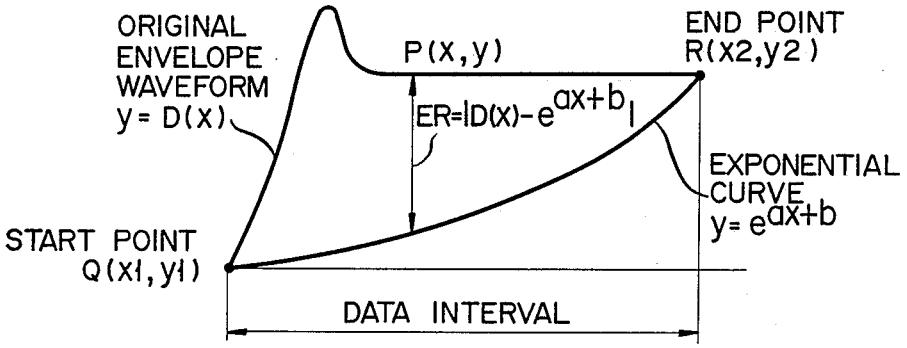
FIG. 35 shows a graph useful in explaining the principle to select the optimum switching point in envelope approximation according to a tenth embodiment of the present invention.

FIG. 35 shows the principle of analyzing the optimum switching point, which is employed in this embodiment. In the graph, $y=D(x)$ represents the waveform of the original envelope data. Q(x1, y1) and R(x2, y2) indicate respectively the start point and the end point of the original envelope waveform within the data interval.

To find the optimum switching points within the data interval, each point in the original envelope waveform are checked. P(x, y) indicates a specific coordinates point on the original envelope waveform. A exponential curve connecting the start point Q and the end point R is given by $y=e^{ax+b}$. A distance (absolute error) between the original envelope waveform and the exponential curve as viewed on the x coordinates is given by $$ER=|D(x)-e^{ax+b}|$$

When scanning is made from the start point x1 to the end point x2, the distance ER changes with scanning positions, and reaches a peak at a certain scanning position. The coordinates point to maximize ER is used as the optimum switching point.

Figure 36:
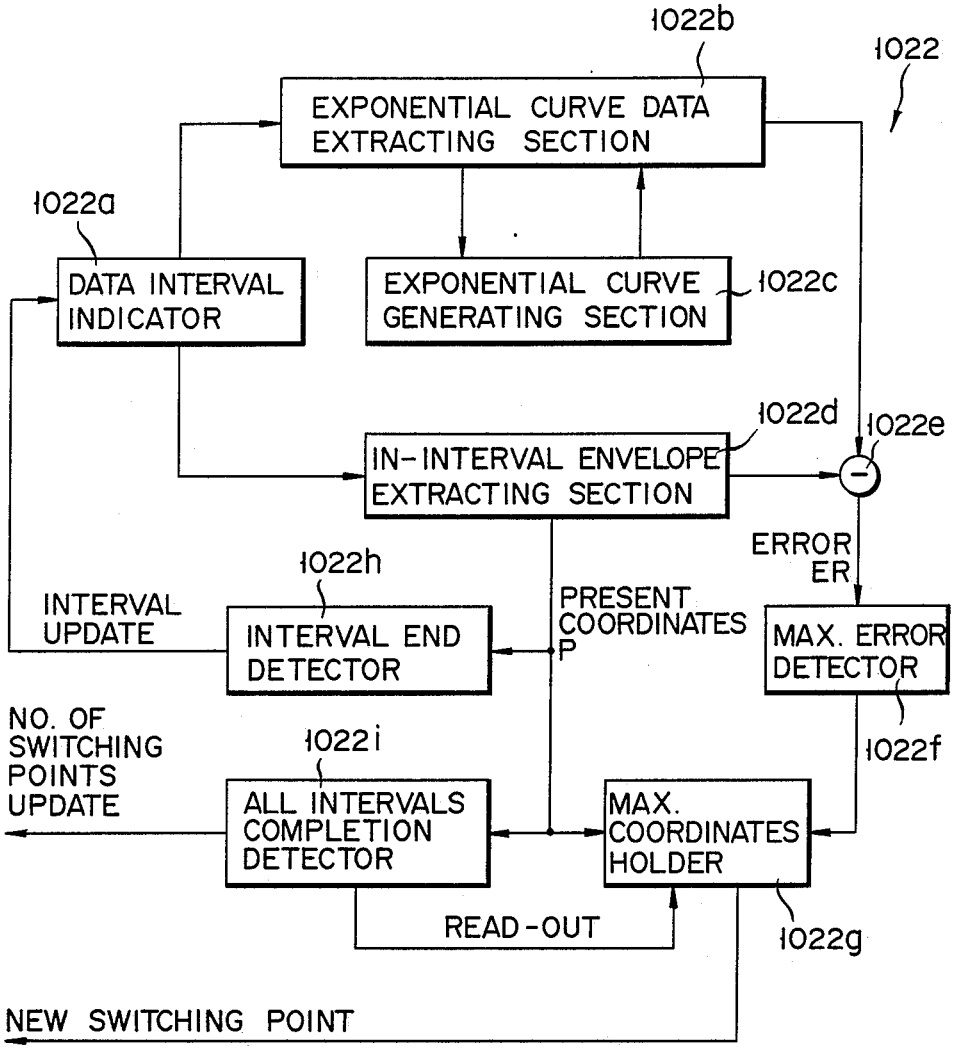
FIG. 36 shows a circuit arrangement of a key portion of an envelope approximating apparatus according to the tenth embodiment.

FIG. 36 shows an arrangement of exponential curve switching point analyzer 1022 designed on the basis of the principle of FIG. 35. In this instance, the entire range of the original envelope data is used for the first data interval. Scanning is made from the top to end of the original envelope waveform in the direction of the x coordinates, to obtain the first optimum switching point. Subsequently, the optimum switching point already obtained is used as the end point of the data interval. A point to maximize the distance between a exponential curve connecting the already obtained optimum switching points and the original envelope waveform is found from those in the entire range of the original envelope waveform. This point is used as a new optimum switching point.

In FIG. 36, the data of the data interval is applied from the cycle controller and set in data interval indicator **1022*a* according to the optimum switching point search cycle. Exponential curve data extracting section 1022*b* transfers the start point Q and the end point R of the present data interval as indicated by data interval indicator 1022*a* to expontential curve generator 1022*c*. Upon receipt of these points, exponent curve generator 1022*c* computes coefficients "a" and "b" to define the exponential curve $y=e^{ax+b}$, and generates curve data based on a predetermined exponential curve. In-interval envelope extracting section 1022*d*** extracts the original envelope data within the present data interval.

Difference element **1022*e*** computes the difference ER between the value D(x) of the original envelope data and the value eax+b of the exponential curve data in the x coordinates.

Maximum error detector **1022*f* monitors the error ER derived from difference element 1022*e*, and extracts its maximum value. When the maximum error is detected, maximum error detector 1022*f* applies an updating signal to MAX coordinates holder 1022*g*. Then, coordinates holder 1022*g* reads in the present scanning coordinates as indicated by in-interval envelope extracting section 1022*d***, and holds it.

Interval end point detector **1022*h* detects that the present scanning coordinates reaches the end point of the data interval, and causes data interval indicator 1022a** to shift the data interval to the next interval.

All interval completion detector 1022i detects that the present scanning coordinates reaches the end of the original envelope waveform.

At this time, MAX coordinates holder 1022g holds the coordinates to maximize the distance between the exponential curve and the original envelope waveform in the entire range of the original envelope waveform, viz., a new optimum switching point as the coordinates of the peak of the function subtracted from the original envelope waveform.

All intervals completion detector 1022i sends a signal representing the completion of analyzing the this-time optimum switching point to the cycle controller. At the same time, this detector reads out a new optimum switching point from MAX coordinates holder 1022g, and transfers it to the cycle controller.

Figure 37A:
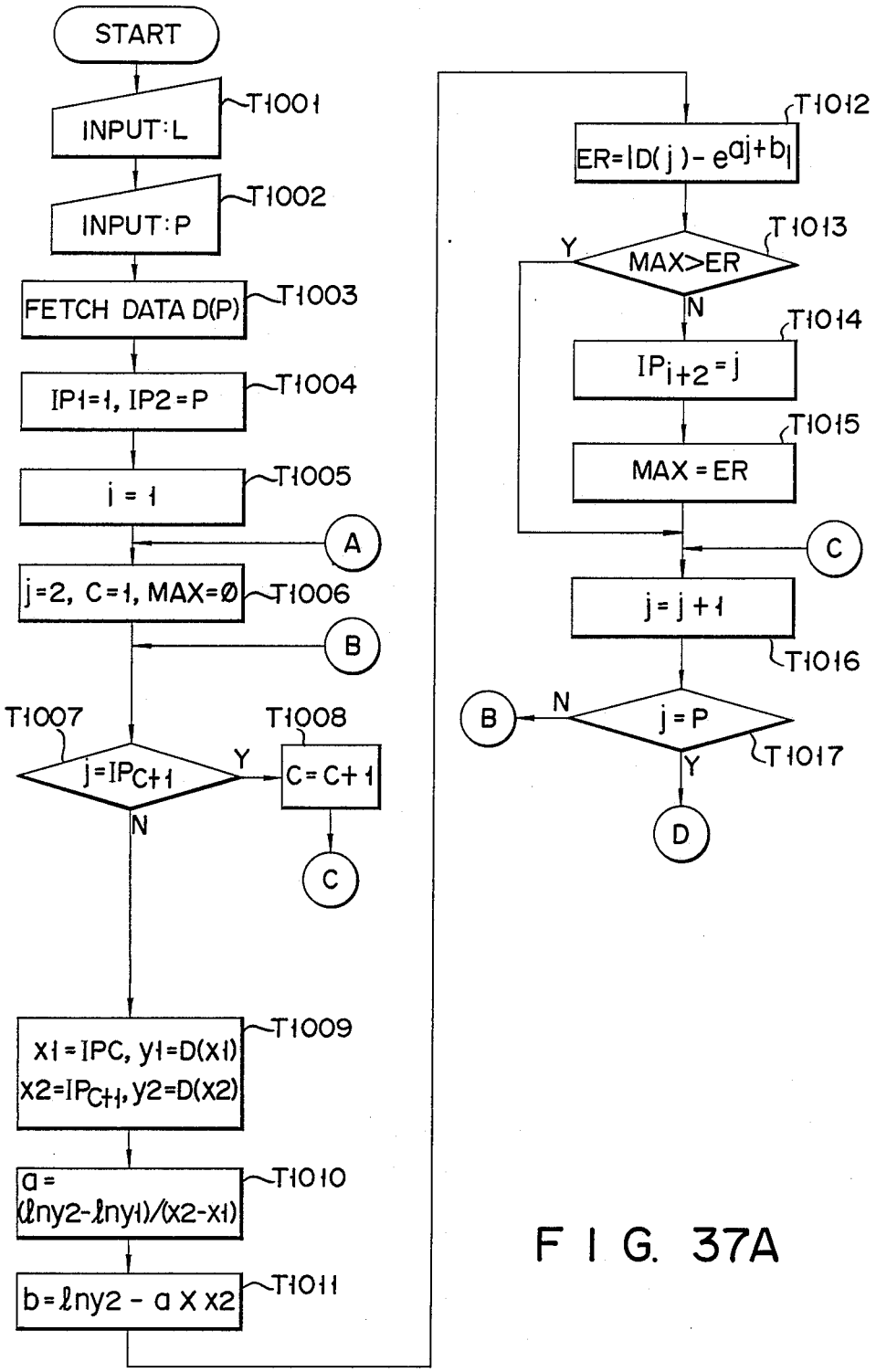
FIGS. 37A and 37B show a flow chart for explaining the operation of the envelope approximating apparatus according to the tenth embodiment.
Figure 37B:
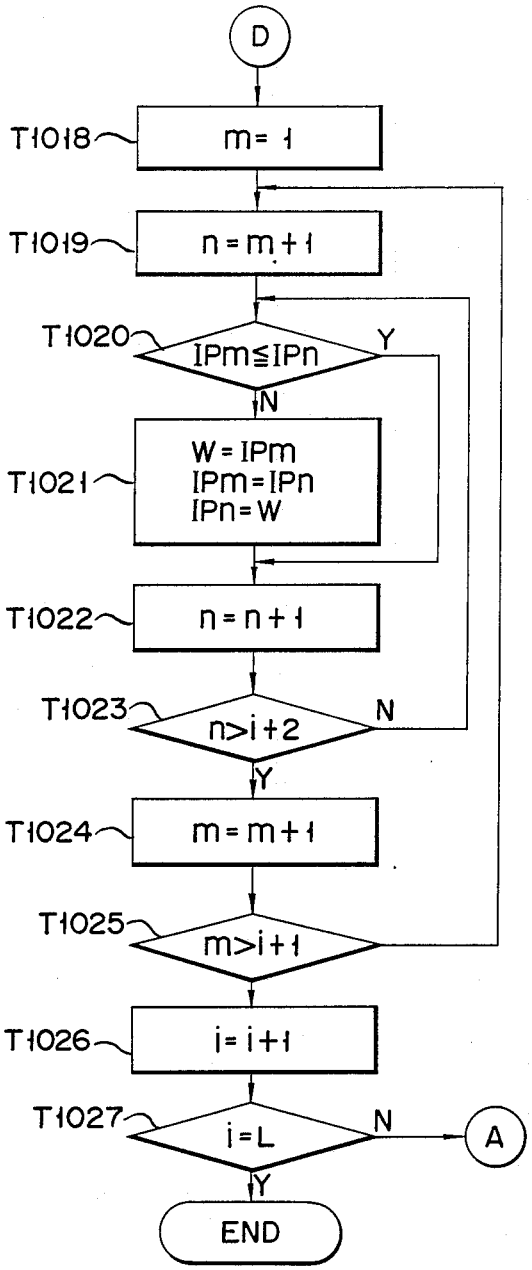

FIGS. 37A and 37B show a flow chart describing in detail the operation of envelope approximating circuit 1002.

The meanings of various types of parameters used in this flowchart will be described below. These parameters are substantially the same as those of the ninth embodiment except the following parameters.

a, b: Coefficients of exponential curve $y=e^{ax+b}$

ER: Absolute value of the difference between $y=e^{ax+b}$ and $y=D(x)$ at the "j" point Steps T1001 to T1005 are provided for initializing, and sets the number of exponential curve enters the number of data of the original envelope used, and reads in the original envelope data. In step T1004, IP1=1 and IP2=P. The setting in this step is used for the reason that in this instance, the start and end points of the original envelope waveform are the optimum switching points, and the distance between the start point and the end point is the first data interval. As indicated by i=1 in step T1005, the first exponential curve is a single curve. In this instance, the first exponential curve is the exponential curve connecting the start point of the original envelope to the end point.

Step T1006 is used for starting the cycle to obtain a new optimum switching point, and initializes the parameters of the scanning x-coordinates, the data interval, and the maximum error.

Step T1007 is used for checking the updating of the data interval, and when the present scanning x-coordinates reaches the end point of the data interval, shifts the data interval to the next data interval through step T1008.

In steps T1009 to T1011, exponential curve $y=e^{ax+b}$ determined by using the start point Q, the end point R, and present scanning coordinates P of the data interval.

In step T1012, control computes the error existing between the original envelope data and the exponential curve data in the present scanning x-coordinates.

Steps T1013 to T1015 are processings for extracting the maximum error of the data. In these steps, when the error of the present scanning coordinates exceeds the maximum value MAX thus far existed, the value is set into the MAX.

In step T1016, the present scanning x-coordinates "j" is incremented, and the processing succeeding to that of step T107 is repeated till the "j" reaches the end point of the original envelope waveform.

Steps T1018 to T1025 execute the sorting of a set of x-coordinates of optimum switching points. When control enters the sorting processing, the x-coordinates of the optimum switching point as found in the present Cycle is placed in IPi+2 as shown in step T1014. This value is naturally smaller than the x-coordinates value P at the end point, which is placed in IPi+1, of the original envelope waveform. It is for this reason that the optimum switching points are rearranged into IP-1<IP2<. . . <IPi+2 in the sorting processing.

In step T1026, the number of processed exponential curves "i" is incremented. In step T1006, the search cycle of the next optimum switching point is started again. This is repeated until the "i" reaches the set number of lines.

In this way, the set IP of x-coordinates of a necessary number of optimum switching points is obtained and given below $$IP=(IP1, IP2, \ldots, IPL+1).$$

Actually, to generate the exponential curve approximating envelope data, computation is made using optimum point switching points IP and D(IP). Specifically, the data of exponential curve connecting set (IP1, D(IP1)) and (IP2, D(IP2)) is first computed. When set IP2 is reached, the curve connecting (IP2, DIP2)) and (IP3, D(IP3)) is then used. This sequence is subsequently repeated.

According to the processing of FIGS. 37A and 37B, to find one optimum switching point, the necessary operations are only to scan the x-coordinates corresponding to the number of data of the original envelope and to extract the maximum error relating to it. Therefore, the number of required operations is small.

As seen from the foregoing, when the envelope data extracted from a natural musical tone is applied, the optimum approximation by exponential curves may be automatically performed by designating only the number of exponential curves by an operator. Therefore, this method can provide the envelope more effectively and quickly than the conventional try-and-error method.

In the above-mentioned embodiment, the single principle is used for selecting optimum points. If necessary, it may be used in combination with the other suitable principles.

3. Effects

As seen from the foregoing description, in this embodiment, an original envelope waveform is approximated by a limited number of exponential curves, which are generated by using the maximum distance between the original waveform and the envelope waveform as represented by the applied original envelope data. The approximated waveform contains most of the essential features of the original sound. When the envelope approximating apparatus is coupled with musical tone composing apparatuses, the musical tone generated is almost the same as the original, or natural musical tone.

11 th Embodiment

1. General

An eleventh embodiment of an envelope approximating apparatus according to the present invention will be described referring to FIGS. 38 to 39B.

The 11 th embodiment provides an easy envelope approximation through the interaction of an operator with the machine.

Particularly, in the data compression, the data is appropriately weighted with the time axis for envelope approximation. In the trumpet sound with special features in the rise part, the approximation is exactly made placing an emphasis on the rise part. In the violin sound with special feature in the continued part, the approximation is performed laying an emphasis on the continued part.

More specifically, an envelope waveform expressed by the envelope data of an applied musical tone is approximated by a limited number of function waveforms whose characteristics are switched at switching points. To obtain the optimum switching point, envelope data is visually presented to the operator or user. While seeing this, the user manually specifies points at which the envelope is divided into a plurality of intervals. A function to optimize the envelope during each interval is determined to obtain an approximated envelope for each interval. A cross point of the approximated envelopes during the adjacent intervals, viz., a cross point of the functions during the adjacent intervals, is used as an optimum switching point.

An envelope waveform expressed by a large amount of the original envelope data is optimumly approximated by a limited number of function waveforms whose characteristics are switched at the optimum switching points. Therefore, the data can be compressed without losing the features of the original sound of the original envelope data. It is easy to generate specific envelope data from the compressed data expressed by the sets of optimum switching points. This can be made by computing the data of the function curve connecting the optimum switching points.

In this embodiment, the envelope waveform is divided or segmented into a plurality of intervals at dividing or segmenting points as specified by an operator, with respect to the time axis. The cross point of the approximated function waveforms during the adjacent intervals is used as an optimum switching point. Thus, the approximation of the envelope waveform is appropriately weighted with respect to time axis by appropriately designating segmenting points.

2. Description of Arrangement and Operation

The 11th embodiment of the present invention will be described referring to the accompanying drawings.

Figure 38:
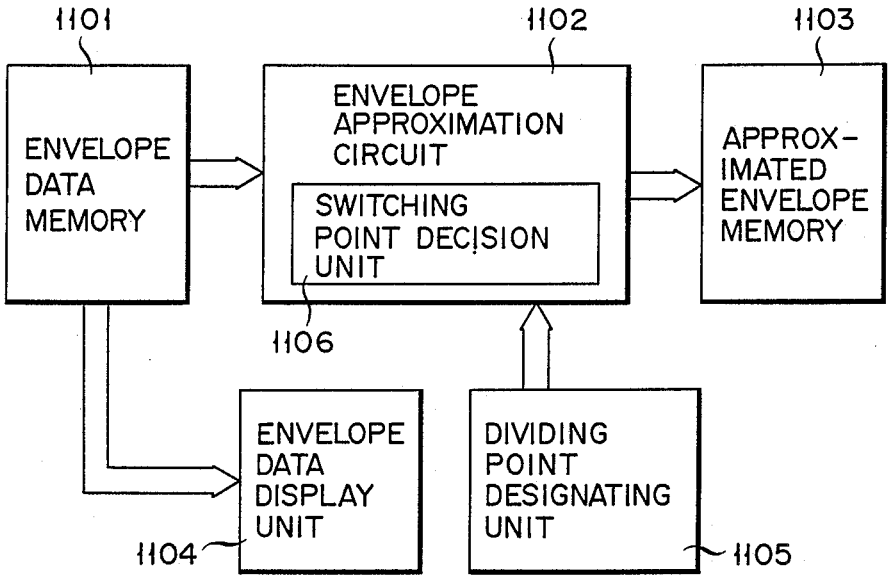
FIG. 38 shows a circuit arrangement of an envelope approximating apparatus according to an eleventh embodiment of the present invention.

FIG. 38 shows an arrangement of an envelope approximating apparatus according to the present invention. In the figure, envelope data memory 1101 stores the envelope data extracted from the sound of a natural musical instrument. Envelope approximating circuit 1102 approximates the waveform of the original envelope data by a limited number of function waveforms, to form approximated envelope data as congregation of optimum switching points. The data compressed approximated envelope data is stored into approximated envelope memory 1103. Envelope approximating circuit 2 is comprised of ACPU, envelope approximating program memory, working memory, and like.

Reference numeral 1104 designates a display means such as CRT, and displays the envelope data given by envelope data memory 1101. Segmenting point designating means 1105 is for designating time axis dividing points, and is a switching means, for example. This designation is performed by an operator, while he is seeing the envelope data displayed by the display means 1104.

In use, the operator designates desired segmenting points to segments the time axis of the envelope on the basis of the envelope data displayed by envelope data display means 1104. The segmenting points are appropriately selected by the operator on the basis of his judgments. Then he approximates the envelope placing an emphasis on the rise part of the envelope waveform, it is necessary to segment the time axis of the envelope waveform in the rise part, more discretely. When emphasis is placed on the sustain part of the envelope waveform, such part is segmented more finely. For each of time intervals thus segmented, a function f(x) as an envelope approximating function is selected. In this instance, linear function $y=f(x)=a1x+b1$. The envelope data and the data of function f(x) as obtained by envelope approximating circuit 1102 are both applied for switching point decision means 1106. In this instance, in the segmented interval, the envelope is approximated by using linear function $y=a1x+b1$ on the basis of the minimum square method. The cross point of the linear function in the adjacent intervals, which is located at the coordinates (x, y), is obtained, and used as an optimum switching point, to determine an approximated envelope well approximating the original envelope.

Figure 39A:
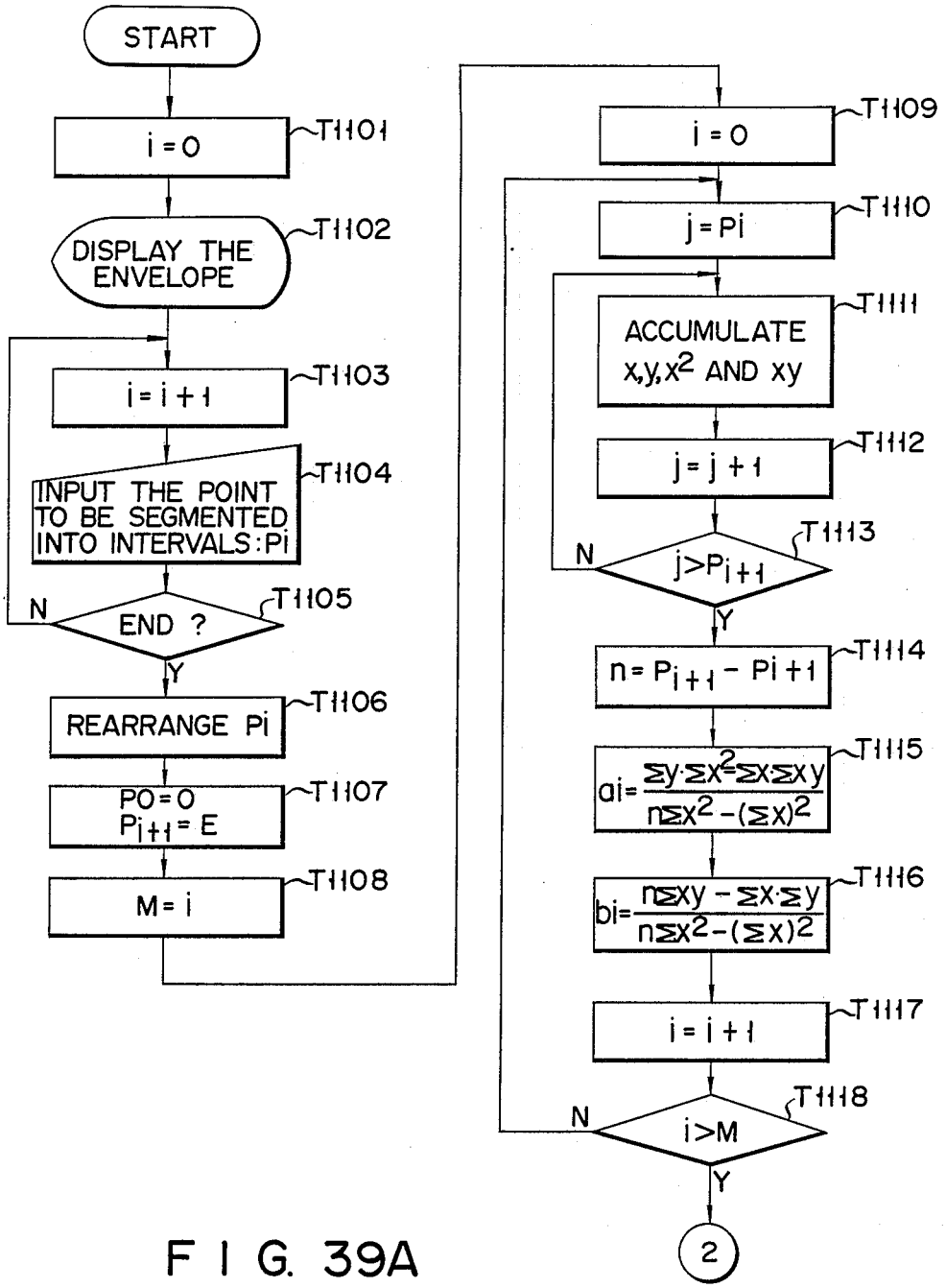
FIGS. 39A and 39B show a flow chart for explaining the operation of the envelope approximating apparatus according to, the eleventh embodiment.
Figure 39B:
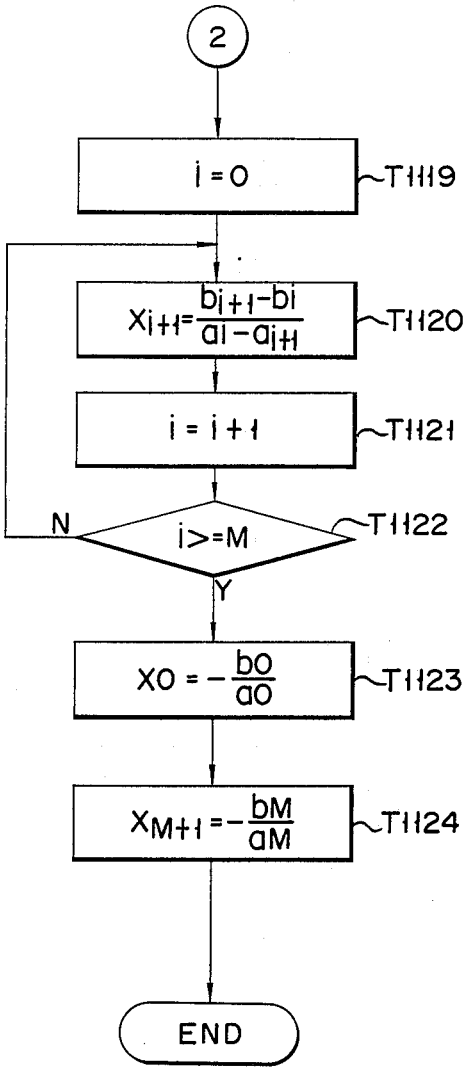

FIGS. 39A and 39B show a flow chart for explaining the operation of the FIG. 38 embodiment.

Steps T1101 to T1108 in this flowchart are used for the input/output interface and the preparatory processing. In step S1101, parameter "i" representing the number of a designated point is initialized to "0". In step S1102, display means 1104 displays the envelope data of the applied envelope, in the form of the envelope waveform. In step T1103, parameter "i" is incremented one by one, and in step T1104, an operator manually designates position P1 on the time axis (x-axis) in the interval. In step T1105, control checks if the point designation is terminated. If the answer is YES, points P1 are reordered in the order from small to large. In step T1107, "0" as the top of the envelope data is set in Po, and "E" as the end of the same is set in Pi+j. In step T1108, the designated number "i" of points is set in M.

In steps T1109 to T1118, the minimum square approximation of envelope is performed for each of point segmented intervals by using linear function $y=aix+bi$, as the approximating function f(X), to compute the coefficients of the approximating function as optimized for each interval. In step T1109, parameter *2i"* is initialized to "0". In step T1110, parameter "i" representing the number of the envelope data in each interval is set to position Pi of the i-th point, to obtain a new parameter. In step T1111, values x, y, x2 and xy in the in-interval envelope are accumulated. In step T1112, "j" is incremented one by one and the accumulation is continued until step T1113 checks if $j>Pj+1$. In step T1114, $Pi+1-Pi^{+1}$ is applied to the number "n" of samples in the intended interval. In steps T1115 and T1116, the following relations are computed $$ai=(\Sigma y\cdot\Sigma x^2-\Sigma x\cdot\Sigma xy)/(n\Sigma x^2-(\Sigma x)^2)$$

$$bi=(n\Sigma xy-\Sigma x\cdot\Sigma y)/(n\Sigma x^2-(\Sigma x)^2)$$

In this way, the approximating line for one interval is determined. Since the number of all of the intervals is (M+1), the above processing is repeated (M+1) times. In step T1117, "i" is incremented one by one, and is repeated till i=M+1 in step T1118. As a result, line coefficient combinations of (M+1), (a0, b0), (a1, b1), In steps T1119 to T1124, control computes the x-coordinates at which the cross points of approximating the lines in the adjacent point designated intervals, i.e., the optimum switching points, are located. In step T1119, "0" is set into parameter "i", and in step T1120, the x-coordinates $xi+1=(bi+1-bi)/(ai-ai+1)$ of the cross point $(xi+1, yj+1)$ at the (x, y) coordinates of linear functions $y=ai+bi$ and $y=ai+1+bj+1$. In step T1121, "i" is incremented one by one and is continued M times, i.e., from $i=0$ to $i=M-1$. When $i=M$, the answer to step T1122 is YES, and control goes to the next step. In step T1123, the cross point of the approximating line during the first interval and the x-axis is used as $x0=(b0)/(a0)$. In step T1124, the cross point of the approximating line during the last interval and the x-axis is used as $XM+1=-(bM)/aM$). Here, the processing flow ends.

The approximating functions and switching points are determined in this way. The envelope may be obtained by $y=a0x+b0$ for interval $0<x<P1$ (more exactly $x0=x<x1$), $y=a1x+b1$ for interval $P1<x<P2$ (more exactly $x1\leqq x<x2$), and $y=aix+bi$ for interval $Pi\leqq x<Pi+1$ (more exactly $xi<x<xi+1$).

In the above-mentioned embodiment, the function to optimize the envelope approximation by the minimum square method and by using the line for the approximating function f(x), is decided. The approximating function may be any other function such as exponential functions, logarithmic functions, and the like, if it is unconditionally determined when two points are given. Additionally, other suitable method to optimize the envelope approximating may be used. A switching point to minimize the difference area between the waveforms of each interval of the original envelope and the function f(x), is used as an optimum switching point. A switching point to maximize the difference function between the original envelope and the function f(x) is used as an optimum switching point. Further, a plurality of methods may be used for switching point determination.

3. Effects

As seen from the foregoing description, according to the 11th embodiment, when the envelope data extracted from the sound from natural musical instruments is applied, an operator manually segments the time axis of the envelope waveform while seeing the data on the display. Accordingly, the segmentation of the time axis may appropriately be weighted according to the situation. Therefore, the rise part of the envelope is more exactly approximated, to reproduce the musical tone features peculiar to the natural musical instrument, for example, metal tube instrument. If the sustaining part of the envelope waveform is more finely approximated, the variation in the amplitude peculiar to the sound of violin may be reproduced more exactly. In the musical tone with quick phrases, it is approximated emphasizing the rise part of the envelope waveform In the musical tone with long phrases, i.e., with slow tempo and long keying time, it is substantially uniformly approximated over the entire envelope. Thus, the envelope approximating apparatus is variably and flexibly applicable for various types of musical tone envelope approximation.

12th Embodiment

1. General

A 12th embodiment of an envelope approximating apparatus according to the present invention will be described referring to FIGS. 40 to 43.

The 12th embodiment is based on a similar technical idea to that of the 11th embodiment.

This envelope approximating apparatus eliminates the use of the display means for the original envelope data, such as CRT, and can execute the envelope approximation uniformly even if difference operators operate the envelope approximating apparatus. To attain the uniformity of approximation, the segmenting points are automatically determined on the basis of the total number of designated switching points.

An envelope waveform expressed by the envelope data of an applied musical tone is approximated by a limited number of function waveforms whose characteristics changes at switching points. The total number of switching points is designated by a user. Segmenting points are determined on the basis of that total number automatically, not by the user. To this end, a segmenting point determining means is provided, and operates to select one of different segmenting conversion function, and to compute the segmenting points according to the selected conversion function A function to optimumly approximate the envelope in the interval segmented by the segmenting point determining means, is determined to obtain the approximated envelope for each interval. A cross point of the function in the adjacent intervals is obtained as an optimum switching point An envelope waveform expressed by a large amount of the original envelope data is optimumly approximated by a limited number of function waveforms whose characteristics are switched at the optimum switching points. Therefore, the data can be compressed without losing the features of the original sound of the original envelope data. It is easy to generate specific envelope data from the compressed data expressed by the sets of optimum switching points. This can be made by computing the data of the function curve connecting the optimum switching points.

According to the 12th embodiment of the present invention, the segmenting points are automatically determined on the basis of the switching points as specified by the user. The function waveform optimumly approximated for each interval is determined. A cross point of the function waveforms approximated in the adjacent intervals is used as an optimum switching point. Therefore, in the approximation of the envelope curve, the envelope is appropriately weighted with respect to the time axis.

2. Description of Arrangement and Operation

12th embodiment of the present invention will be described referring to the accompanying drawings.

Figure 40:
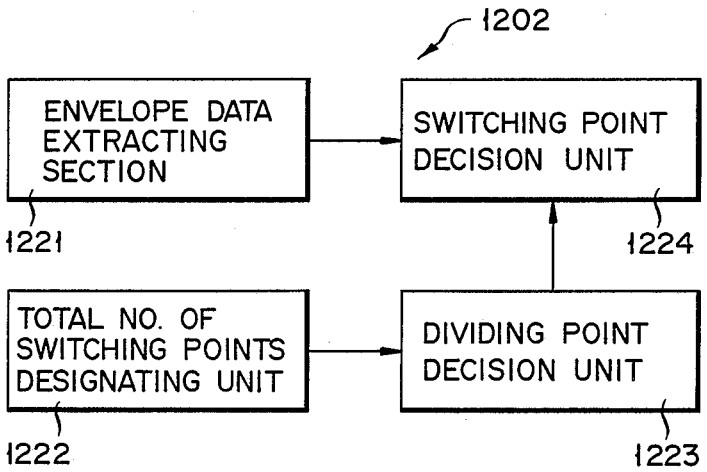
FIG. 40 shows a circuit arrangement of a key portion of an envelope approximating apparatus according to a twelfth embodiment of the present invention.

FIG. 40 shows an arrangement of an envelope approximating apparatus according to the present invention. In the figure, envelope approximating circuit 1201 approximates the waveform of the original envelope data by a limited number of function waveforms, to form approximated envelope data as congregation of optimum switching points. In envelope data extracting section 1221, the original envelope data is extracted. Designating section 1222 for designating the total number of switching points is used for the total number of segmenting points for segmenting the envelope data. The user designates the total number by using designating section 1222. Segmenting point determining section 1223 determines the coordinates on the time axis (x-axis) of the segmenting points. The original envelope data from envelope data extracting section 1221 and the segmenting points from segmenting points determining section 1223 are applied to switching point determining section 1224. In this instance, in each interval, the envelope is approximated by linear function $y=aix+bi$ by using the minimum square method. A cross point of the linear functions respectively determined in the adjacent intervals, is obtained on the coordinates (x, y). The coordinates of the cross point is used as an optimum point. These optimum points thus obtained are used for determining the approximated envelope for the original envelope.

Figure 41A:
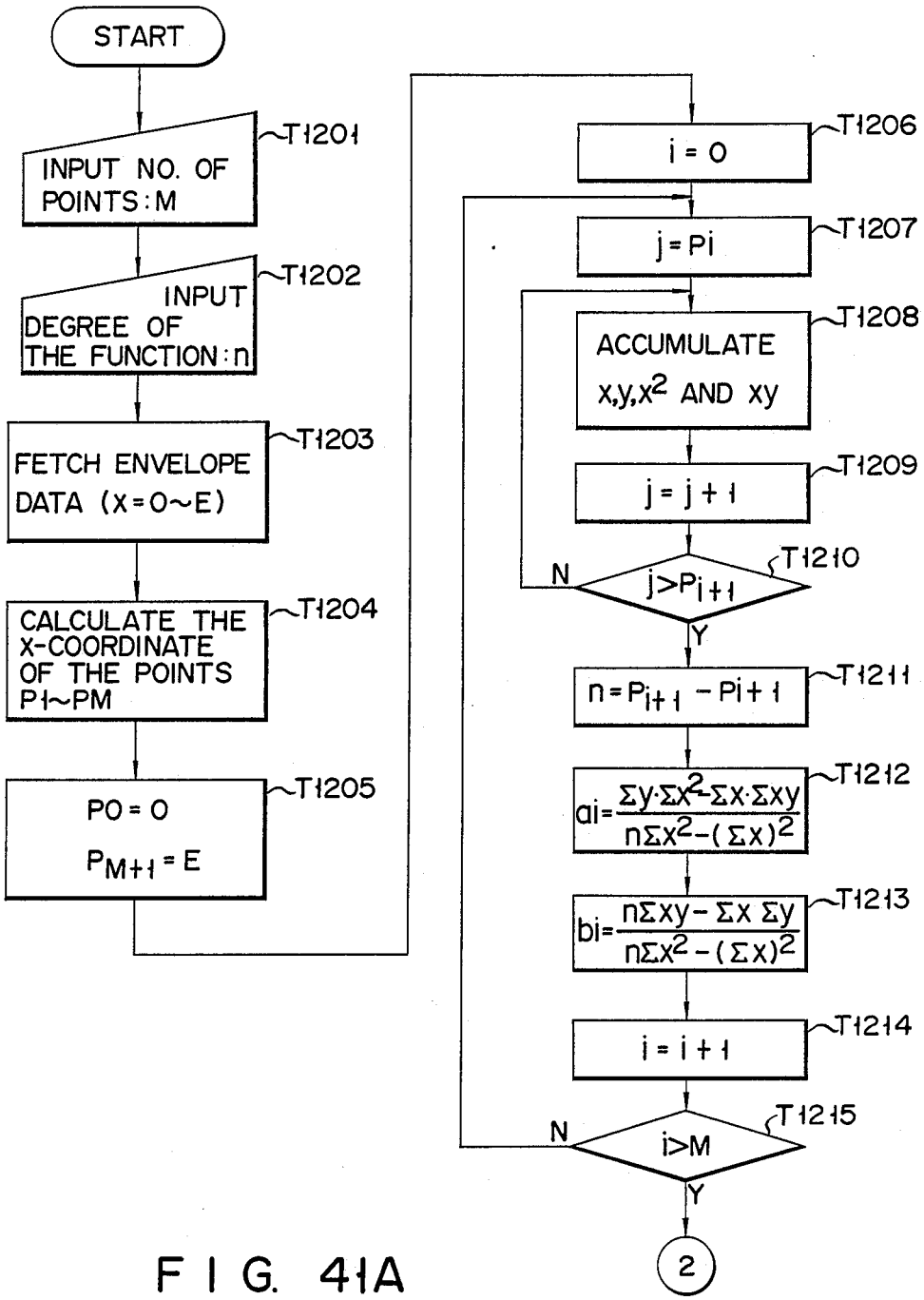
FIGS. 41A and 41B show a flow chart for explaining the operation of the envelope approximating apparatus of FIG. 40.
Figure 41B:
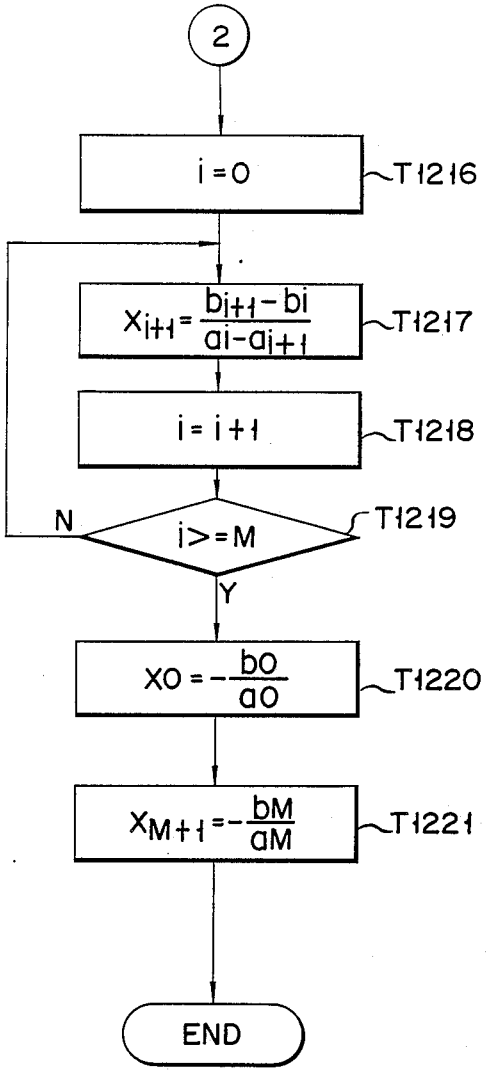
Figure 42:
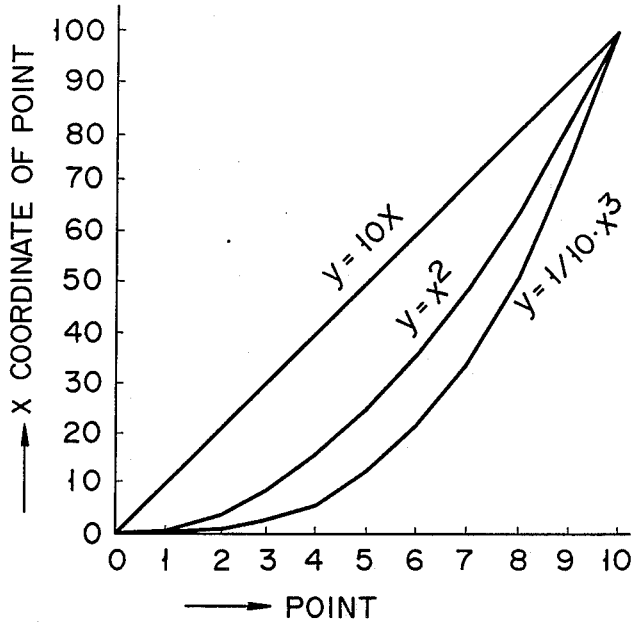
FIG. 42 shows a graph illustrating a conversion function, which is useful in explaining the envelope approximation.

FIG. 41 shows a flow chart for explaining the operation of the embodiment shown in FIGS. 39A and 39B. In the flow chart, steps T1201 to T1221 following the start of program flow, are for the input/output interface, and for determining the points to segmenting the time axis (x-axis) of the original envelope data. In step T1201, the number of segmenting points are entered and set as M. A function of n-degree, which can be designated by a user, is determined as a conversion function for outputting the segmenting points coordinates on the time-axis (x-axis). In step T1202, the degree of the function is set as "n" and entered. In step T1203, control fetches the envelope data for the points of $(E-1)$ $(E=0$ to $x=E)$ on the time axis. In step T1204, x-axis coordinates P1 to PM at the points are computed. FIG. 42 shows a conversion function to determine segmenting points when $n=1$ to 3, $E=100$, and $M=9$. In FIG. 42, the x-axis represents the number of the point based on the total number of points as designated, that is, what order of the point is used. The y-axis represents the x-coordinates of these points. When $n=1$, the lengths of those intervals are equal to one another. Therefore, the envelope approximation is uniformly weighted with respect to time axis. When $n=2$, the lengths of these intervals are 0 to 1, 1 to 4, 4 to 9, 9 to 16, 16 to 25, 25 to 36, . . . in the order of the x-coordinates values from small to large. These figures show that in the small x-coordinates of points, i.e., in the rise part of the envelope, the envelope approximation is finely performed. As the coordinates is larger, the envelope approximation is made more roughly, i.e., in more coarse intervals. When $n=3$, the rise part of the envelope is more finely approximated. With elapsing of time, the approximating intervals are more coarse. In step T1205, the coordinates values at the 0th and $(M+1)$-th points are set as $Po=0$ and $PM+1=E$, and all of points are determined. The conversion function to determine the segmenting points is $y=ax^n+b$. Let us obtain constants "a" and "b", when $n=1$ to 3 degree. Since $x=0$, $y=0$ and hence $b=0$. When $x=M+1$, $y=a(M+1)^n$, and hence $a=E/(M+1)^n$. When $n=1$ and $M=9$, $a=100/10=10$, and we have $y=10x$. When $n=2$ and $M=9$, $a=100/10^2$, and hence $y=x2$. When $n=3$ and $M=9$, $a=100/10^3=1/10$, $y=1/10$ and hence $y=(1/10)x^3$.

In steps T1206 to T1215, the envelope approximation is independently made for each of the intervals which are segmented by segmenting points as judged in previous steps. In this instance, linear function $y=aix+bi$ is used as the approximating function f(X), to determine the function to optimize the envelope approximation based on the minimum square method, for each interval. In step T1206, parameter "i" is initialized to "0". In step T1207, the position Pi of the i-th point is set into parameter "j" representing the number of the envelope data in each interval, to obtain a new parameter. In step T1208, values x, y, $x^2$ and xy in the in-interval envelope are accumulated. In step T1209, "j" is incremented one by one and the accumulation is continued until step T1210 checks if $j>Pj+1$. In step T1211, $Pi+1-Pi+1$ is applied to the number "n" of samples in the intended interval. In steps T1212 and T1213, the following relations are computed.

$$ai=(\Sigma y\cdot\Sigma x^2-\Sigma x\cdot\Sigma xy)/(n\Sigma x^2-(\Sigma x)^2)$$

$$bi=(n\Sigma xy-\Sigma x\cdot\Sigma y)/(n\Sigma x^2-(\Sigma x)^2)$$

In this way, the approximating line for one interval is determined. Since the number of all of the intervals is $(M+1)$, the above processing is repeated $(M+1)$ times. In step T1214, "i" is incremented one by one, and is repeated titl $i=M+1$ in step T1215. As a result, line coefficient combinations of $(M+1)$, (a0, b0), (a1, b1), . . . (aM, BM) are obtained.

In steps T1216 to T1221, control program computes the x-coordinates at which the cross points of approximating lines in the adjacent point designated intervals, i.e., the optimum switching points, are located. In step T1216, "0" is set into parameter "i", and in step T1217, control computes the x-coordinates $xi+1=(bi+1\ bi)/(ai-ai+1)$ of the cross point $(xi+1, yj+1)$ at the (x, y) coordinates of linear functions $y=ai+bi$ and $y=ai+1+bj+1$. In step T1218, "i" is incremented one by one and is continued M times, i.e., from $i=0$ to $i=M-1$. When $i=M$, the answer to step T1219 is YES, and control goes to the next step. In step T1220, the cross point of the approximating line during the first interval and the x-axis is used as $x0=-(b0)/(a0)$. In step T1221, the cross point of the approximating line during the last interval and the x-axis is used as $xM+1=-(bM)/(aM)$. Here, the processing flow ends.

Since the approximation function and the switching points can be determined in the described manner, the approximation envelope may be obtained by using the equation $y=a0x+b0$ for interval $0<x<P1$ (more exactly $x=x<x1$), $y=a1x+b1$ for interval $P1<x<P2$ (more exactly $xl=x<x2$), and $y=aix+bi$ for interval $Pi<x<Pi+1$ (more exactly $xi=x<xi+1$).

In the above-mentioned embodiment, the function to optimize the envelope approximation by the minimum square method and by using the line for the approximating function f(x), is determined. The approximating function may be any other function such as exponential functions, logarithmic functions, and the like, if it is unconditionally determined when two points are given. Additionally, other suitable method to optimize the envelope approximating may be used. A switching point to minimize the difference area between the waveforms of each interval of the original envelope and the function f(x), is used as an optimum switching point. A switching point to maximize the difference function between the original envelope and the function f(x) is used as an optimum switching point. Further, a plurality of methods may be used for switching point determination.

3. Modification of 12th Embodiment

Figure 43:
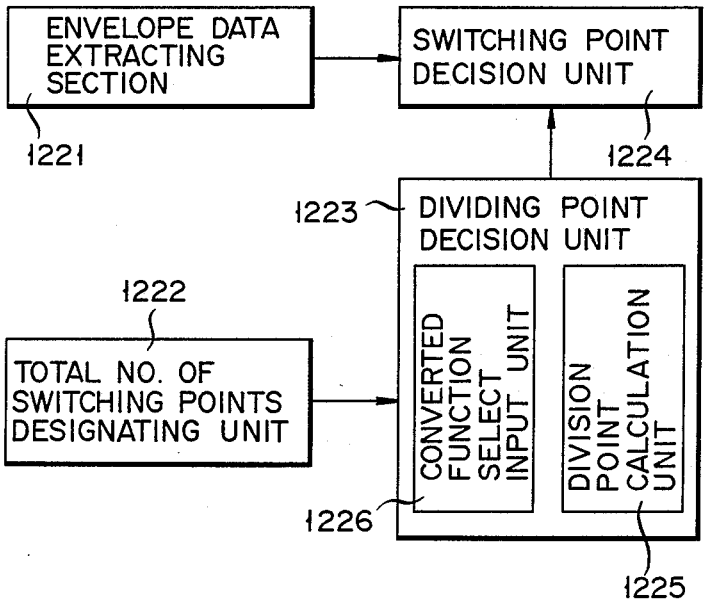
FIG. 43 shows a circuit diagram of a modification of the twelfth embodiment.

FIG. 43 shows a key portion of an envelope approximating apparatus as a modification of the 12th embodiment. Like reference symbols are used for designating like or equivalent portions of FIG. 40.

In FIG. 40, segmenting point determining means 1223 contains conversion function select input means 1226 and segmenting point computing means 1225. This means 1226 selects the conversion function to output the time-axis coordinates of the segmenting points, in order to determine the segmenting points on the time axis of the envelope data, according to the number of switching points designated by designating means 1222. The conversion function may be the exponential function or the n-degree function whose degree may be designated by the user. Conversion function select input means 1226 selects one of different segmenting point conversion functions, and enters the machine. Dividing point computing means 1225 computes the positions on the time axis for the points corresponding to segmenting point number, i.e., the x-coordinates P1 to PM. As in the envelope approximating apparatus 1202 as described referring to FIG. 40, the time-axis (x-coordinates) coordinates of segmenting points are determined by the value of the x-axis coordinates of the segmenting points as obtained by segmenting point computing means 1225. The operations of envelope data extracting section 1221 and switching point determining means 1224 are similar to that of envelope approximating apparatus 1202 in the FIG. 40 embodiment. Therefore, if the linear function is used for the conversion function, the envelope may be approximated uniform with respect to time. If the user selects the function of high degree, for 2nd or 3rd degree, for the conversion function, the envelope approximation is possible with the finely approximated in its rise part. In this way, if the user selects and input the conversion function is selectively input to the machine, the segmenting points of the envelope time axis is automatically determined, and an optimum switching point is selected also automatically.

4. Effects

As seen from the foregoing description, according to above-mentioned embodiments, when the envelope data extracted from the musical tone generated by a natural musical instrument, is applied to the approximating apparatus, the segmenting points on the envelope time axis are automatically determined by merely designating the total number of the switching points. As a result, the envelope appropriately weighted with respect to time can be approximated optimumly. Thus, the envelope approximating apparatus according to this invention can execute exact approximation with appropriately weighted switching points with respect to time, without any special display means for displaying the envelope, and free from the error due to the different knowledge of operators.

The present invention is not limitative to the described first to 12th embodiments. A combination of two or more of embodiments or modifications of the embodiments may also be included within the scope of this invention. The envelope extraction apparatus can be operative independently from the envelope approximation apparatus. Therefore, a system in which an envelope data is extracted from an input waveform signal and the extracted data is processed in a various way, a system in which an envelope waveform is displayed on a display unit, and a system for eliminating an envelope component from the input waveform signal may be realized by applying the present invention.

A waveform normalizing apparatus for normalizing an input waveform by eliminating an envelope is disclosed in U.S. patent application Ser. No. 910,207 filed on Sept. 22, 1986.

The described embodiments thereof are applicable to many usages. The present invention is also applicable to an envelope generating apparatus.

What is claimed is:

1. An envelope generating apparatus for an electronic musical instrument, comprising:

envelope extracting means for extracting an envelope waveform defined by a plurality of envelope data, including:

dividing means for dividing sampled waveform data into a plurality of segmental waveform data, each of which has a predetermined time period, and extracting means for extracting a plurality of envelope data from the sampled waveform data for each of the predetermined time periods, in accordance with a characteristic of a waveform defined by the segmental waveform data obtained by said dividing means; and envelope approximating means for approximating the envelope waveform defined by the plurality of envelope data extracted by said extracting means, including means for generating a limited number of function waveforms having characteristics that change at determined switching points, and means for determining said switching points so as to minimize error between an approximated envelope waveform produced from the limited number of function waveforms by said generating means, and the envelope waveform defined by said plurality of envelope data.

2. The apparatus according to claim 1, in which said envelope extracting means includes means for using the fundamental period of the waveform expressed by said sampled waveform data, for said predetermined time period.

3. The apparatus according to claim 2, in which said envelope extracting means includes means for extracting the envelope data in accordance with the maximum value of the segmental waveform data contained in each of said predetermined time periods.

4. The apparatus according to claim 1, in which said envelope extracting means includes means for obtaining maximum and minimum values of the sampled waveform data contained in each of said predetermined time periods, and determining means for determining the envelope data inherent in each predetermined time period on the basis of the maximum and minimum data as obtained for each predetermined time period.

5. The apparatus according to claim 4, in which said envelope extracting means includes means for using the fundamental period of the waveform expressed by said sampled waveform data, for said predetermined time period.

6. The apparatus according to claim 1, in which said envelope extracting means includes means for computing the waveform area of the sampled waveform data contained in each of said predetermined time periods, and determining means for determining the envelope data inherent in each predetermined time period on the basis of the waveform area computed for each predetermined time period.

7. The apparatus according to claim 6, in which said envelope extracting means includes means for using the fundamental period of the waveform expressed by said sampled waveform data, for said predetermined time period.

8. The apparatus according to claim 1, in which said envelope extracting means includes means for computing the square sum of the sampled waveform data contained in each of said predetermined time periods, and determining means for determining the envelope data inherent in each predetermined time period on the basis of the square sum computed for each predetermined time period.

9. The apparatus according to claim 8, in which said envelope extracting means includes means for using the fundamental period of the waveform expressed by said sampled waveform data, for said predetermined time period.

10. The apparatus according to claim 1, in which said envelope approximating means includes function data generating means for generating function data, computing means for computing an evaluation value of an error between said function data and the envelope data, and switching point determining means for determining a switching point to optimize said evaluation value.

11. The apparatus according to claim 10, in which said function data generating means uses at least one of linear, exponential, triangle and logarithmic function 12. The apparatus according to claim 1, in which said envelope approximating means includes linear data generating means for generating linear data, computing means for computing the total sum of the errors between the linear data from said linear data generating means and the envelope data, and switching point determining means for determining a switching point to substantially minimize the total sum of said errors.

13. The apparatus according to claim 1, in which said envelope approximating means includes linear data generating means for generating linear data, computing means for computing the square sum of the errors between the linear data from said linear data generating means and the envelope data, and switching point determining means for determining a switching point to substantially minimize the square sum of said errors.

14. The apparatus according to claim 1, in which said envelope approximating means includes exponential curve data generating means for generating exponential curve data, computing means for computing the total sum of the errors between the exponential curve data from said exponential curve data generating means and the envelope data, and switching point determining means for determining a switching point to substantially minimize the total sum of said errors.

15. The apparatus according to claim 1, in which said envelope approximating means includes exponential curve data generating means for generating exponential curve data, computing means for computing the square sum of the errors between the exponential curve data from said exponential curve data generating means and the envelope data, and switching point determining means for determining as switching point to substantially minimize the square sum of said errors.

16. The apparatus according to claim 1, in which said envelope approximating means includes linear data generating means for generating linear data connecting two points, computing means for computing a maximum distance between said linear data and the envelope data, and switching point determining means for determining a switching point on the basis of said maximum distance.

17. The apparatus according to claim 1, in which said envelope approximating means includes exponential curve data generating means for generating exponential curve data connecting two points, computing means for computing a maximum distance between said exponential curve data and the envelope data, and switching point determining means for determining a switching point on the basis of said maximum distance.

18. An envelope approximating apparatus which approximates an envelope waveform described by envelope data, in the form of a limited number of function waveforms whose characteristic changes at switching points, said apparatus comprising:

function data generating means for generating function data corresponding to said limited number of function waveforms;

computing means coupled to said function data generating means for computing an evaluation value corresponding to an error between said function data and the envelope data representative of said envelope waveforms and switching point deciding means coupled to said computing means for deciding a switching point to be provided between successive ones of the limited number of function waveforms, for optimizing said evaluation value in accordance with the limited number of function waveforms.

19. The apparatus according to claim 18, in which said function data generating means includes linear data generating means for generating linear data, said computing means includes means for computing errors between said linear data and the envelope data, and said switching point determining means includes means for determining a switching point to substantially minimizing the total sum of said errors.

20. The apparatus according to claim 1, in which said function data generating means includes linear data generating means for generating linear data, said computing means includes means for computing the square sum of errors between said linear data and the envelope data, and said switching point determining means includes means for determining a switching point to substantially minimizing the square sum of said errors.

21. The apparatus according to 18, in which said function data generating means includes exponential curve data generating means for generating exponential curve data, said computing means includes means for computing the total sum of errors between said exponential curve data and the envelope data, and said switching point determining means includes means for determining a switching point to substantially minimizing the total sum of said errors.

22. The apparatus according to claim 18, which said function data generating means includes exponential curve data generating means for generating exponential curve data, said computing means includes means for computing the square sum of errors between said exponential curve data and the envelope data, and said switching point determining means includes means for determining a switching point to substantially minimizing the square sum of said errors.

23. The apparatus according to claim 18, in which said function data generating means includes linear data generating means for generating linear data connecting two points, said computing means includes means for computing a maximum distance between said linear data and the envelope data, and said switching point determining means includes means for determining a switching point on the basis of said maximum distance.

24. The apparatus according to claim 18, in which said function data generating means includes exponential curve data generating means for generating exponential curve data connecting two points, said computing means includes means for computing a maximum distance between said exponential curve data and the envelope data, and said switching point determining means includes means for determining a switching point on the basis of said maximum distance.

* * * * *